US011597557B2

(12) United States Patent
Ward et al.

(10) Patent No.: US 11,597,557 B2
(45) Date of Patent: Mar. 7, 2023

(54) RECONFIGURABLE BEVERAGE CRATE

(71) Applicant: Rehrig Pacific Company, Los Angeles, CA (US)

(72) Inventors: Suzanne Clark Ward, Santa Monica, CA (US); Shelby Frances Apps, Brookhaven, GA (US); Brian Robert Guerry, Huntington Beach, CA (US); William P. Apps, Alpharetta, GA (US); Margaret Wilson Garratt, Charlotte, NC (US)

(73) Assignee: Rehrig Pacific Company, Los Angeles, CA (US)

( * ) Notice: Subject to any disclaimer, the term of this patent is extended or adjusted under 35 U.S.C. 154(b) by 493 days.

(21) Appl. No.: 16/593,096

(22) Filed: Oct. 4, 2019

(65) Prior Publication Data

US 2020/0108969 A1 Apr. 9, 2020

Related U.S. Application Data

(60) Provisional application No. 62/741,392, filed on Oct. 4, 2018.

(51) Int. Cl.
*B65D 1/24* (2006.01)
*B65D 21/08* (2006.01)

(52) U.S. Cl.
CPC ..... *B65D 1/243* (2013.01); *B65D 21/08* (2013.01); *B65D 21/086* (2013.01); *B65D 2501/24063* (2013.01); *B65D 2501/24286* (2013.01)

(58) Field of Classification Search
CPC ..... B65D 1/243; B65D 21/08; B65D 21/083; B65D 21/086; B65D 21/06; B65D 21/062; B65D 2501/24063; B65D 2501/24286
USPC ..... 220/4.26; 206/586
See application file for complete search history.

(56) References Cited

U.S. PATENT DOCUMENTS

| | | | |
|---|---|---|---|
| 94,202 | A | 8/1869 | Gustavson |
| 1,028,933 | A | 6/1912 | Compton |
| 1,082,274 | A | 12/1913 | Lapish |
| 1,330,338 | A | 2/1920 | Peavy |
| 1,378,614 | A | 5/1921 | McLeod et al. |
| 1,389,199 | A | 8/1921 | Leonard |
| 1,407,054 | A | 2/1922 | Farley |
| 1,443,901 | A | 1/1923 | Murray |

(Continued)

FOREIGN PATENT DOCUMENTS

| | | | |
|---|---|---|---|
| CA | 2069226 | A1 | 3/1993 |
| CA | 2309234 | A1 | 11/2000 |

(Continued)

OTHER PUBLICATIONS

U.S. Appl. No. 13/117,195.
U.S. Appl. No. 16/593,096.

*Primary Examiner* — Andrew D Perreault
(74) *Attorney, Agent, or Firm* — Carlson, Gaskey & Olds, P.C.

(57) ABSTRACT

A beverage crate includes a base and a plurality of walls extending upward from the base. The base together with the plurality of walls define a container interior for receiving beverage containers. By reconfiguring the crate, the storage volume of the container interior is selectively adjustable to accommodate different size beverage containers. Thus, the same crate could be used for different size beverage containers.

18 Claims, 52 Drawing Sheets

(56) References Cited

U.S. PATENT DOCUMENTS 1,611,629 A 12/1926 Artas
1,671,051 A 5/1928 Soderquist
1,689,217 A 10/1928 White
1,809,523 A 6/1931 McLean
1,869,071 A 7/1932 McLean
1,980,482 A 11/1934 Golden
2,134,875 A 11/1938 Henze
2,221,504 A 11/1940 Beasley et al.
2,297,097 A 9/1942 Best
2,462,693 A 2/1949 Wabshaw
2,497,453 A 2/1950 Hazen
2,512,522 A 6/1950 Denny
2,528,551 A 11/1950 Ross
2,553,607 A 5/1951 Rosenberg
2,667,398 A 1/1954 Claflin
2,714,466 A 8/1955 Killeen
2,731,761 A 1/1956 Marshall
2,747,748 A 5/1956 Barefoot
2,755,955 A 7/1956 Gordon
2,759,622 A 8/1956 Simmons et al.
2,760,669 A 8/1956 Kreutzer
2,777,627 A 1/1957 Crane
2,780,381 A 2/1957 Coit, Jr.
2,782,950 A 2/1957 Corr
2,785,822 A 3/1957 Kus
2,843,280 A 7/1958 Stopps
2,847,794 A 8/1958 Loud et al.
2,850,204 A 8/1958 Rehrig
2,868,406 A 1/1959 Kookogey
2,964,211 A 12/1960 Pfeffer
2,982,419 A 5/1961 Shiels
3,000,049 A 9/1961 Terry, Jr.
RE25,050 E 10/1961 Hamilton
3,048,147 A 8/1962 McKean
3,095,965 A 7/1963 Stahl et al.
3,122,127 A 2/1964 Shechmeister et al.
3,130,850 A 4/1964 Oakey et al.
3,151,576 A 10/1964 Patterson
3,186,585 A 6/1965 Denny
3,220,603 A 11/1965 Bromley
3,270,913 A 9/1966 Bridenstine et al.
3,272,377 A 9/1966 Schray
3,311,254 A 3/1967 Beh
3,360,180 A 12/1967 Venturi
3,372,829 A 3/1968 Averill
3,374,915 A 3/1968 Verhein et al.
3,379,339 A 4/1968 Asenbauer
3,398,850 A 8/1968 Kennard
3,421,656 A 1/1969 Asenbauer
3,446,145 A 5/1969 Weeks et al.
3,446,415 A 5/1969 Bromley
3,448,914 A 6/1969 Scholz
3,497,127 A 2/1970 Box
3,516,592 A 6/1970 Friedrich
3,591,212 A 7/1971 Rhyne
3,685,718 A 8/1972 Chidgey
3,747,794 A 7/1973 Bitney
3,770,186 A 11/1973 Kupersmit
3,782,579 A 1/1974 Zarges
3,796,342 A 3/1974 Sanders et al.
3,804,033 A 4/1974 Izawa et al.
3,814,220 A 6/1974 Brody
3,821,861 A 7/1974 Jalbert
3,840,115 A 10/1974 Ladewig
3,853,238 A 12/1974 Luisada et al.
3,874,546 A 4/1975 Sanders et al.
3,895,715 A 7/1975 Drader
3,904,066 A 9/1975 Wilson
3,941,271 A 3/1976 Zarges et al.
3,951,265 A 4/1976 Carroll
3,955,703 A 5/1976 Zebarth
3,970,209 A 7/1976 Baxter
3,973,692 A 8/1976 Cloyd
3,981,410 A 9/1976 Schurch
3,982,650 A 9/1976 Ichihara
4,005,795 A 2/1977 Mikkelsen et al.
4,030,232 A 6/1977 Niva
4,030,600 A 6/1977 Heaps
4,043,476 A 8/1977 Joseph
4,044,910 A 8/1977 Box
4,049,113 A 9/1977 Joyce et al.
4,062,467 A 12/1977 Friedrich
4,081,099 A 3/1978 Shead
4,090,633 A 5/1978 Frubiano
4,106,623 A 8/1978 Carroll et al.
4,109,791 A 8/1978 Clipson et al.
4,120,417 A 10/1978 Aquino
4,148,407 A 4/1979 Sinclair
4,159,591 A 7/1979 Plante
4,163,495 A 8/1979 Drader
4,170,313 A 10/1979 Caves et al.
4,181,236 A 1/1980 Prodel
4,186,841 A 2/1980 Buckley et al.
4,192,430 A 3/1980 Cornou
4,214,669 A 7/1980 McQuiston
4,235,345 A 11/1980 VandeDrink et al.
4,241,831 A 12/1980 Locatelli
4,247,004 A 1/1981 Bird
4,293,069 A 10/1981 Partain
4,300,695 A 11/1981 Hsu
4,314,686 A 2/1982 Marz
4,320,845 A 3/1982 Waller
4,342,393 A 8/1982 Box
4,391,369 A 7/1983 Stahl et al.
4,406,380 A 9/1983 Paige
4,417,686 A 11/1983 Wozniacki
4,423,813 A 1/1984 Kreeger et al.
4,466,541 A 8/1984 Tabler et al.
4,505,422 A 3/1985 Vossen
4,508,237 A 4/1985 Kreeger et al.
4,573,577 A 3/1986 Miller
4,579,220 A 4/1986 Brundage
4,591,065 A 5/1986 Foy
RE32,223 E 8/1986 Kreeger et al.
4,619,366 A 10/1986 Kreeger
4,624,381 A 11/1986 Friedrich
4,643,310 A 2/1987 Deaton et al.
4,648,199 A 3/1987 Deaton et al.
4,648,200 A 3/1987 Miller et al.
4,662,532 A 5/1987 Anderson et al.
4,663,803 A 5/1987 Gora
4,676,534 A 6/1987 Hix, Jr.
4,693,386 A 9/1987 Hughes et al.
4,720,013 A 1/1988 Nichols et al.
4,720,020 A 1/1988 Su
4,726,486 A 2/1988 Masuda
4,735,330 A 4/1988 Hoss
4,735,331 A 4/1988 Keenan et al.
4,759,149 A 7/1988 Dunn
4,773,533 A 9/1988 Greene
4,775,068 A 10/1988 Reiland et al.
4,781,300 A 11/1988 Long
4,798,304 A 1/1989 Rader
4,807,774 A 2/1989 Karpisek
4,820,383 A 4/1989 Schamorov et al.
4,846,089 A 7/1989 Cedergreen
4,848,578 A 7/1989 Schafer
4,863,062 A 9/1989 Holliday
4,887,747 A 12/1989 Ostrowsky et al.
4,887,874 A 12/1989 Joffe
4,901,859 A 2/1990 Jones
4,905,833 A 3/1990 Kreeger et al.
4,909,188 A 3/1990 Tominaga
4,917,255 A 4/1990 Foy et al.
4,923,079 A 5/1990 Foy
4,946,093 A 8/1990 Moorman
4,947,992 A 8/1990 Schafer
4,953,735 A 9/1990 Tisbo et al.
4,960,223 A 10/1990 Chiang et al.
4,967,927 A 11/1990 Reiland et al.
5,016,772 A 5/1991 Wilk
5,022,529 A 6/1991 Kang
5,038,953 A 8/1991 Radar
5,048,715 A 9/1991 Wolff

(56) References Cited

U.S. PATENT DOCUMENTS 5,076,457 A 12/1991 Marovskis
5,083,666 A 1/1992 Lam
5,092,270 A 3/1992 Simons et al.
5,094,356 A 3/1992 Miller
5,109,980 A 5/1992 Matsuoka et al.
5,114,037 A 5/1992 Hillis et al.
5,161,709 A 11/1992 Oestreich, Jr.
5,199,592 A 4/1993 Reiland et al.
5,289,935 A 3/1994 Hillis et al.
5,331,763 A 7/1994 Miller
5,332,114 A 7/1994 Sano et al.
5,398,825 A 3/1995 Erwin
5,398,834 A 3/1995 Umiker
5,398,835 A 3/1995 Blinstrub
5,429,261 A 7/1995 Machino
5,467,885 A 11/1995 Blinstrub
5,469,986 A 11/1995 Jang
5,474,197 A 12/1995 Hillis et al.
5,494,163 A 2/1996 Apps
5,501,354 A 3/1996 Stromgberg
5,515,987 A 5/1996 Jacques et al.
5,538,153 A 7/1996 Marovskis et al.
5,558,241 A 9/1996 Huffstutler, Jr. et al.
5,562,224 A 10/1996 Pascal et al.
5,564,599 A 10/1996 Barber et al.
5,586,675 A 12/1996 Borsboom et al.
5,588,549 A 12/1996 Furtner
5,595,305 A 1/1997 Hart
5,609,254 A 3/1997 Loftus et al.
5,622,276 A 4/1997 Simmons
5,632,114 A 5/1997 McKenzie
5,632,392 A 5/1997 Oh
D381,203 S 7/1997 Ackermann et al.
5,660,291 A 8/1997 Dash
5,671,857 A 9/1997 Stromberg
5,699,926 A 12/1997 Jacques et al.
5,720,405 A 2/1998 Karpisek
5,746,342 A 5/1998 Jacques et al.
5,772,033 A 6/1998 Loftus et al.
5,788,103 A 8/1998 Wagner et al.
5,797,508 A 8/1998 Loftus et al.
5,829,617 A 11/1998 Umiker
5,853,099 A 12/1998 Lessard
5,860,527 A 1/1999 Frankenberg et al.
5,918,743 A 7/1999 Uitz
5,924,572 A 7/1999 Cope
5,938,059 A 8/1999 Luburic
5,950,546 A 9/1999 Brown et al.
5,967,356 A 10/1999 Laarhoven et al.
5,975,324 A 11/1999 Schmitt
5,988,420 A 11/1999 Jacques et al.
6,015,056 A 1/2000 Overhold et al.
6,029,840 A 2/2000 Brauner
D423,217 S 4/2000 Varfeldt
D424,299 S 5/2000 Varfeldt
6,056,177 A 5/2000 Schneider
6,059,114 A 5/2000 Loftus
6,073,790 A 6/2000 Umiker
6,082,570 A 7/2000 Tai
6,098,827 A 8/2000 Overholt et al.
6,131,757 A 10/2000 Clark et al.
6,138,851 A 10/2000 Townson
6,142,329 A 11/2000 Dotan
6,170,689 B1 1/2001 Flesher et al.
6,179,156 B1 1/2001 Aiken
6,189,695 B1 2/2001 Ching-rong
6,209,741 B1 4/2001 Boucher-Giles
6,209,742 B1 4/2001 Overholt et al.
6,223,911 B1 5/2001 Weaver
6,267,079 B1 7/2001 Eby
D446,392 S 8/2001 Overholt et al.
6,283,319 B1 9/2001 Hillis et al.
6,286,701 B1 9/2001 Umiker
6,290,081 B1 9/2001 Merey
6,293,417 B1 9/2001 Varfeldt
6,293,418 B1 9/2001 Ogden et al.
6,305,566 B1 10/2001 Pigott et al.
D452,614 S 1/2002 Overholt
6,382,458 B2 5/2002 Mori
6,386,388 B1 5/2002 Overholt
D458,753 S 6/2002 Overholt et al.
6,398,054 B1 6/2002 Overholt et al.
6,401,953 B2 6/2002 Kofod
6,405,888 B1 6/2002 Overholt et al.
6,409,041 B1 6/2002 Overholt et al.
6,415,938 B1 7/2002 Karpisek
6,446,825 B1 9/2002 Godoy
6,460,717 B1 10/2002 Smyers et al.
D466,392 S 12/2002 Halajko
6,488,168 B1 12/2002 Wang
6,581,330 B1 6/2003 Helsloot et al.
6,581,771 B2 * 6/2003 McDade ..... B65D 21/062 206/505
6,601,724 B1 8/2003 Koefelda et al.
6,623,059 B2 9/2003 Gehring et al.
6,631,822 B1 10/2003 Overholt
6,669,044 B2 12/2003 Murakami et al.
6,691,885 B2 2/2004 Brown
6,702,135 B2 3/2004 Pickler
6,722,516 B1 4/2004 Zelko
6,772,897 B2 8/2004 Kellerer et al.
6,820,761 B1 11/2004 Mouri et al.
6,863,180 B2 3/2005 Apps et al.
6,899,242 B2 5/2005 Overholt et al.
6,918,502 B1 7/2005 Overholt et al.
6,981,605 B2 1/2006 Kasuya et al.
6,994,216 B2 2/2006 Wong
7,011,225 B2 3/2006 Oster et al.
7,017,765 B2 3/2006 Overholt
7,017,766 B2 3/2006 Hsu et al.
7,044,319 B2 5/2006 Overholt et al.
7,048,134 B1 5/2006 Hagan
7,059,489 B2 6/2006 Apps et al.
7,063,223 B2 6/2006 Iwahara et al.
7,100,786 B2 9/2006 Smyers
7,104,414 B2 9/2006 Apps et al.
7,128,231 B2 10/2006 Overholt
7,188,847 B1 3/2007 Friedman
7,195,127 B2 3/2007 Hsu et al.
7,195,128 B2 3/2007 Murakami et al.
7,264,122 B2 9/2007 Koefelda et al.
7,267,227 B2 9/2007 Dubois et al.
7,281,637 B2 10/2007 Hadar
7,353,962 B2 4/2008 Parnall et al.
7,357,269 B2 4/2008 Apps
7,438,197 B2 10/2008 Yamauchi
7,464,817 B2 12/2008 Raghunathan et al.
7,484,634 B2 2/2009 Apps
7,533,486 B2 5/2009 Ribeiro De Matos
7,549,550 B2 6/2009 Smyers et al.
7,556,166 B2 7/2009 Parnall et al.
7,617,947 B2 11/2009 Schafer
7,641,066 B2 1/2010 Baltz
7,694,836 B2 4/2010 Overholt et al.
7,717,283 B2 5/2010 Apps et al.
7,726,502 B2 6/2010 Apps
7,740,146 B2 6/2010 Cavalcante et al.
7,823,728 B2 11/2010 Baltz
D628,801 S 12/2010 Talbot Pouliot et al.
7,861,863 B2 * 1/2011 Meissen ..... B65D 21/062 206/506
7,896,184 B2 3/2011 Meers
8,056,723 B2 11/2011 Cavalcante
8,066,147 B2 11/2011 Meers et al.
8,091,706 B2 1/2012 Koefelda
8,561,836 B2 10/2013 Cook
8,770,568 B2 7/2014 Buck et al.
9,278,775 B2 3/2016 Meers et al.
10,167,110 B2 1/2019 Koefelda et al.
2002/0070215 A1 6/2002 Walsh et al.
2002/0092850 A1 7/2002 Iwahara et al.
2002/0108950 A1 8/2002 Moorman et al.
2002/0117420 A1 8/2002 McDade
2002/0158067 A1 10/2002 Overholt et al.

(56) References Cited

U.S. PATENT DOCUMENTS

| | | | |
|---|---|---|---|
| 2003/0000950 | A1 | 1/2003 | Murakami et al. |
| 2003/0116564 | A1 | 6/2003 | Overholt et al. |
| 2003/0132228 | A1 | 7/2003 | Apps et al. |
| 2003/0136781 | A1 | 7/2003 | Rumpel |
| 2003/0155275 | A1 | 8/2003 | Apps et al. |
| 2003/0222081 | A1 | 12/2003 | Apps et al. |
| 2003/0230510 | A1 | 12/2003 | Aiken et al. |
| 2004/0020821 | A1 | 2/2004 | Koefelda et al. |
| 2004/0069780 | A1 | 4/2004 | Apps et al. |
| 2004/0099662 | A1 | 5/2004 | Overholt |
| 2004/0104231 | A1 | 6/2004 | Hassell et al. |
| 2004/0129700 | A1 | 7/2004 | Oster et al. |
| 2004/0159659 | A1 | 8/2004 | Rumpel |
| 2004/0178197 | A1 | 9/2004 | Hsu et al. |
| 2004/0182858 | A1 | 9/2004 | Smyers |
| 2004/0200833 | A1 | 10/2004 | Dubois et al. |
| 2004/0226945 | A1 | 11/2004 | Hsu et al. |
| 2005/0040166 | A1 | 2/2005 | Nolet et al. |
| 2005/0098556 | A1 | 5/2005 | Kellerer |
| 2005/0121447 | A1 | 6/2005 | Barth |
| 2005/0155967 | A1 | 7/2005 | Vial |
| 2005/0194382 | A1 | 9/2005 | B. |
| 2005/0263423 | A1 | 12/2005 | Hassell et al. |
| 2005/0263424 | A1 | 12/2005 | Hassell et al. |
| 2006/0011627 | A1 | 1/2006 | Overholt et al. |
| 2006/0181101 | A1 | 8/2006 | Reynolds et al. |
| 2006/0231449 | A1 | 10/2006 | Hassell et al. |
| 2006/0231555 | A1 | 10/2006 | Smyers et al. |
| 2006/0237341 | A1 | 10/2006 | McDade |
| 2006/0260976 | A1 | 11/2006 | Apps |
| 2007/0039917 | A1* | 2/2007 | Yourist ..... B65D 79/0084 215/382 |
| 2007/0095842 | A1 | 5/2007 | Apps |
| 2007/0125779 | A1 | 6/2007 | Cope |
| 2007/0144931 | A1 | 6/2007 | McTavish et al. |
| 2007/0158345 | A1 | 7/2007 | Booth et al. |
| 2007/0187276 | A1 | 8/2007 | Stahl |
| 2007/0194023 | A1 | 8/2007 | Apps et al. |
| 2007/0272579 | A1 | 11/2007 | Cavalcante |
| 2008/0142399 | A1 | 6/2008 | Apps |
| 2008/0142530 | A1 | 6/2008 | Meers et al. |
| 2008/0164175 | A1 | 7/2008 | Meissen |
| 2008/0169285 | A1 | 7/2008 | Marazita et al. |
| 2008/0179322 | A1 | 7/2008 | Parnall et al. |
| 2008/0296308 | A1 | 12/2008 | Barbalho et al. |
| 2008/0302791 | A1 | 12/2008 | Baltz |
| 2009/0057320 | A1 | 3/2009 | Meers et al. |
| 2009/0078701 | A1 | 3/2009 | Cavalcante |
| 2009/0134157 | A1 | 5/2009 | Meers |
| 2009/0151226 | A1 | 6/2009 | Apps et al. |
| 2009/0159593 | A1 | 6/2009 | Apps |
| 2009/0223953 | A1 | 9/2009 | Cavalcante |
| 2010/0012654 | A1 | 1/2010 | Apps |
| 2010/0044371 | A1 | 2/2010 | Koefelda |
| 2010/0051497 | A1 | 3/2010 | Meers |
| 2010/0065558 | A1 | 3/2010 | Cavalcante et al. |
| 2010/0126896 | A1 | 5/2010 | Barbalho |
| 2011/0006057 | A1 | 1/2011 | Cavalcante |
| 2011/0290811 | A1 | 12/2011 | Koefelda et al. |
| 2012/0037647 | A1 | 2/2012 | Cook |
| 2012/0111859 | A1 | 5/2012 | Pils et al. |
| 2012/0285951 | A1 | 11/2012 | Cavalcante |
| 2013/0056381 | A1 | 3/2013 | Cook et al. |
| 2013/0180982 | A1 | 7/2013 | Choi |
| 2013/0193153 | A1 | 8/2013 | Baltz et al. |
| 2014/0299418 | A1 | 10/2014 | Meijer |
| 2014/0305741 | A1 | 10/2014 | Jowett et al. |
| 2015/0197365 | A1 | 7/2015 | Josefson |
| 2016/0185487 | A1 | 6/2016 | Meers et al. |
| 2018/0037448 | A1 | 2/2018 | Lacher |
| 2019/0135601 | A1 | 5/2019 | Guerry et al. |

FOREIGN PATENT DOCUMENTS

| | | | |
|---|---|---|---|
| DE | 3521894 | A1 | 1/1987 |
| DE | 20002537 | U1 | 6/2001 |
| EP | 73357 | A2 | 3/1983 |
| EP | 0127414 | A2 | 12/1984 |
| EP | 211116 | A2 | 2/1987 |
| EP | 0178211 | A1 | 12/1990 |
| EP | 485672 | A1 | 5/1992 |
| EP | 0485672 | A1 | 5/1992 |
| EP | 690003 | A1 | 1/1996 |
| EP | 962394 | A1 | 12/1999 |
| EP | 0962396 | A1 | 12/1999 |
| EP | 1114779 | A2 | 7/2001 |
| EP | 1160169 | A2 | 12/2001 |
| EP | 1225131 | A1 | 7/2002 |
| EP | 1241105 | A1 | 9/2002 |
| EP | 1785360 | A1 | 5/2007 |
| EP | 2072413 | A2 | 6/2009 |
| GB | 2068338 | A | 8/1981 |
| GB | 2129401 | A | 5/1984 |
| GB | 2139189 | A | 11/1984 |
| GB | 2141778 | A | 1/1985 |
| GB | 2171980 | A | 9/1986 |
| GB | 2337985 | A | 12/1999 |
| GB | 2351784 | A | 1/2001 |
| GB | 2353276 | A | 2/2001 |
| GB | 2357078 | A | 6/2001 |
| GB | 2359066 | A | 8/2001 |
| GB | 2360726 | A | 10/2001 |
| GB | 2368074 | A | 4/2002 |
| GB | 2370034 | A | 6/2002 |
| GB | 2373238 | A | 9/2002 |
| GB | 2373239 | A | 9/2002 |
| GB | 2438506 | A | 11/2007 |
| GB | 2443949 | A | 5/2008 |
| GB | 2449502 | A | 11/2008 |
| GB | 2463374 | A | 3/2010 |
| JP | 1086930 | H | 4/1998 |
| JP | 118529 | H | 1/1999 |
| JP | 11222233 | H | 8/1999 |
| JP | 2001180670 | A | 7/2001 |
| JP | 2003020037 | A | 1/2003 |
| NL | 7905105 | A | 12/1980 |
| NL | 9002518 | A | 6/1992 |
| NL | 9301566 | A | 4/1995 |
| SU | 1533952 | A1 | 1/1990 |
| WO | 8601182 | A1 | 2/1986 |
| WO | 9324378 | A1 | 12/1993 |
| WO | 9521773 | A1 | 8/1995 |
| WO | 9715502 | A1 | 5/1997 |
| WO | 9726190 | A2 | 7/1997 |
| WO | 9749613 | A1 | 12/1997 |
| WO | 9840199 | A1 | 9/1998 |
| WO | 0027716 | A1 | 5/2000 |
| WO | 0066440 | A1 | 11/2000 |
| WO | 0234630 | A1 | 5/2002 |
| WO | 03008275 | A2 | 1/2003 |
| WO | 03078259 | A1 | 9/2003 |
| WO | 03101846 | A1 | 12/2003 |
| WO | 03104094 | A1 | 12/2003 |
| WO | 2006010311 | A1 | 2/2006 |
| WO | 2008062494 | A1 | 5/2008 |
| WO | 2008145977 | A1 | 12/2008 |
| WO | 2011006654 | A1 | 1/2011 |

* cited by examiner

RECONFIGURABLE BEVERAGE CRATE

CROSS-REFERENCED TO RELATED APPLICATION

This application claims priority to U.S. Provisional Application No. 62/741,392, which was filed on Oct. 4, 2018.

BACKGROUND

Beverage crates are typically designed for a particular beverage container (e.g. bottle or can) size and configuration. The interior volume defined by the base and walls of the crate is constant, whether the beverage crate is a nestable crate, collapsible crate, or a stackable full-depth crate. Sometimes, a beverage crate can accommodate a small number of beverage container variations, e.g. a taller bottle and a shorter bottle both having the same body diameter.

SUMMARY

A beverage crate includes a base and a plurality of walls extending upward from the base. The base together with the plurality of walls define a container interior for receiving beverage containers. By reconfiguring the crate, the storage volume of the container interior is selectively adjustable to accommodate different size beverage containers.

Thus, the same crate could be used for different size beverage containers. The crate could be used to ship a first size bottle to a store, then returned to the warehouse or distribution center, reconfigured and loaded with a second size bottle.

In some embodiments disclosed herein, the beverage crate includes at least one spacer movable between a stowed position in which the storage volume of the container interior is larger and a deployed position in which the storage volume of the container interior is smaller.

Some of the embodiments disclosed herein are collapsible crates and some are disclosed as nestable crates; however, it should be noted that the movable spacers disclosed in any of these embodiments could be implemented in either collapsible crates, nestable crates, or stackable full-depth crates.

DETAILED DESCRIPTION

Figure 1:
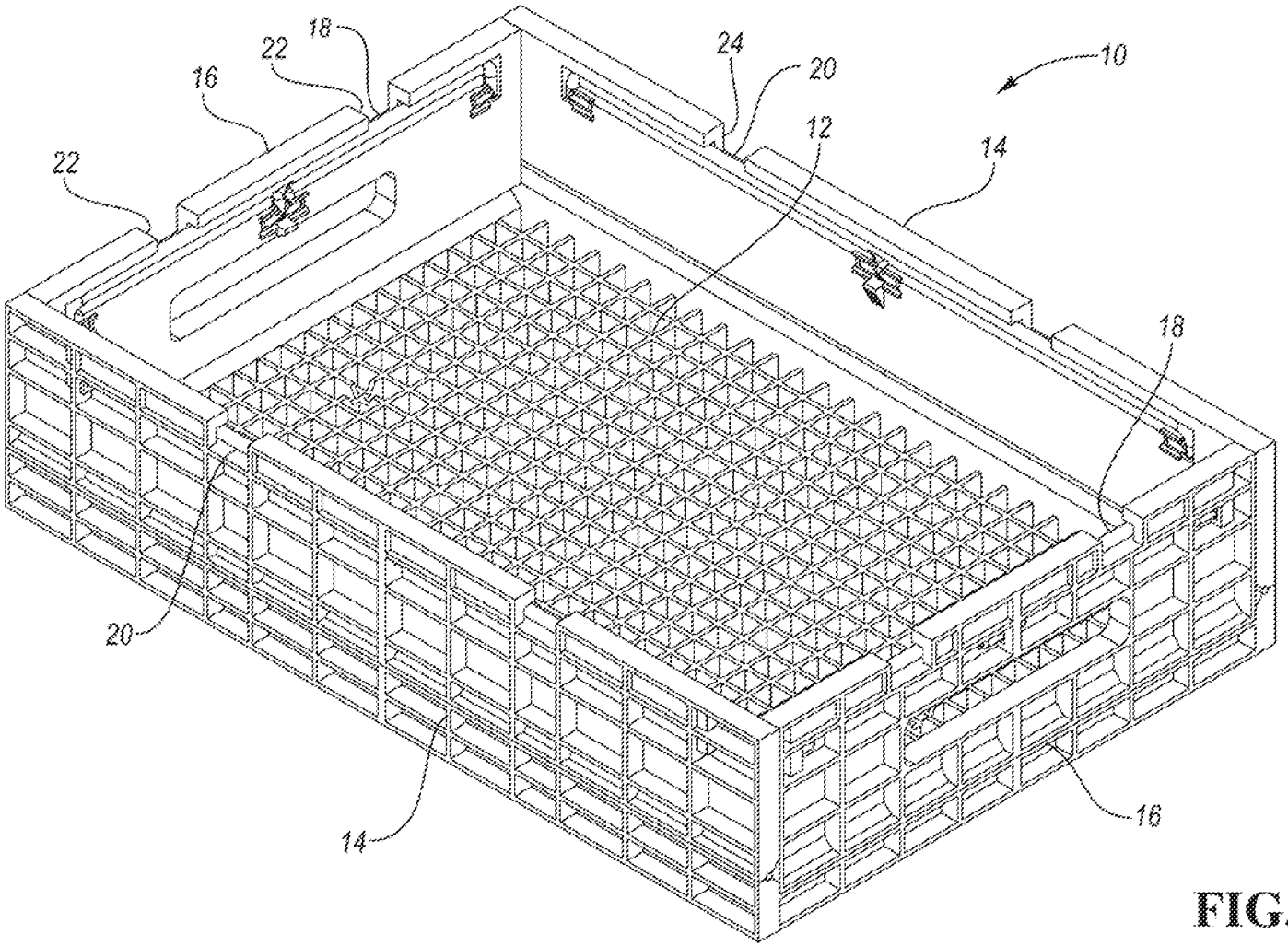
FIG. 1 is a perspective view of the beverage crate according to a first embodiment.

FIGS. 1-25 show a bottle crate 10 according to a first embodiment. In this embodiment, the crate 10 is a collapsible crate 10. The crate 10 includes a base 12, sidewalls 14 extending upward from side edges of the base 12, and end walls 16 extending upward from end edges of the base 12. The sidewalls 14 and end walls 16 are hingeably connected to the base 12, as is known, and are selectively latched to one another, as is also well-known.

A spacer 18 is pivotably connected to each end wall 16. The spacer 18 is generally U-shaped, having short arms pivotably connected to the end walls 16 and extending upward to connect to an elongated cross bar extending across most of the end wall 16. In the example shown, the spacer 18 is pivotably connected adjacent the upper end of each end wall 16. The cross bar of the spacer 18 can be accessed via a pair of notches 22 formed in the upper edge of each end wall 16.

A side spacer 20 is pivotably mounted to each side wall 14 in a similar manner The side spacers are accessible via notches 24 formed in upper edges of the side walls 14. The spacers 18, 20 are shown in FIG. 1 in the stowed or retracted position where they are received within recesses formed in the end wall 16 and side walls 14, respectively, and do not project into the interior of the crate 10.

Figure 2:
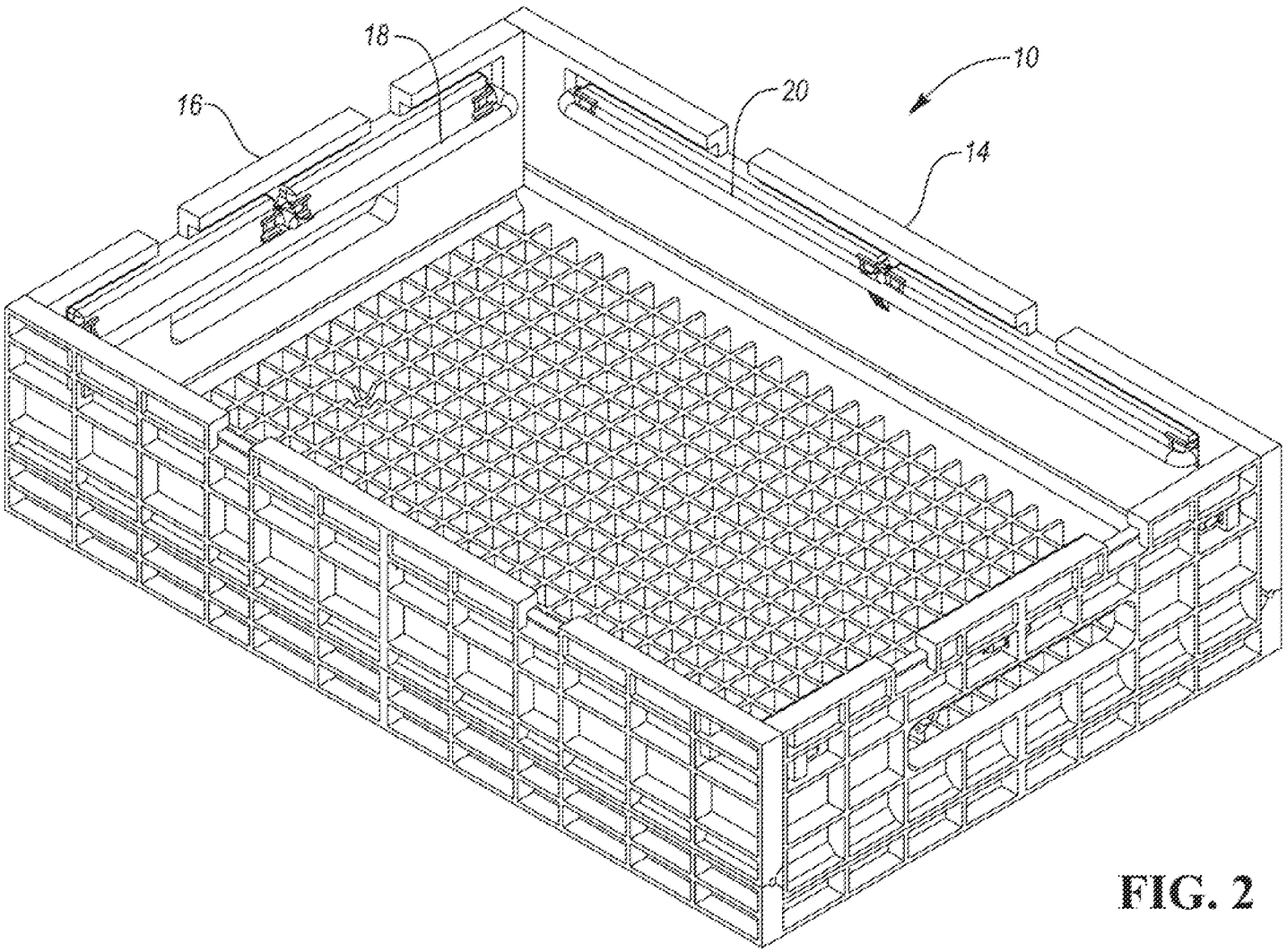
FIG. 2 is a perspective view of the beverage crate of FIG. 1 with the spacers pivoted downward in the deployed position.

Referring to FIG. 2, the spacers 18, 20 can be pivoted downward to their deployed position, as shown. In this position, the spacers 18, 20 project inward from the end walls 16 and side walls 14, respectively into the interior of the crate 10. The spacers 18 project toward one another. The spacers 20 project toward one another. The spacers 18, 20 project inward over the base 12. As compared to the stowed position of FIG. 1, in the deployed position, the spacers 18, 20 reduce the available storage volume of the interior of the crate 10 available to receive beverage containers.

Figure 3:
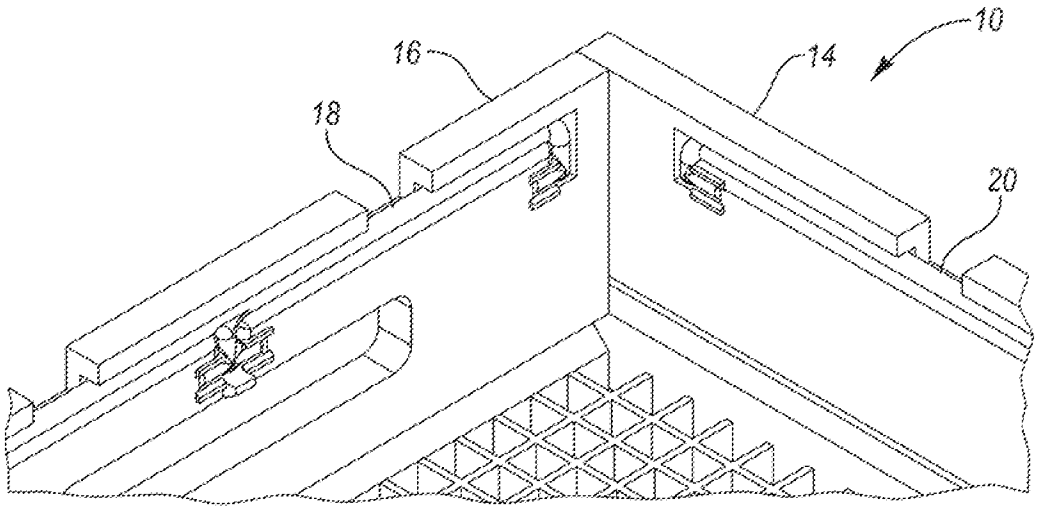
FIG. 3 is an enlarged view of an interior corner of the crate of FIG. 1.
Figure 4:
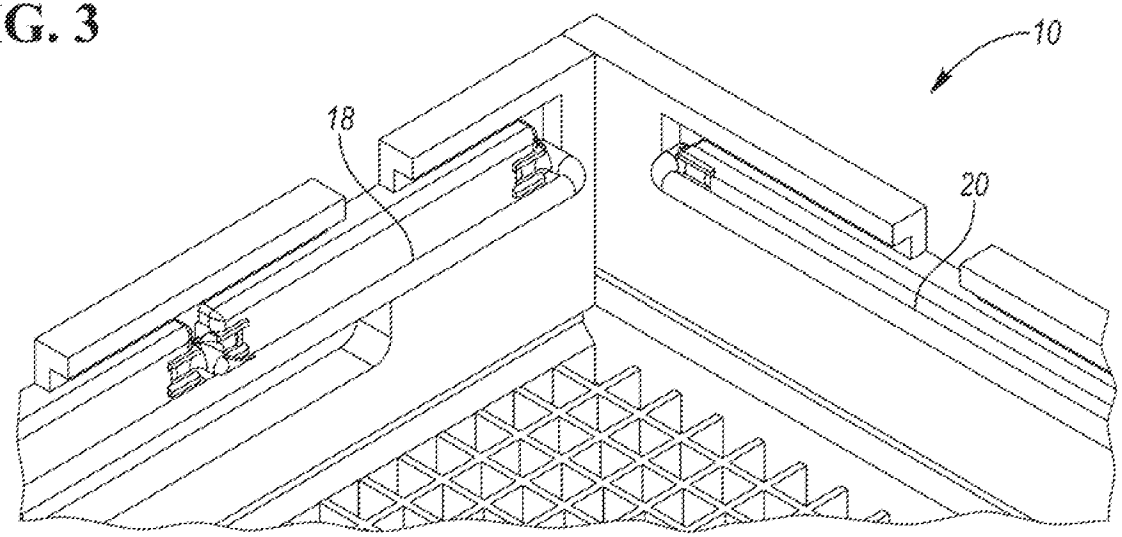
FIG. 4 is an enlarged view of the interior corner, showing the spacers of the crate of FIG. 1 in the deployed position.

FIG. 3 is an enlarged view of an interior corner of the crate 10 of FIG. 1, showing the spacers 18 and 20 in the stowed position. FIG. 4 is an enlarged view of the interior corner, showing the spacers 18, 20 in the deployed position.

Figure 5:
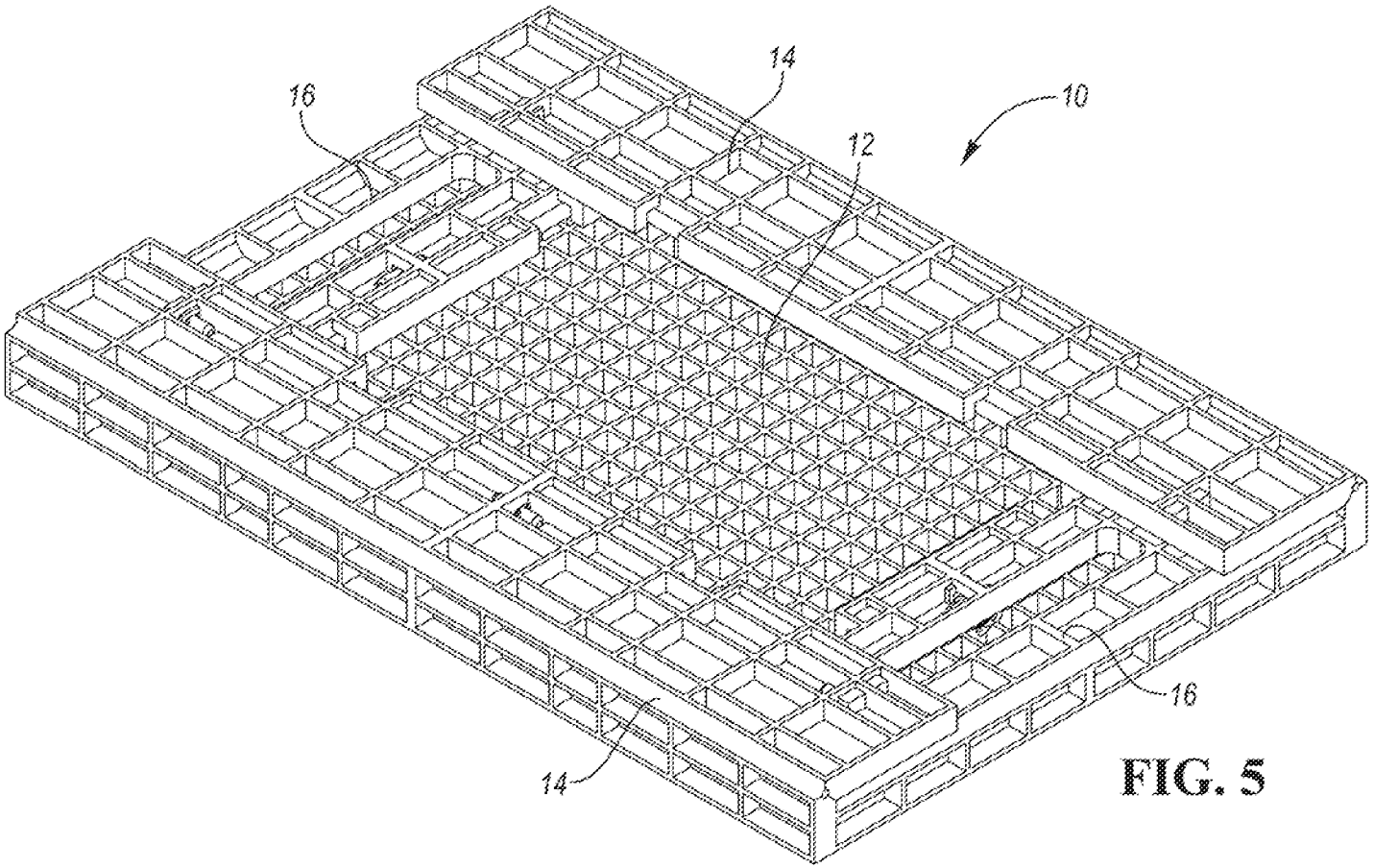
FIG. 5 shows the crate of FIG. 1 in a collapsed position.

FIG. 5 shows the crate 10 in a collapsed position. In the collapsed position, the end walls 16 are pivoted down onto the base 12. The sidewalls 14 are pivoted down onto the end walls 16 and out to the base 12. As is known, in the collapsed position, the empty crate 10 can be shipped and stored more efficiently.

Figure 6:
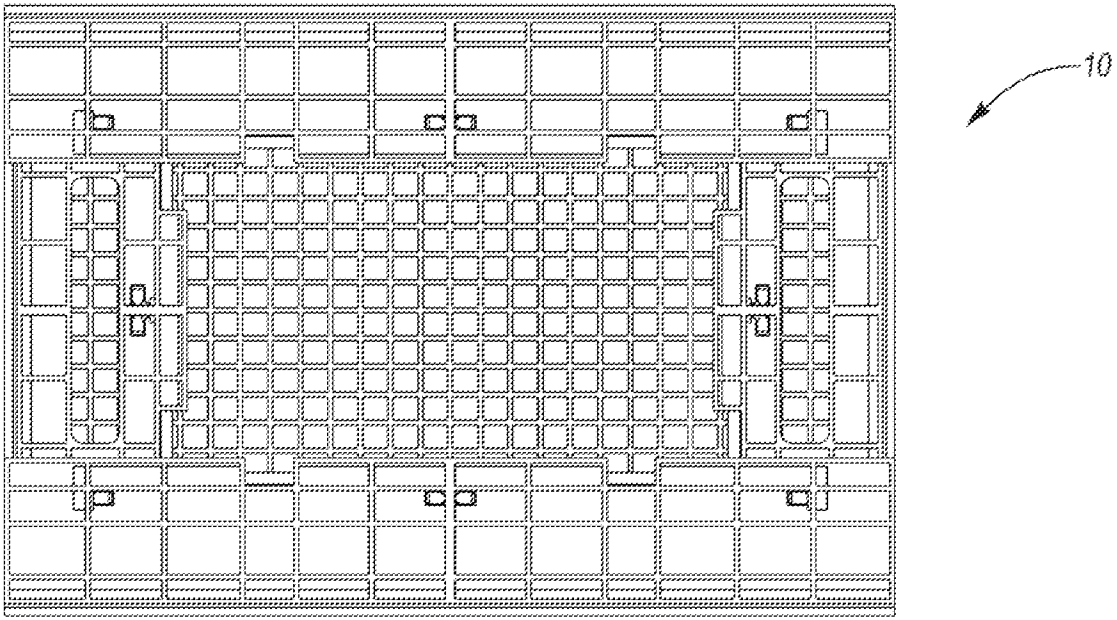
FIG. 6 is a top view of the collapsed crate of FIG. 5.
Figure 7:
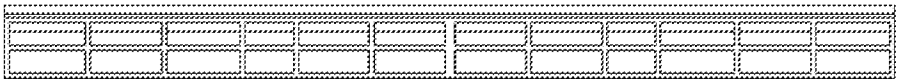
FIG. 7 is a side view of the collapsed crate of FIG. 1.
Figure 8:
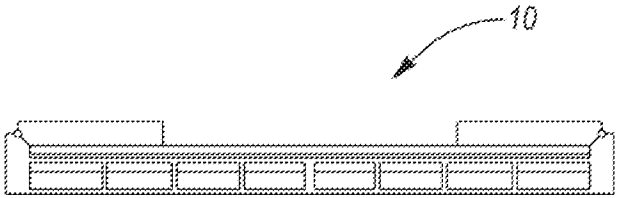
FIG. 8 is an end view of the collapsed crate of FIG. 1.
Figure 9:
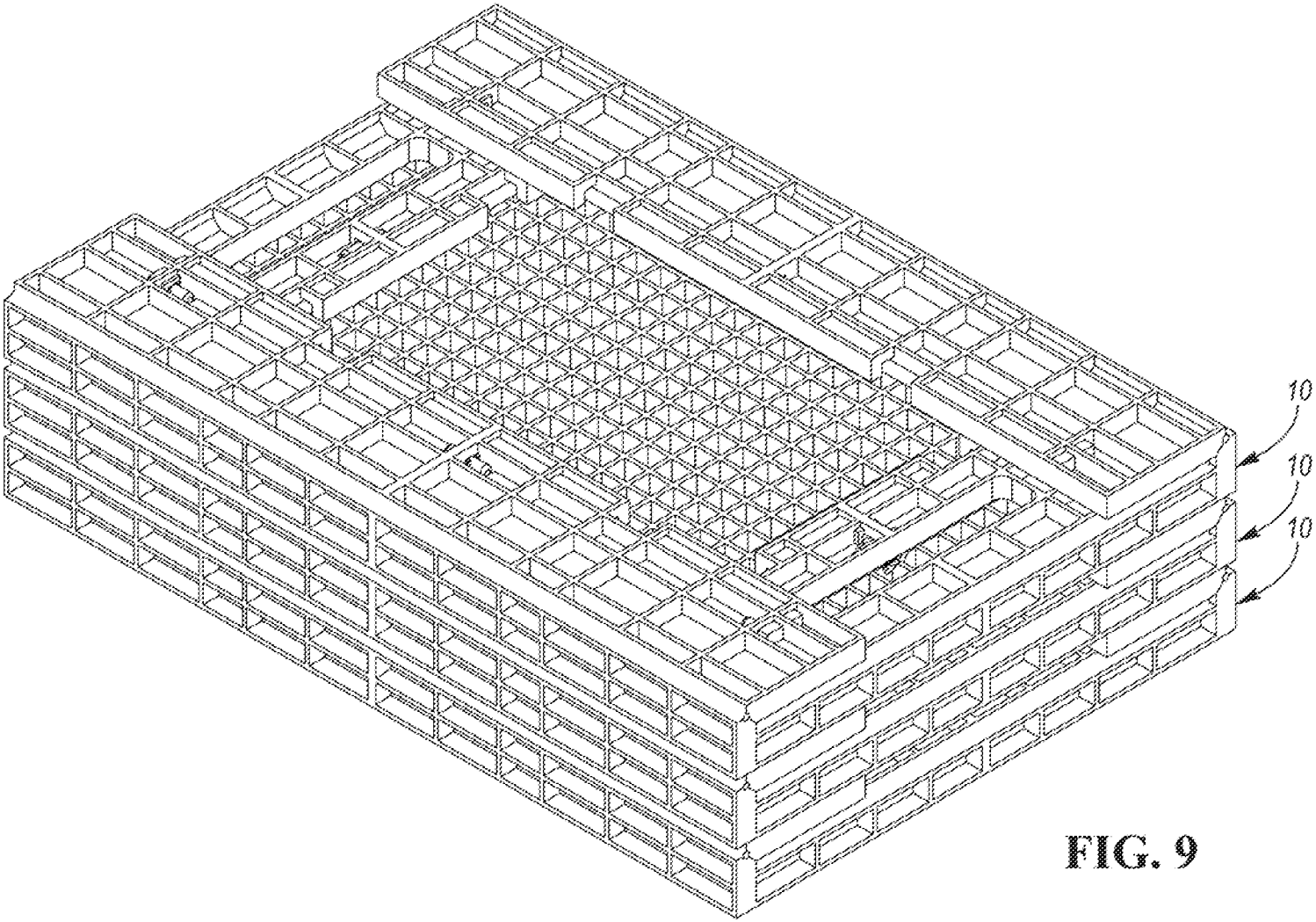
FIG. 9 is a perspective view showing a plurality of the collapsed crates of FIG. 1 stacked on one another.
Figure 11:
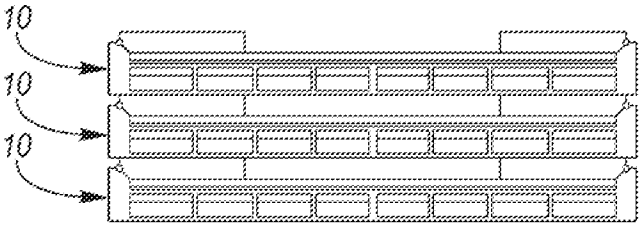
FIG. 11 is an end view of the stack of collapsed crates of FIG. 9.
Figure 10:
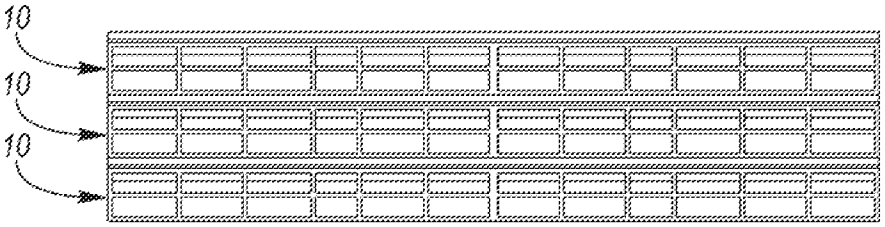
FIG. 10 is a side view of the stack of crates of FIG. 9.

FIG. 6 is a top view of the collapsed crate 10 of FIG. 5. FIG. 7 is a side view of the collapsed crate 10. FIG. 8 is an end view of the collapsed crate 10. FIG. 9 is a perspective view showing a plurality of the collapsed crates 10 stacked on one another. FIG. 10 is a side view of the stack of crates 10 of FIG. 9. FIG. 11 is an end view of the stack of collapsed crates 10 of FIG. 9.

Figure 12:
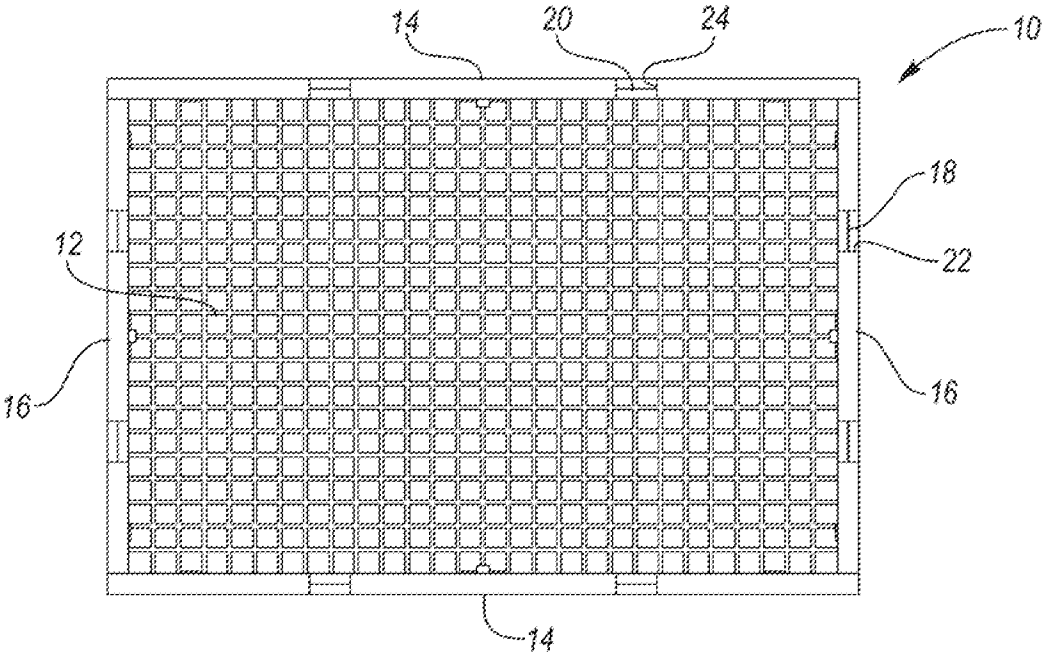
FIG. 12 is a top view of the crate of FIG. 1 with the spacers in the stowed position.
Figure 14:
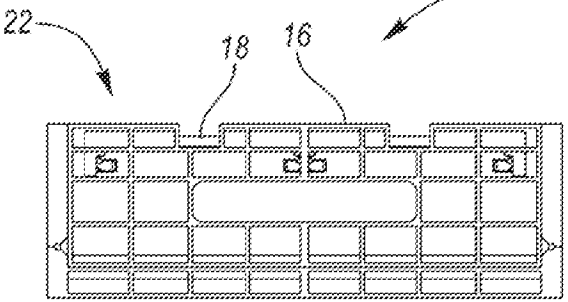
FIG. 14 is an end view respective of the crate of FIG. 12.
Figure 13:
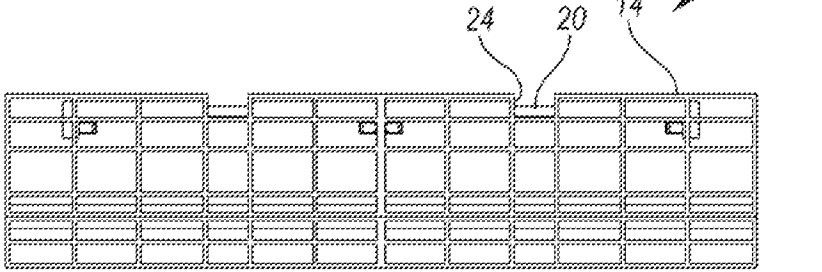
FIG. 13 is a side view respective of the crate of FIG. 12.

FIG. 12 is a top view of the crate 10 with the spacers 18, 20 in the stowed position. FIGS. 13 and 14 are side and end views, respectively of the crate 10 of FIG. 12.

Figure 15:
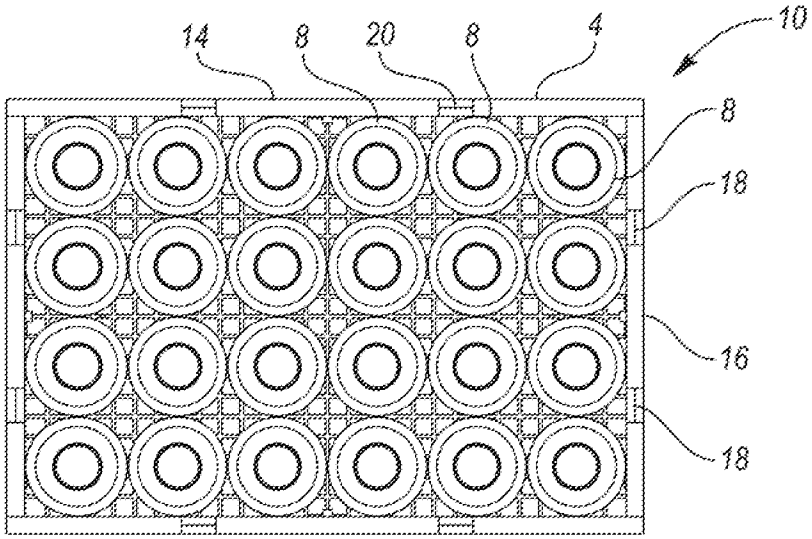
FIG. 15 is a top view of the crate of FIG. 1 loaded with bottles while the spacers are in the stowed position.
Figure 16:
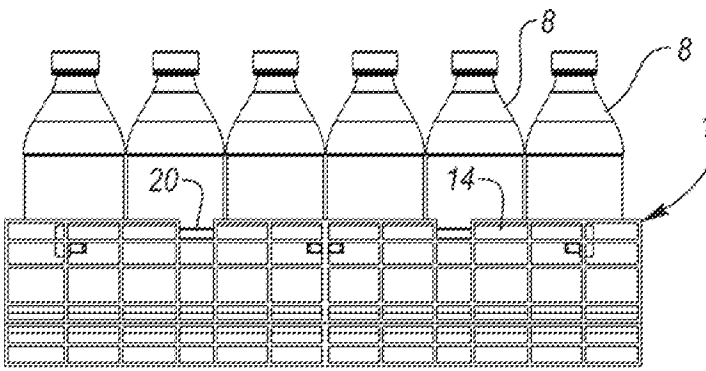
FIG. 16 is a side view of the crate and bottles of FIG. 15.
Figure 17:
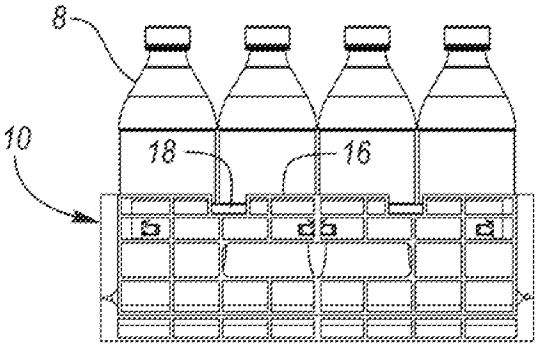
FIG. 17 is an end view of the crate and bottles of FIG. 15.

FIG. 15 is a top view of the crate 10 loaded with bottles 8 while the spacers 18 are in the stowed position. The diameter of the bodies of the bottles 8 is such that the bottles 8 fit reasonably snugly between the sidewalls 14 and between the end walls 16. FIGS. 16 and 17 are side views and end views of the crate 10 and bottles 8 of FIG. 15, respectively.

Figure 18:
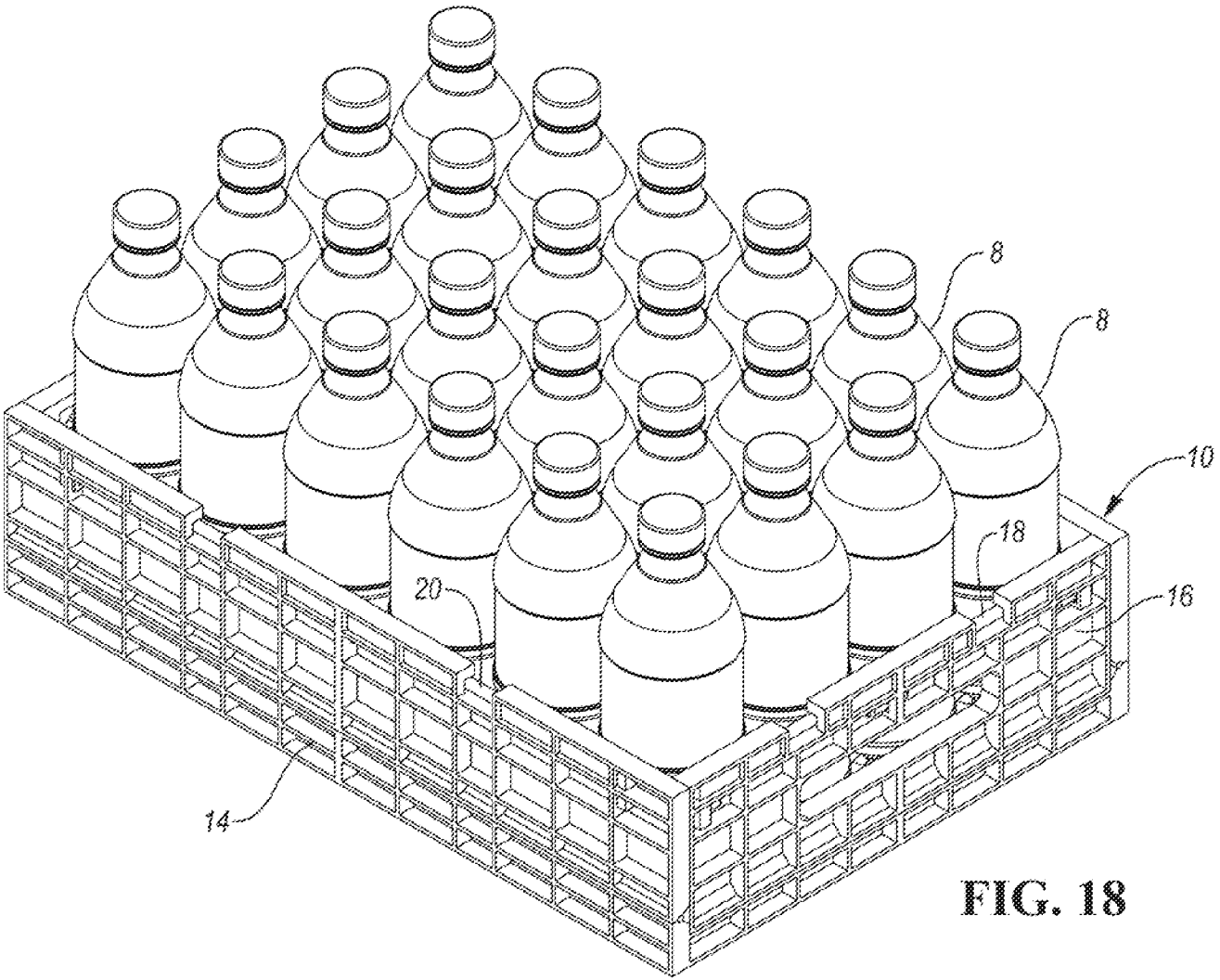
FIG. 18 is a perspective view of the crate and bottles of FIG. 15.

FIG. 18 is a perspective view of the crate 10 and bottles 8 of FIG. 15. Again, the spacers 18, 20 are in the stowed position. The bottles 8 are received in the interior of the crate 10 in a 4×6 array.

Figure 19:
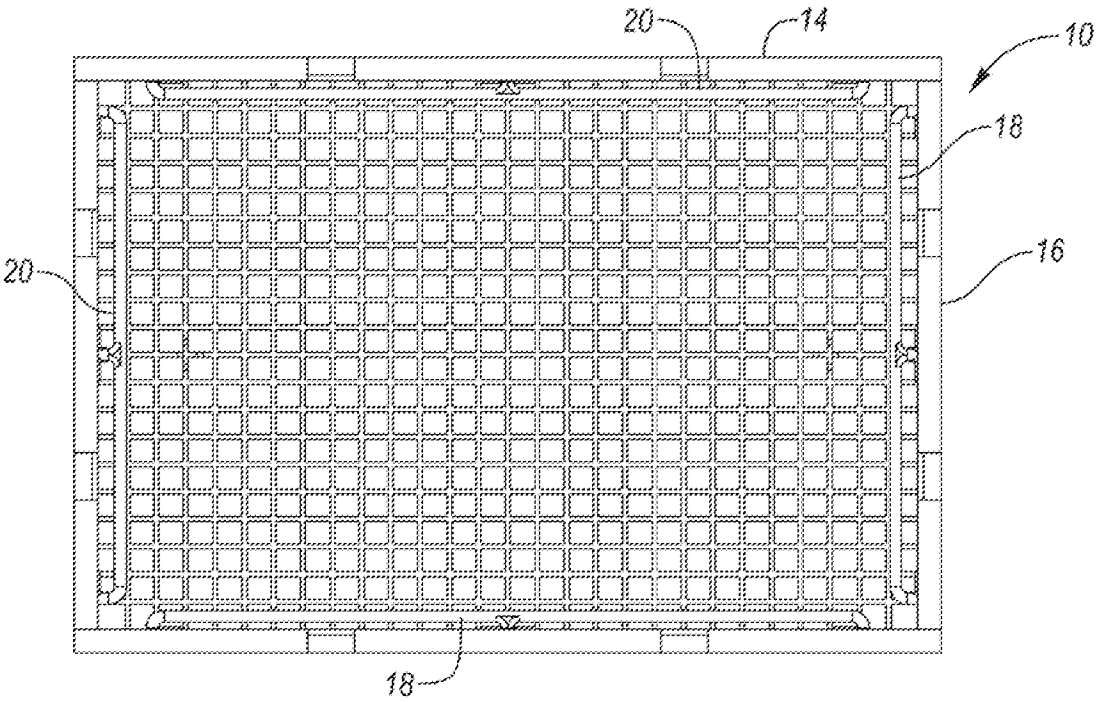
FIG. 19 is a top view of the crate of FIG. 1 with the spacers in the deployed position.
Figure 20:
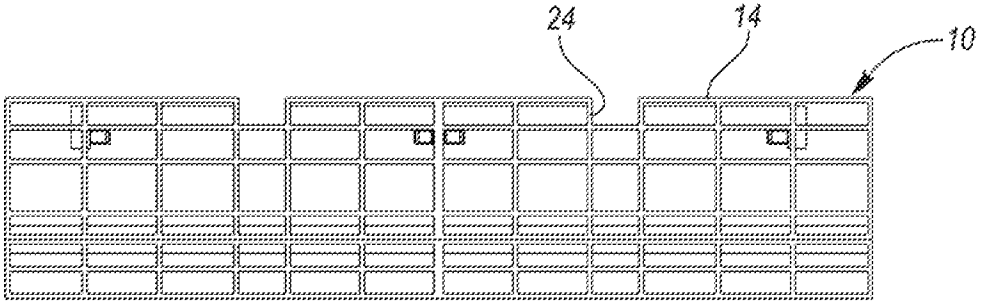
FIG. 20 is a side view of the crate of FIG. 19.
Figure 21:
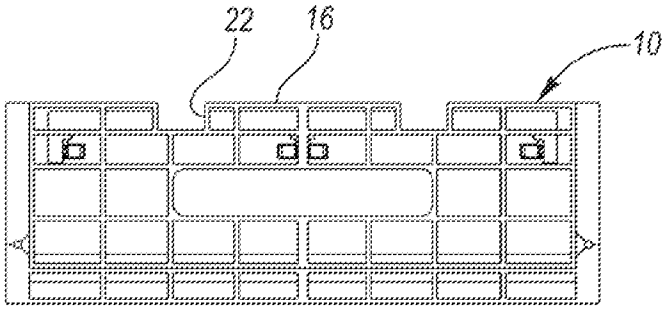
FIG. 21 is an end view of the crate of FIG. 19.

FIG. 19 is a top view of the crate 10 with the spacers 18, 20 in the deployed position. As shown, the spacers 18, 20 project into the interior of the crate 10 and reduce the interior dimensions of the crate 10. FIGS. 20 and 21 are side and end views, respectively of the crate 10 of FIG. 19.

Figure 22:
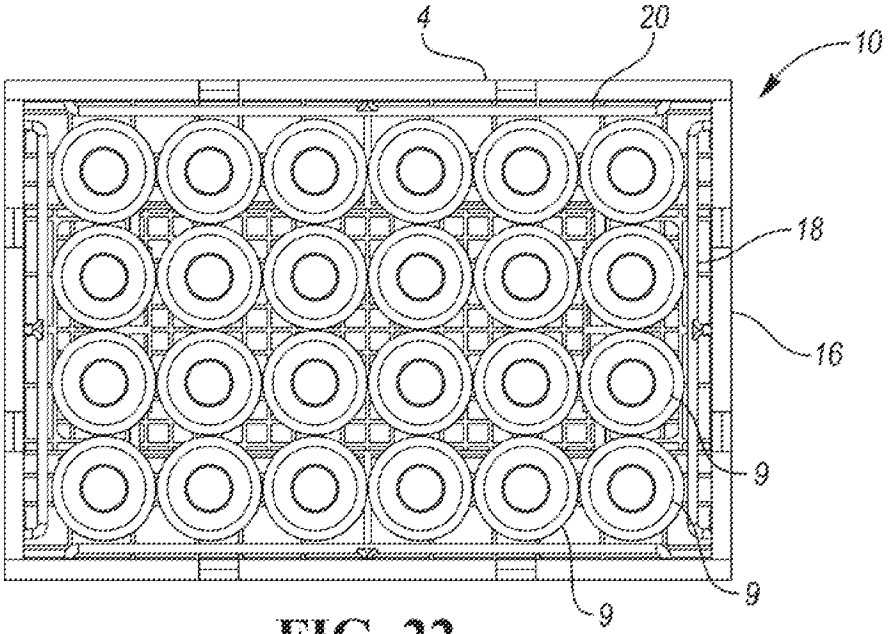
FIG. 22 is a top view of the crate of FIG. 1 with the spacers in the deployed position and loaded with smaller bottles.

FIG. 22 is a top view of the crate 10 with the spacers 18, 20 in the deployed position and loaded with smaller bottles 9 (i.e. the bodies of the bottles 9 have a smaller diameter). As shown, the bottles 9 fit reasonably snugly between the spacers 18 and between the spacers 20. The smaller bottles 9 are received in the crate 10 interior in a 4×6 array.

The spacers 18, 20 permit the crate 10 to accommodate bottles 8, 9 of different sizes (i.e. body diameters). Alternatively, the deployed spacers 18, 20 could reconfigure the crate 10 to accommodate a lesser number of larger bottles than the retracted spacers 18, 20 (e.g. larger diameter bottles in a 3×5 array).

Figure 23:
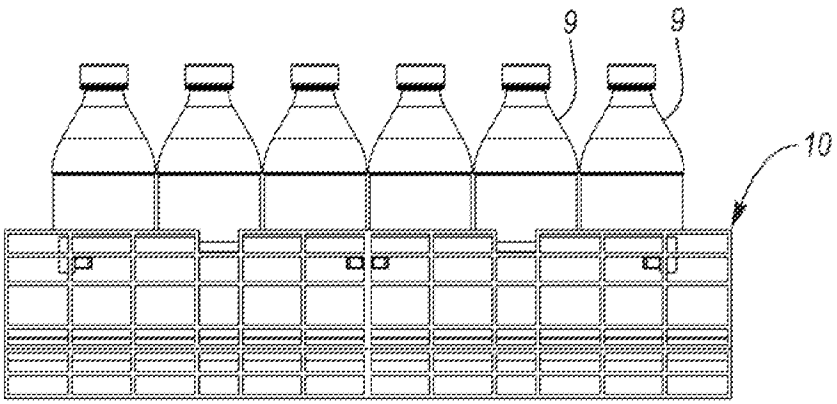
FIG. 23 is a side view of the crate and bottles of FIG. 22.
Figure 24:
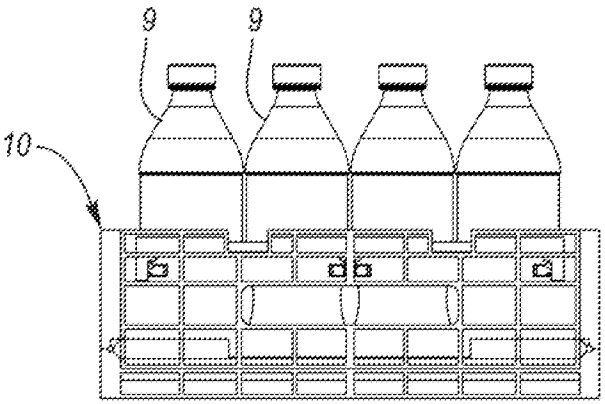
FIG. 24 is an end view of the crate and bottles of FIG. 22.
Figure 25:
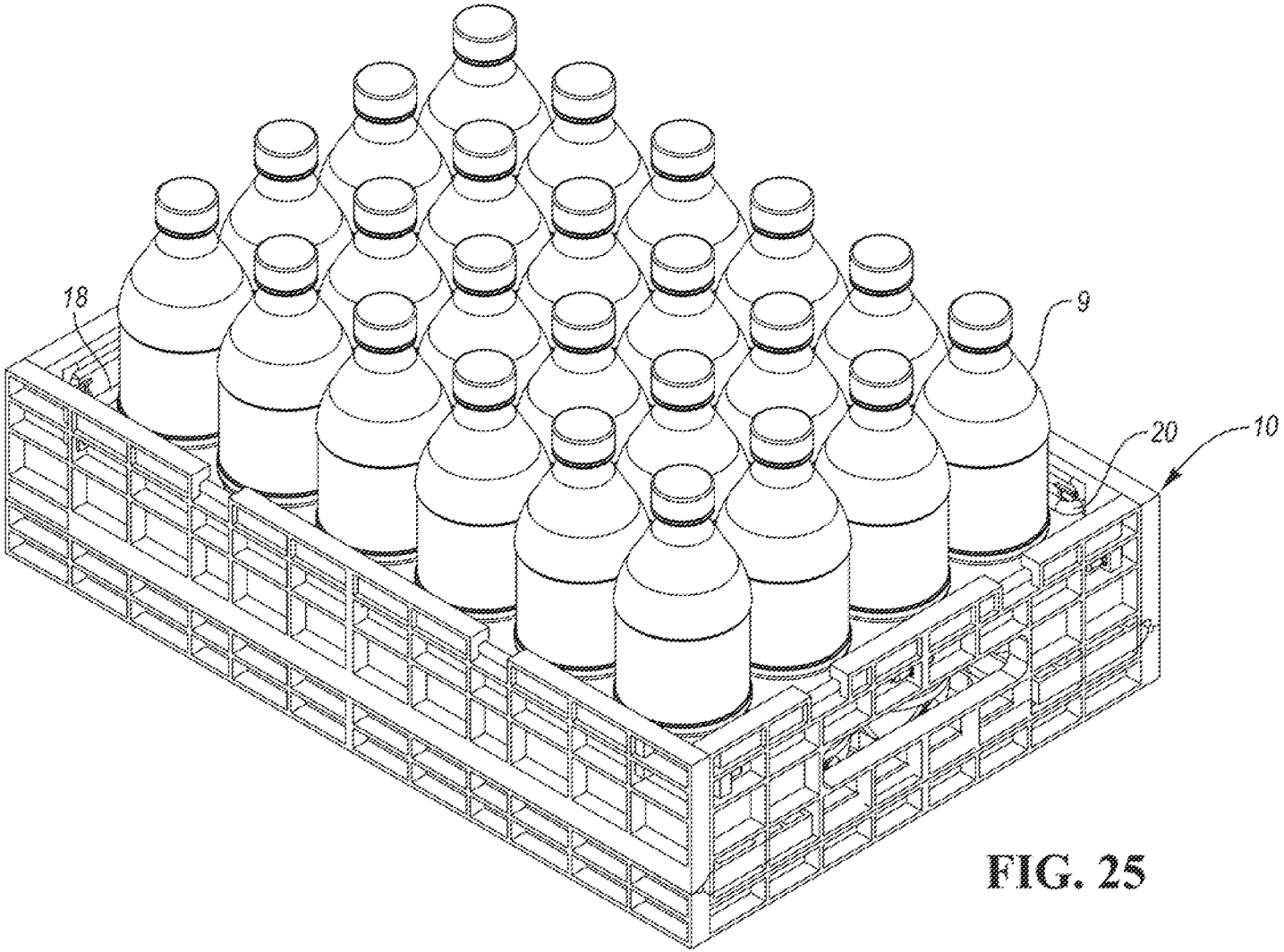
FIG. 25 is a perspective view of the crate and bottles of FIG. 22.

FIGS. 23 and 24 are side and end views of the crate 10 and bottles 9 of FIG. 22. FIG. 25 is a perspective view of the crate 10 and bottles 9 of FIG. 22.

Figure 26:
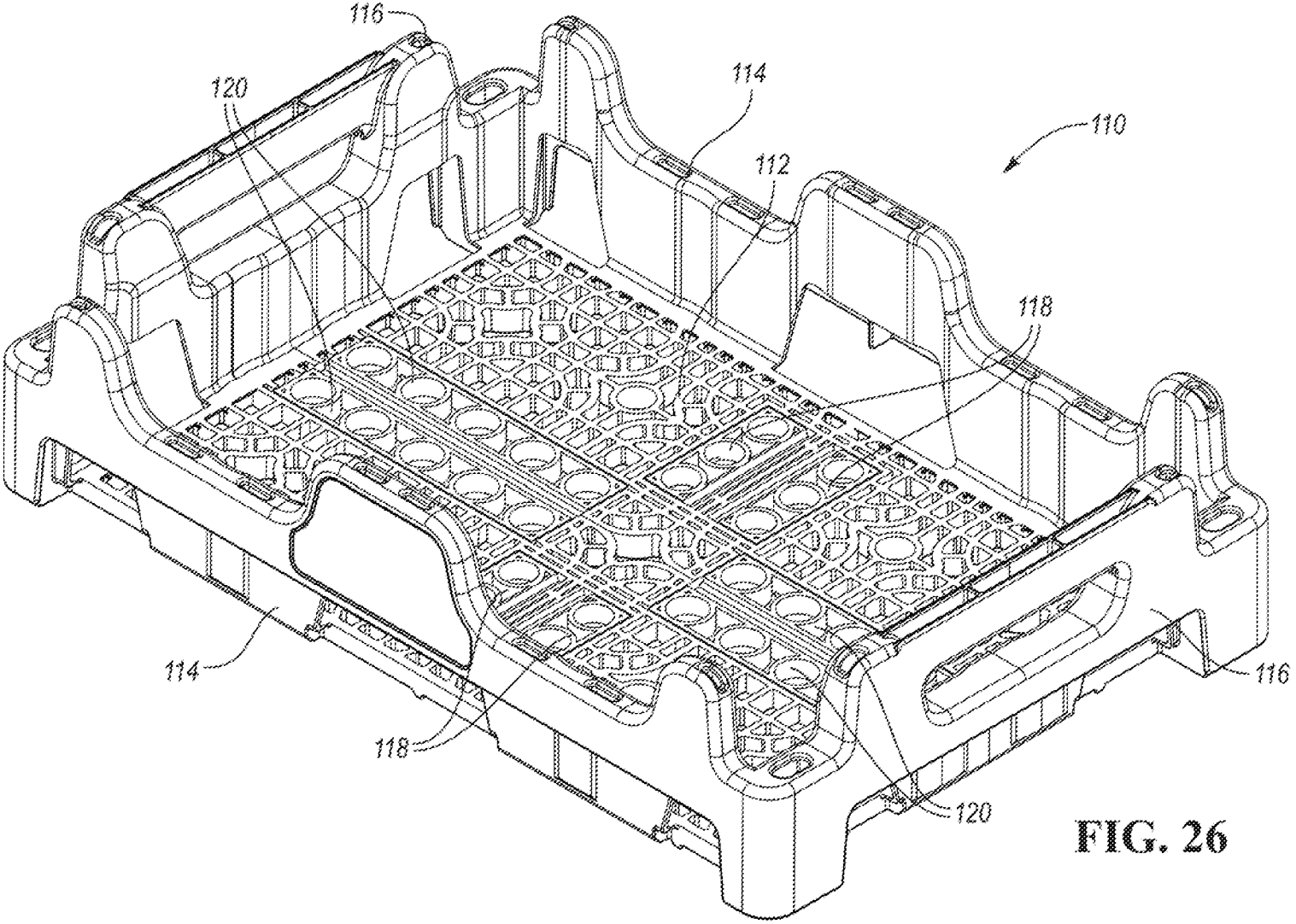
FIG. 26 is a perspective view of a beverage crate according to a second embodiment with the spacers in a stowed position.
Figure 27:
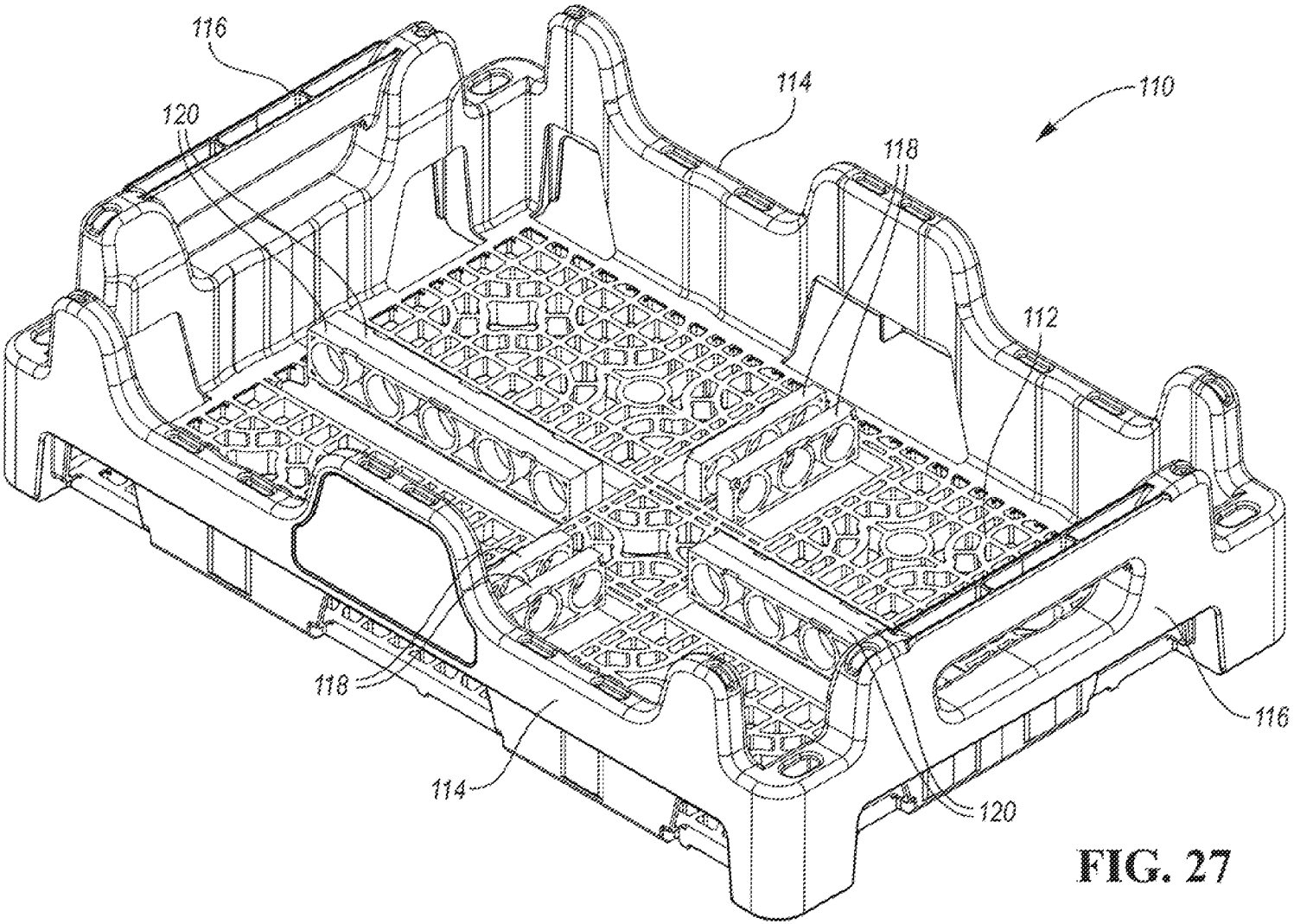
FIG. 27 shows the beverage crate of FIG. 26 with the spacers in a deployed position.

FIGS. 26-27 show a crate 110 according to a second embodiment. The crate 110 includes a base 112 having side walls 114 extending upward from side edges of the base 112 and end walls 116 extending upward from end edges of the base 112. In this embodiment, a plurality of laterally extending spacers 118 (two spaced-apart rows with two spacers 118 in each row) are stowed in recesses formed in the base 112 and extend generally from one side wall 114 to the other side wall 114. Similarly, longitudinally extending spacers 120 are stored in recessed in the base 112 and extend generally from one end wall 116 to the other end wall 116 (again, two rows of two spacers 120 in each row). The spacers 118, 120 are connected to the base 112 by hinges.

FIG. 27 shows the crate 110 with the spacers 118, 120 in the deployed position. In each case, each adjacent pair of spacers 118 are pivoted toward one another upward out of the recess in the base 112 until they are generally back to back. Similarly, the longitudinally extending spacers 120 are also pivoted upward in adjacent pairs to be back to back. In this manner, larger bottles could be stored in the crate 110 when the spacers 118, 120 are in the stowed position of FIG. 26 (or a larger number of smaller bottles). When the spacers 118, 120 are pivoted to the deployed position of FIG. 27, bottles are received between the spacers 120 and one of the side walls 114 and between the spacers 118 and one of the end walls 116. In the deployed position of FIG. 27, smaller bottles can be accommodated in the crate 110 (or a lesser number of larger bottles).

FIGS. 26 and 27 show a nestable crate, in which the base 112 side walls 114 and end walls 116 are integrally molded as a single piece of plastic, and when empty, portions of the side walls 114 and end walls 16 could be nested in an identical crate 110 stacked thereon. It should be noted that the spacers 118, 120 deployed from and stowed in the base 112 could also be implemented in a collapsible crate.

Figure 28:
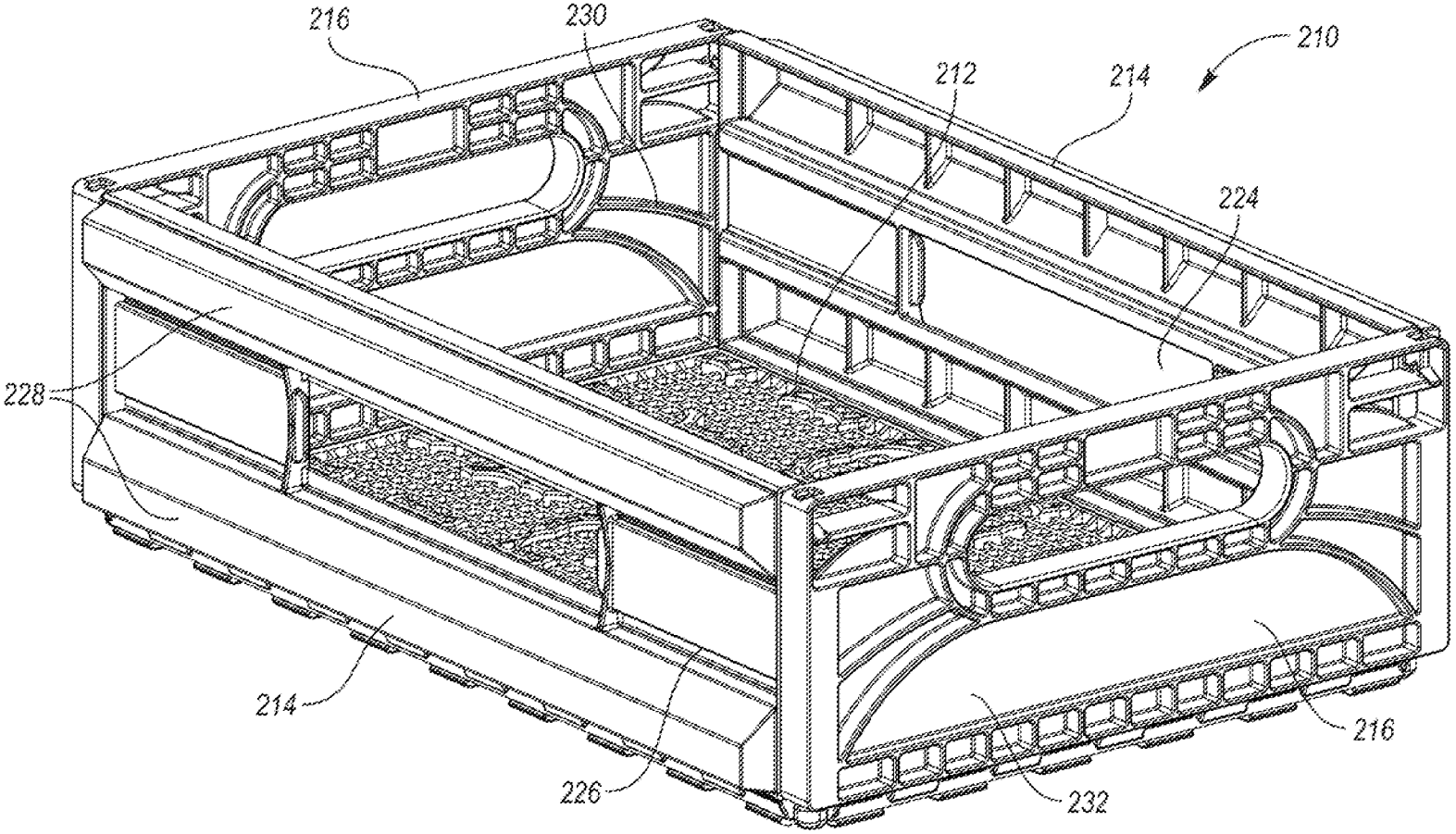
FIG. 28 is a perspective view of a beverage crate according to a third embodiment.

FIGS. 28-54 show a collapsible crate 210 according to a third embodiment. Referring to FIG. 28, the crate 210 includes a base 212 having side walls 214 pivotably connected to side edges of the base 212 by hinges and having end walls 216 pivotably connected to end edges of the base 212 by hinges. Each side wall 214 includes a first surface 224, which in the configuration of FIG. 28, is an interior surface 224. Each side wall 214 also includes a second surface 226, which in the configuration of FIG. 28 is an exterior surface 226. The second surface 226 of each side wall 214 includes a plurality (in this case two) spacer rails 228, upper and lower spacer rails 228. Each end wall 216 has a first surface 230, which in the configuration of FIG. 28 is an interior surface 230. Each end wall 216 further includes a second surface 232, which in the configuration of FIG. 28 is an exterior surface 232.

Figure 29:
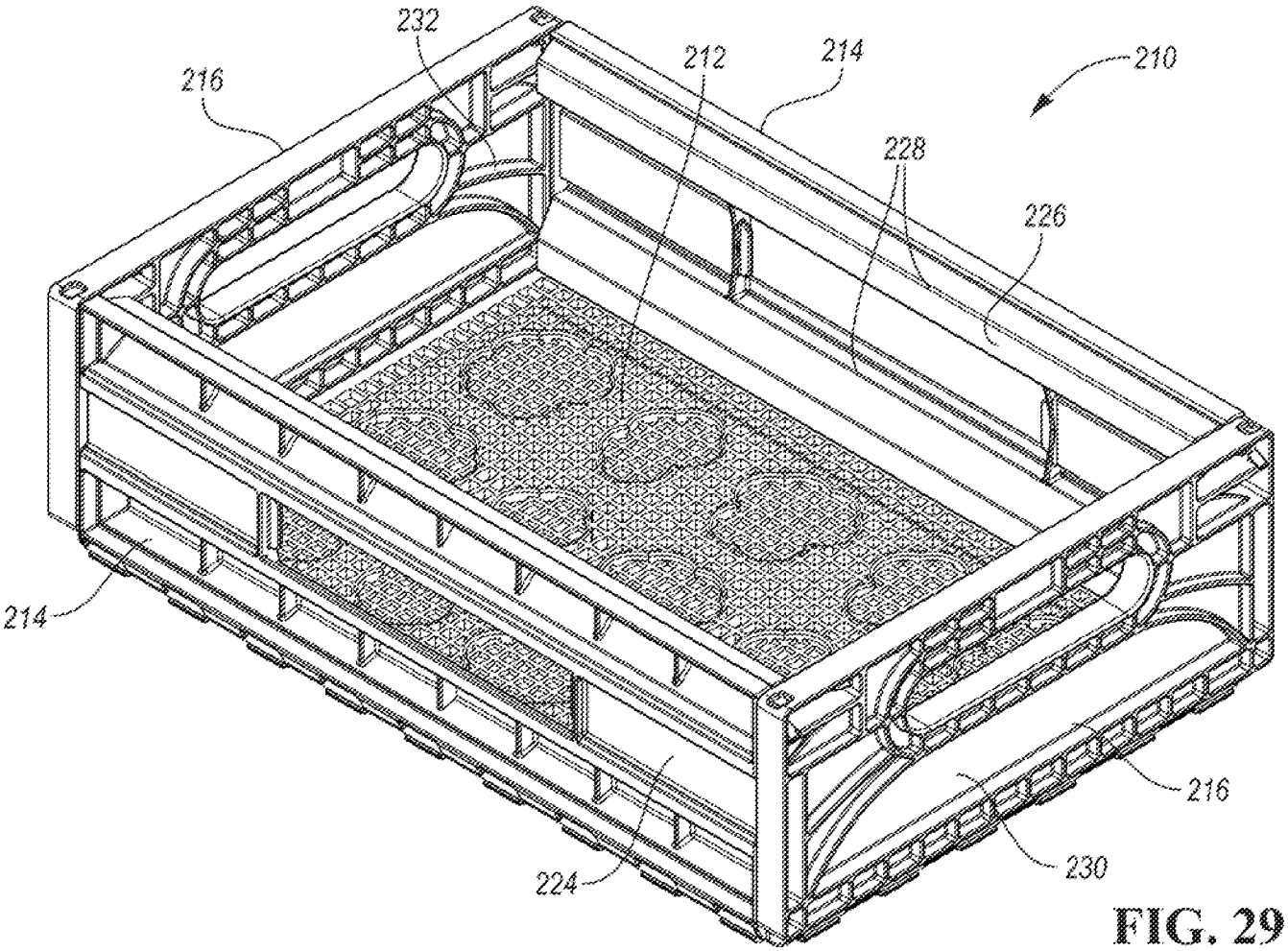
FIG. 29 shows the beverage crate of FIG. 28 in a second configuration with a reduced storage volume compared to that of FIG. 28.

The crate 210 can be reconfigured as shown in FIG. 29 so that the second surface 226 of each side wall 214 faces interior of the crate 210 and the first surface 224 faces exterior of the crate 210 and such that the second surface 232 of each end wall 216 faces interior of the crate, while the first surface 230 of each end wall 216 faces exterior of the crate 210. In this configuration, the spacer rails 228 of the side walls 214 project inward of the crate 210, occupying interior space of the crate 210. In this configuration the spacer rails 228 project over the base 212. In the configuration of FIG. 29, the second surfaces 226 are closer to one another than were the first surfaces 224 in FIG. 28. This reduces the storage volume of the interior of the crate 210 (for smaller bottles or for fewer larger bottles). Optionally, the end walls 216 could also provide different interior dimensions between the two configurations in a similar manner (i.e. with their own spacer rails).

Figure 30:
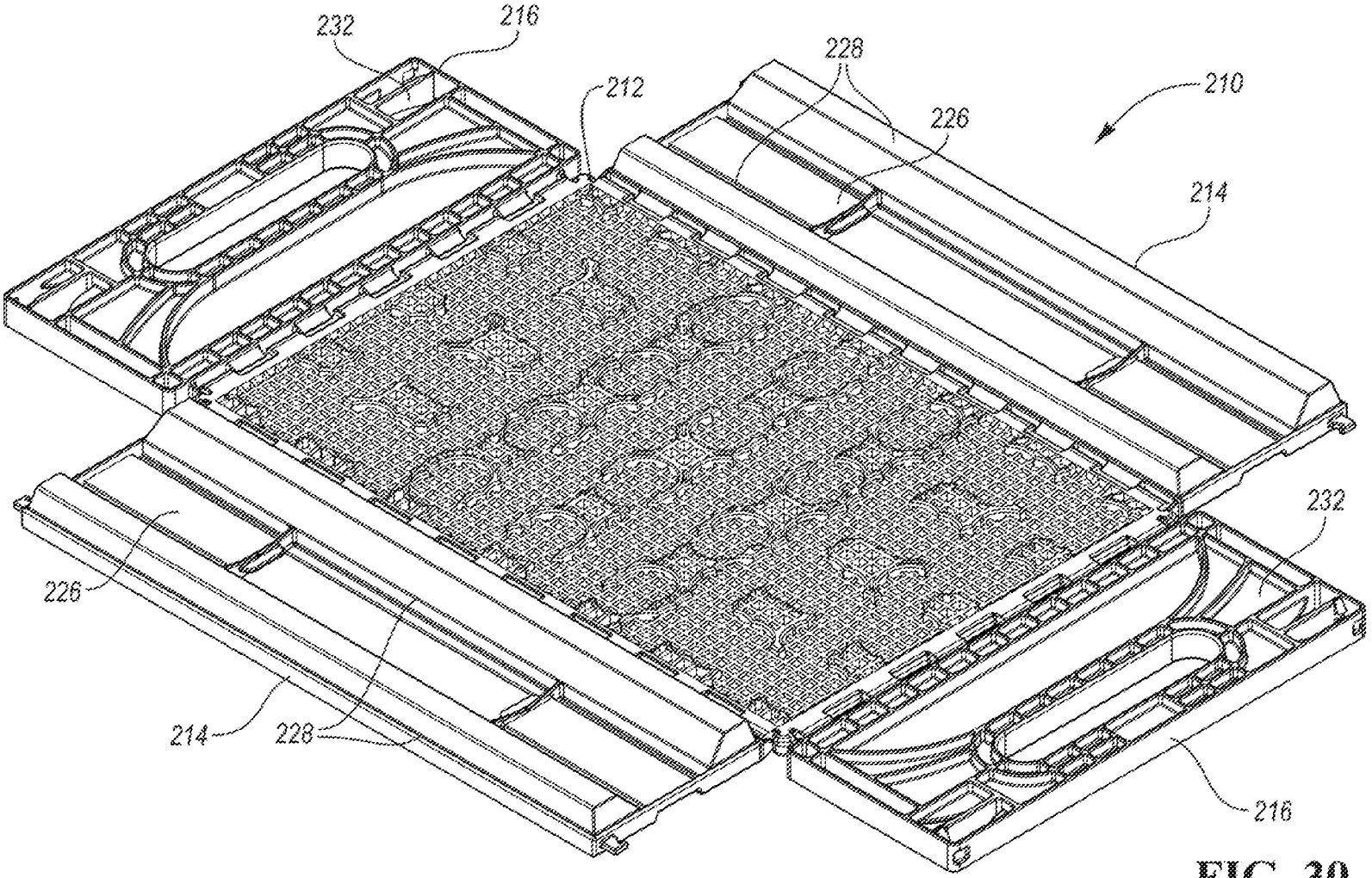
FIG. 30 is a collapsed view of the crate of FIG. 28.

As shown in FIG. 30, the crate is collapsible to a flat, shipping and storage configuration with the side walls 214 pivoted outward to be generally parallel to the base 212 and the end walls 216 to be pivoted outward generally parallel to the base 212.

Figure 31:
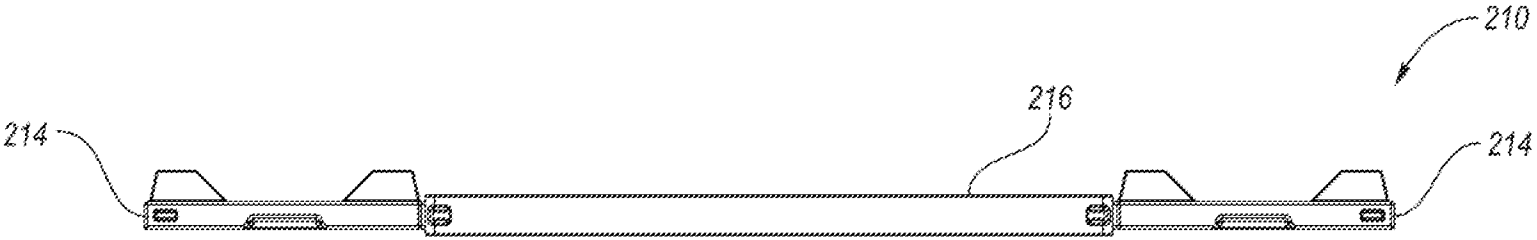
FIG. 31 is an end view of the collapsed crate of FIG. 30.
Figure 32:
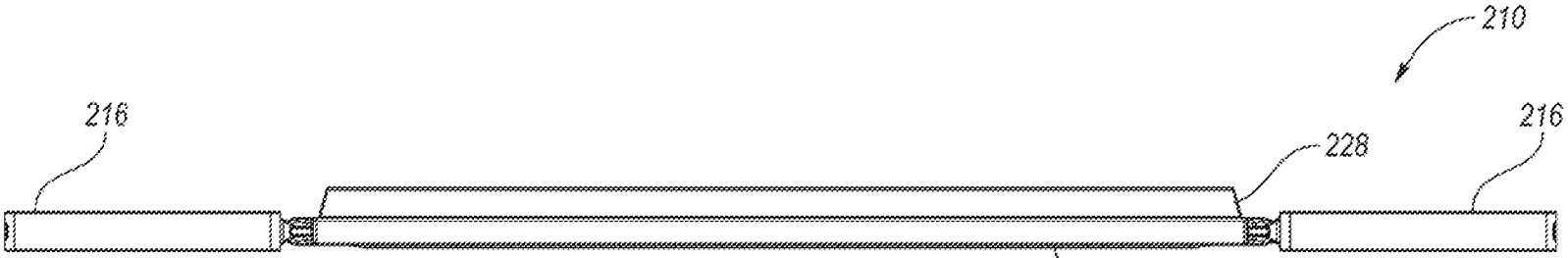
FIG. 32 is a side view of the collapsed crate of FIG. 30.
Figure 34:
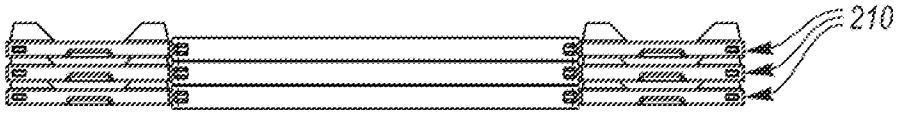
FIGS. 33, 34, and 35 show perspective, end and side views of a plurality of the collapsed crates of FIG. 30 stacked on one another.
Figure 35:
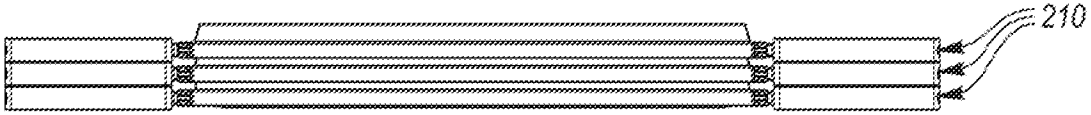
Figure 33:
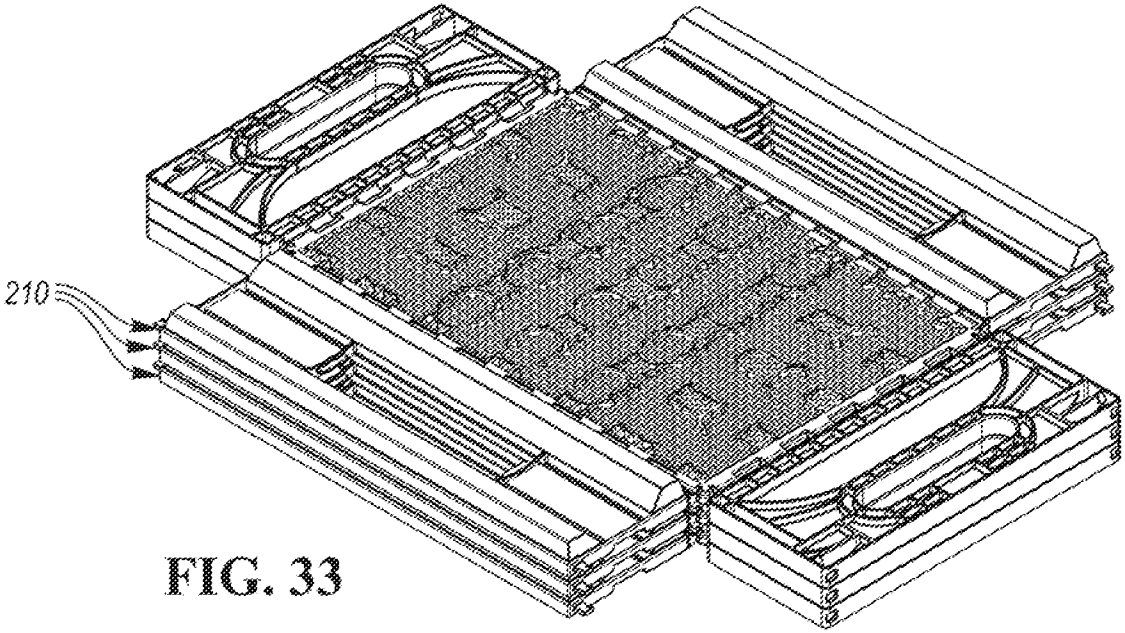
Figure 38:
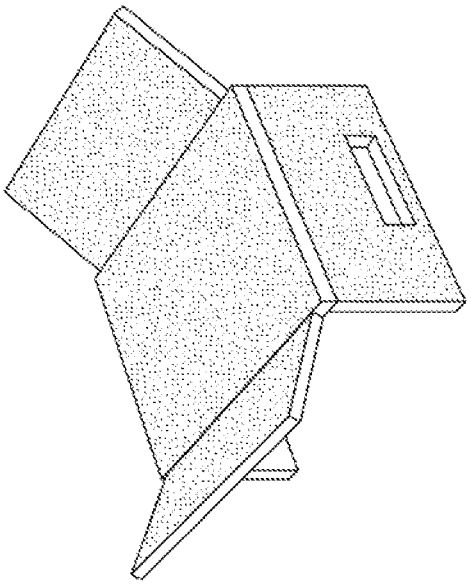
FIGS. 36-40 schematically show the sequence of reconfiguring of the crate from the configuration of FIG. 29 to the configuration of FIG. 30 (or vice versa).
Figure 37:
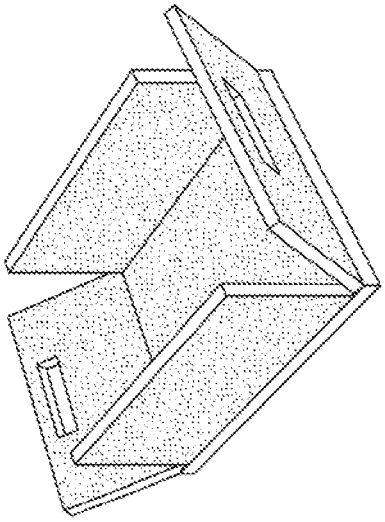
Figure 40:
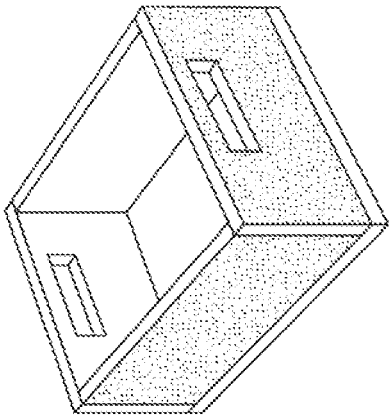
Figure 39:
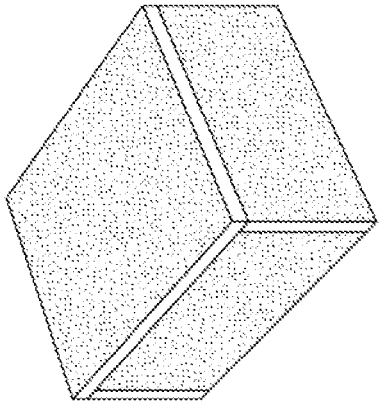
Figure 36:
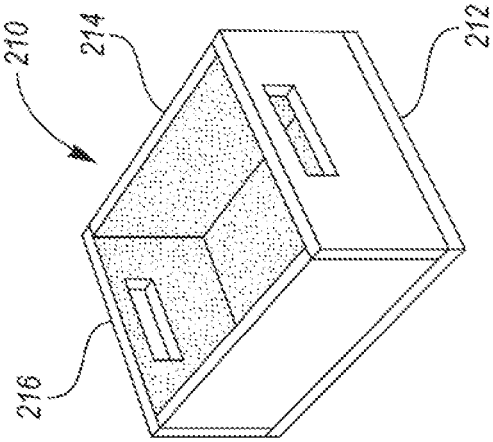

FIG. 31 is an end view of the collapsed crate 210 of FIG. 30. FIG. 32 is a side view of the collapsed crate 210 of FIG. 30. FIGS. 33, 34 and 35 show a plurality of the collapsed crates 210 stacked on one another.

FIGS. 36-40 schematically show the sequence of reconfiguring the crate 210 from the configuration of FIG. 29 to the configuration of FIG. 30 (or vice versa). As shown, the side walls 214 and end walls 216 are unlatched and then pivoted outward approximately 180 degrees until they are reconfigured with the interior and exterior surfaces of the walls 214, 216 switched. As shown in FIGS. 29 and 30, this ability to reconfigure the crate 210 can be used to move the spacer rails 228 from an exterior of the crate to an interior of the crate to reduce the dimension of the interior of the crate 210 to accommodate different size and/or a different number of bottles.

Figure 41:
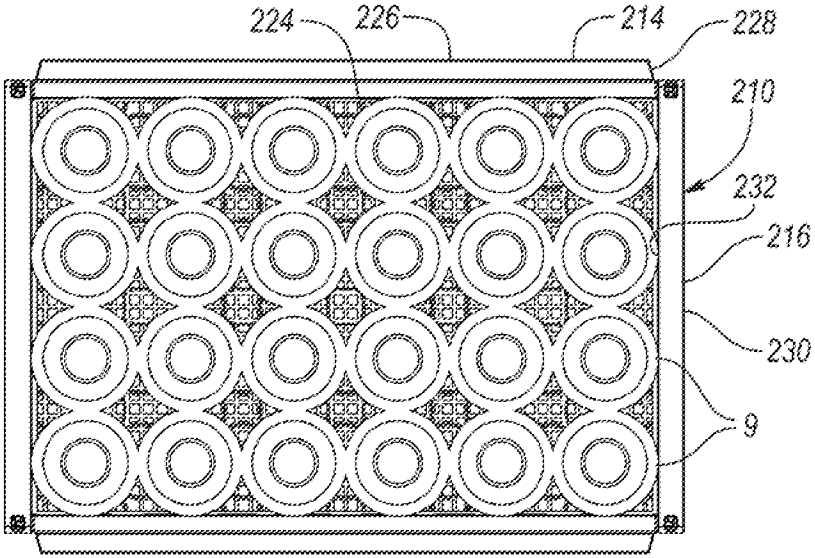
FIGS. 41-43 show a plurality of smaller bottles that are received reasonably snugly within the crate.
Figure 42:
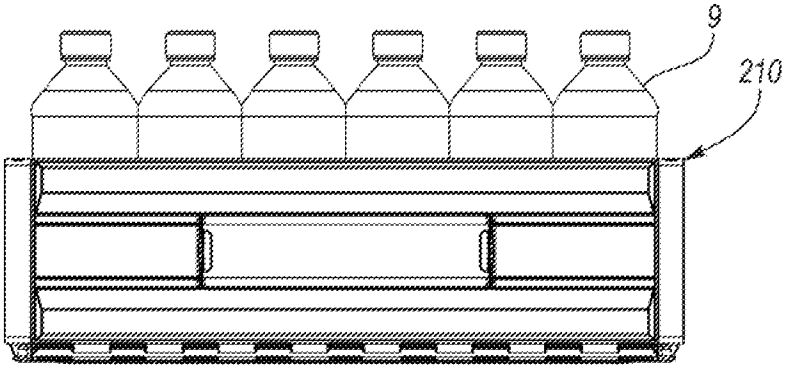
Figure 43:
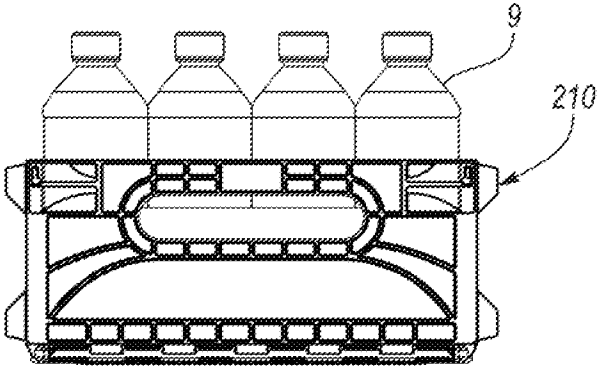

For examples, as shown in FIG. 41-43, a plurality of smaller bottles 9 are received reasonably snugly within the crate 210, with the spacer rails 228 facing the exterior of the crate 210.

Figure 46:
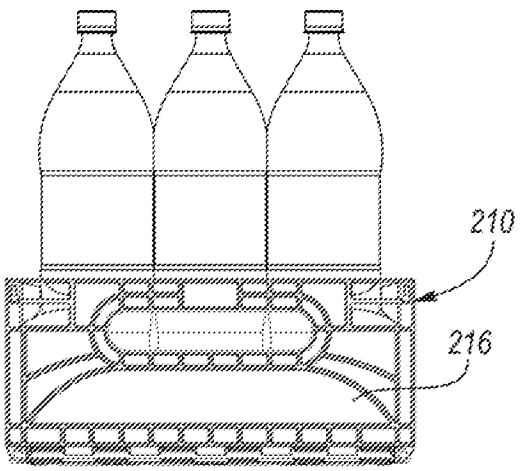
FIGS. 44-46 show perspective, side and end views of the crate with fewer bottles received therein than in FIG. 41.
Figure 44:
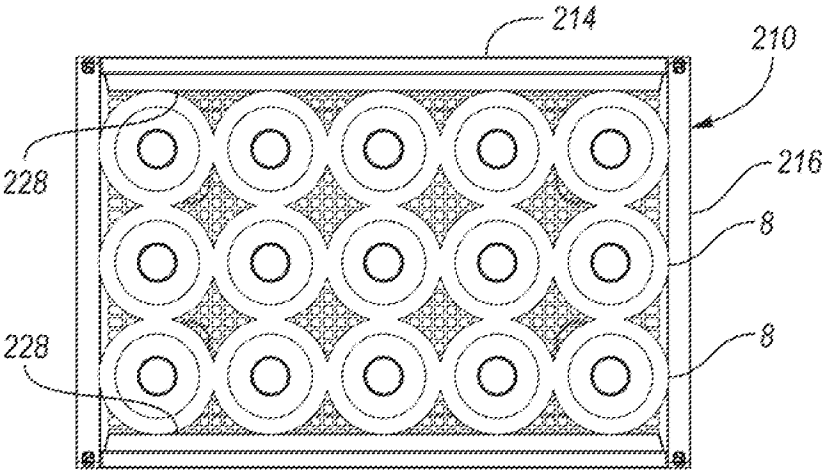
Figure 45:
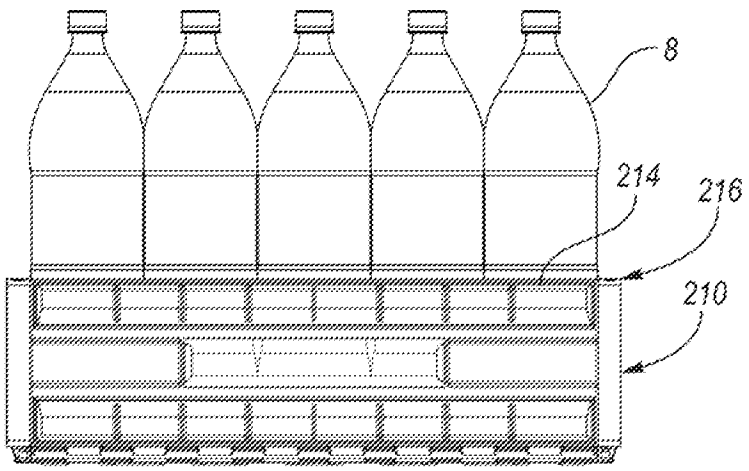

FIGS. 44-46 a lesser number of larger bottles 8 are received in the crate 210 in the configuration in which the spacer rails 228 are facing interior of the crate 210. In this manner both size bottles 8, 9 can be accommodated reasonably snugly within the same crate 210 in different configurations.

Figure 47:
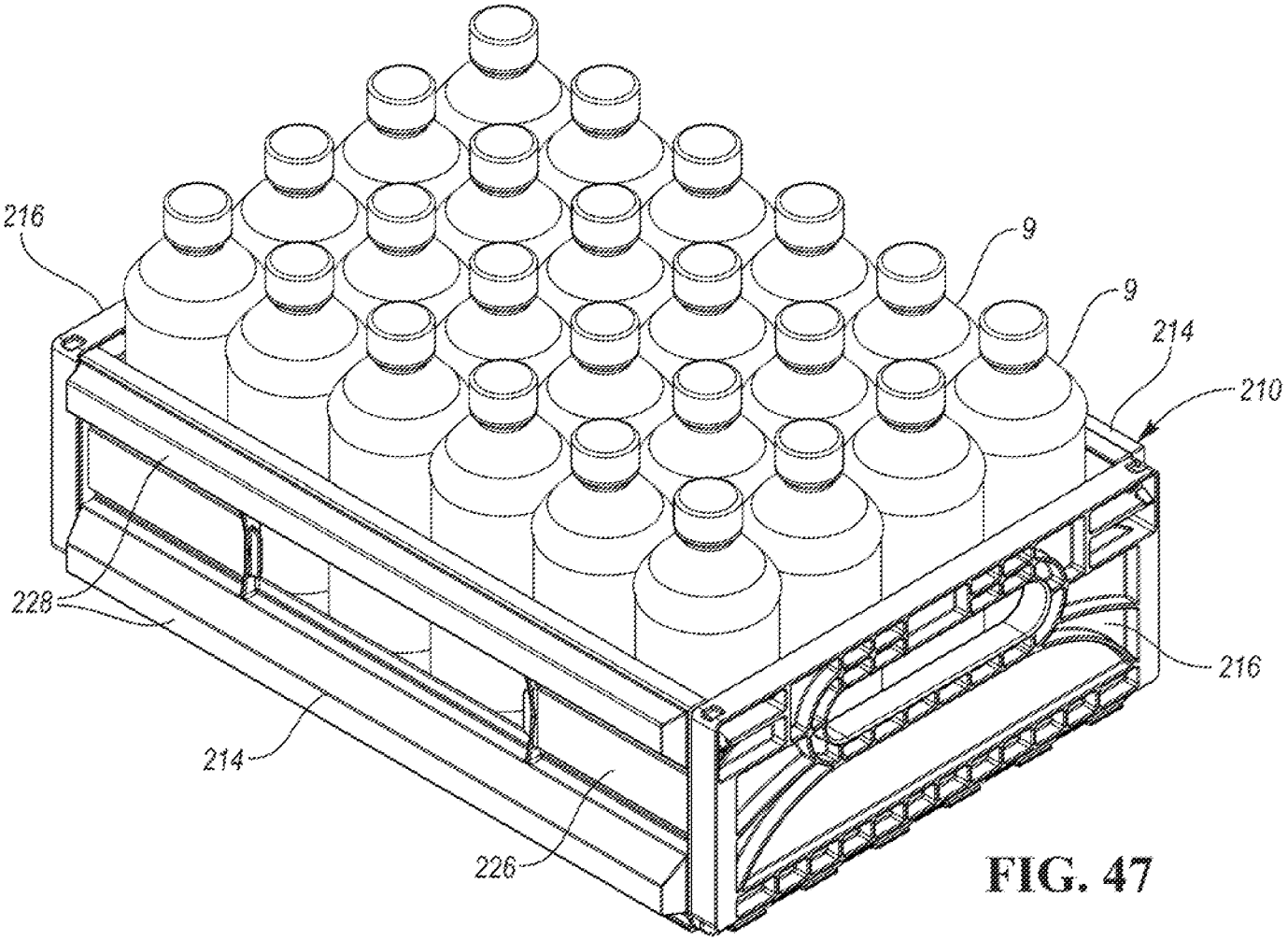
FIG. 47 is a perspective view of the crate and bottles of FIG. 41.

FIG. 47 is a perspective view of the crate 210 and bottles 9 of FIG. 41.

Figure 48:
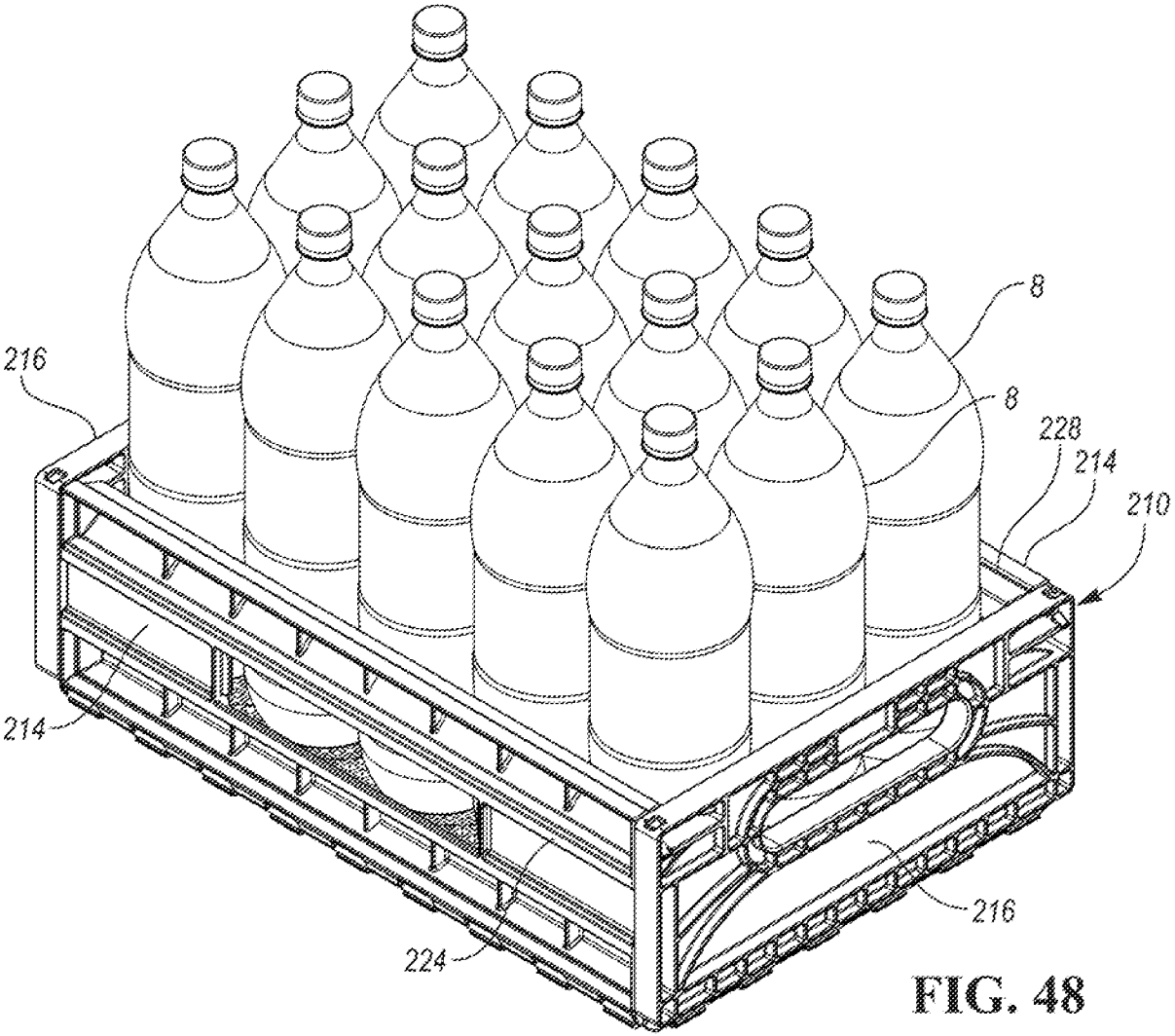
FIG. 48 is a perspective view of the crate and bottles of FIG. 44.

FIG. 48 is a perspective view of the crate 210 and bottles 8 of FIG. 44.

Figure 49:
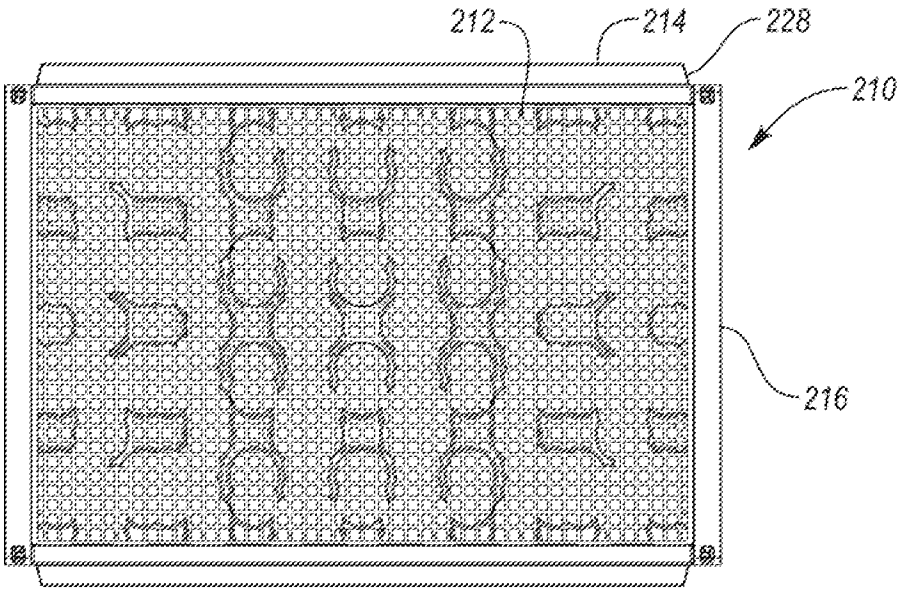
FIG. 49 is a top view of the crate of FIG. 28.
Figure 50:
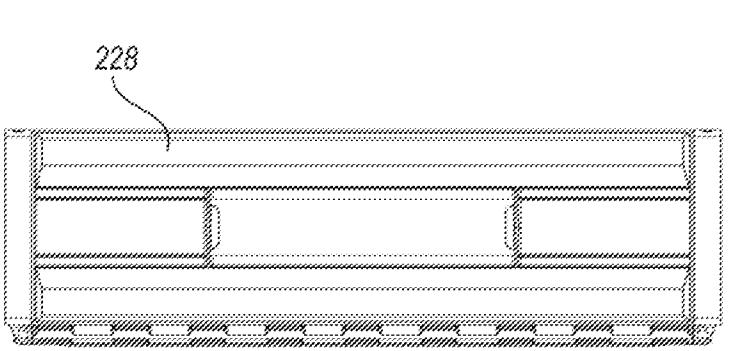
FIG. 50 is a side view of the crate of FIG. 49.
Figure 51:
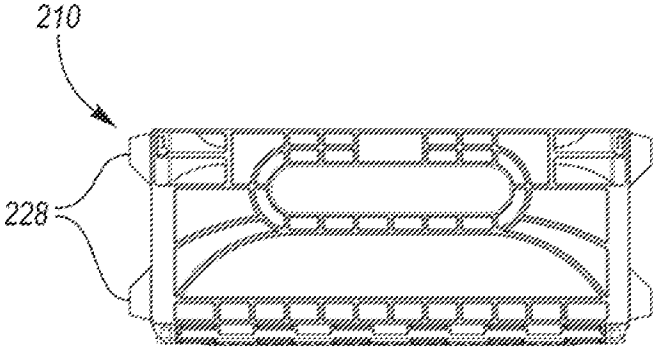
FIG. 51 is an end view of the crate of FIG. 49.

FIG. 49 is a top view of the crate 210 configured with the spacer rails 228 facing exterior of the crate 210. FIGS. 50 and 51 are side and end views of the crate of FIG. 49.

Figure 52:
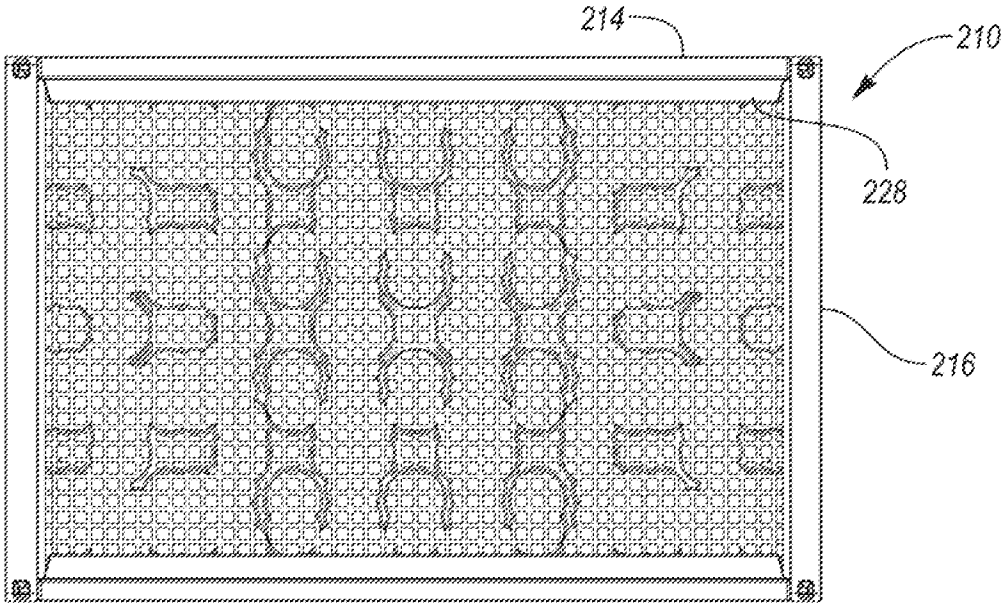
FIG. 52 is a top view of the crate of FIG. 29 with the spacer rails facing interior of the crate.
Figure 53:
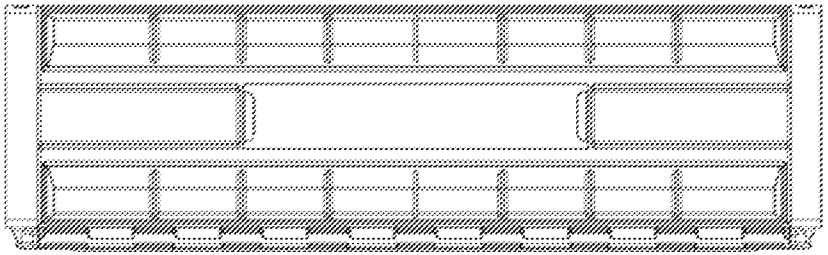
FIG. 53 is a side view of the crate of FIG. 52.
Figure 54:
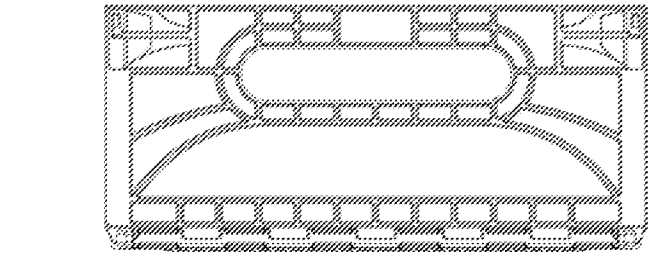
FIG. 54 is an end view of the crate of FIG. 52.

FIG. 52 is a top view of the crate 210 with the spacer rails 228 facing interior of the crate 210. FIGS. 53 and 54 are side and end views, respectively, of the crate 210 of FIG. 52.

Figure 55:
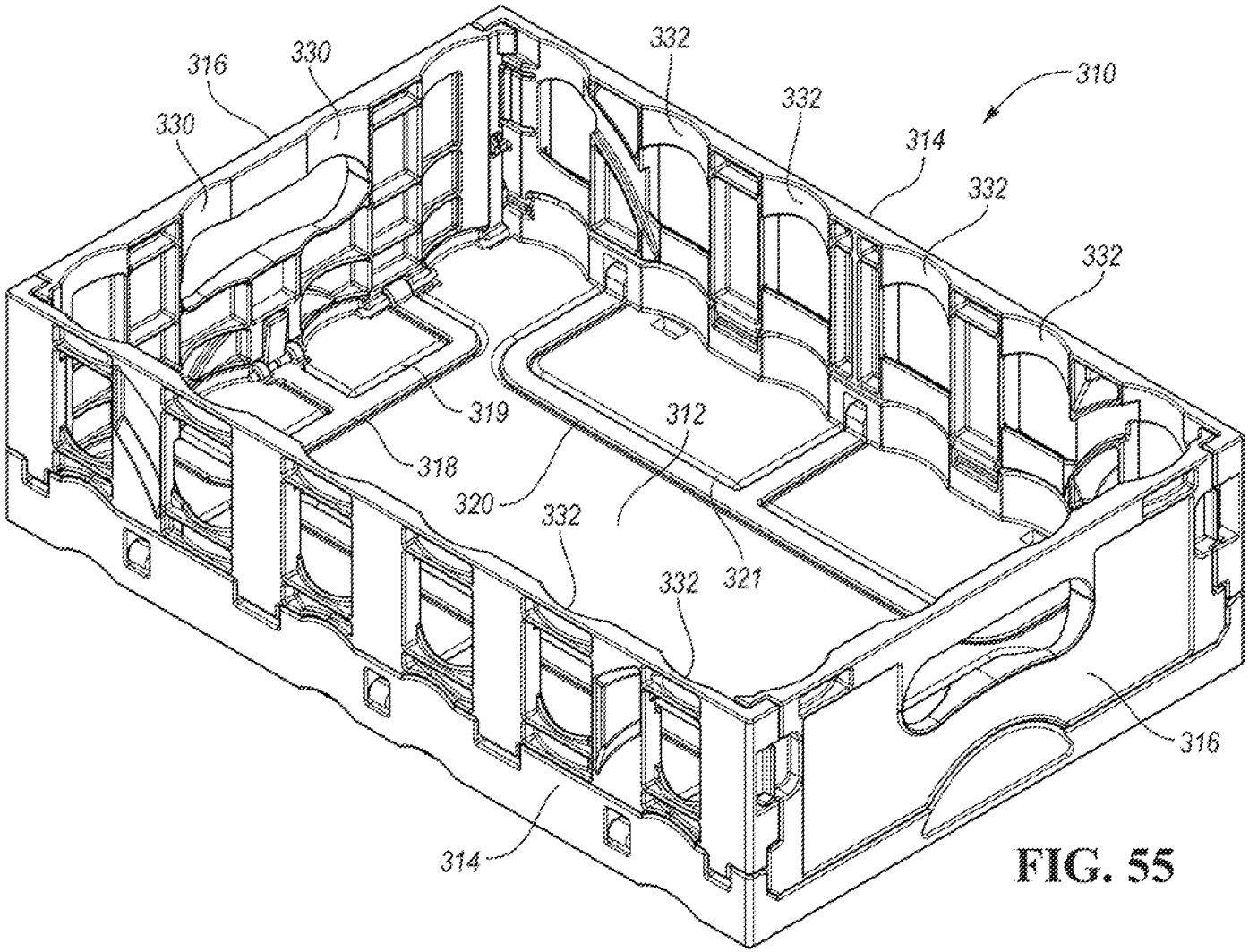
FIG. 55 is a perspective view of a crate according to a fourth embodiment.

FIGS. 55-66 show a collapsible beverage crate 310 according to a fourth embodiment. The crate 310 includes a base 312 having side walls 314 pivotably connected to side edges and end walls 316 pivotably connected to end edges. End spacers 318 are pivotably connected adjacent lower edges of the end walls 316 and can be pivoted down to their stowed position in a recess 319 in the base 312 as shown in FIG. 55. Side spacers 320 are pivotably connected adjacent lower ends of the side walls 314 and can be stowed in recesses 321 formed in the base 312, as shown. Interior surfaces of the end walls 316 include a plurality of recesses 330 for partially receiving bottles. Likewise, the side walls 314 each include a plurality of recesses 332 for partially receiving bottles. The recesses 330, 332 are generally portions of a cylinder with a vertical axis (perpendicular to the base 312).

Figure 56:
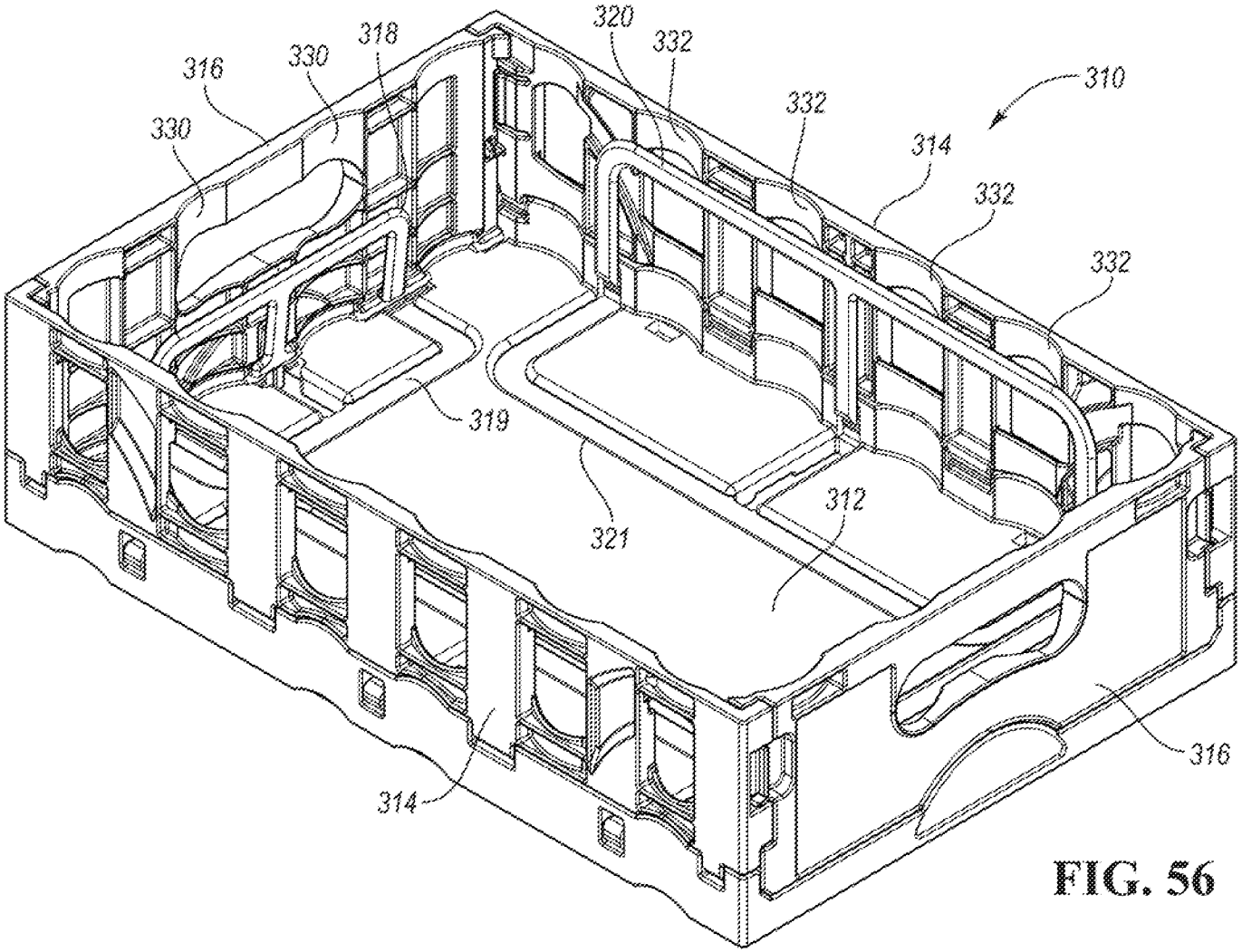
FIG. 56 shows the crate of FIG. 55 with the spacers pivoted upward to a deployed position.

Referring to FIG. 56, the spacers 318, 320 can be pivoted upward to a deployed position as shown in FIG. 56. In the deployed position, the end spacers 318 are positioned in front of at least some of the recesses 330 formed on the interior surface of the end walls 316. The spacers 320 are also positioned in front of the recesses 332 on the side walls 314. In this matter, the effective interior dimensions of the crate 310 are reduced to the extent that the spacers 318 block the recesses 330 and to the extent that the spacers 320 block the recesses 332, plus the thickness of the spacers 318, 320.

Figure 57:
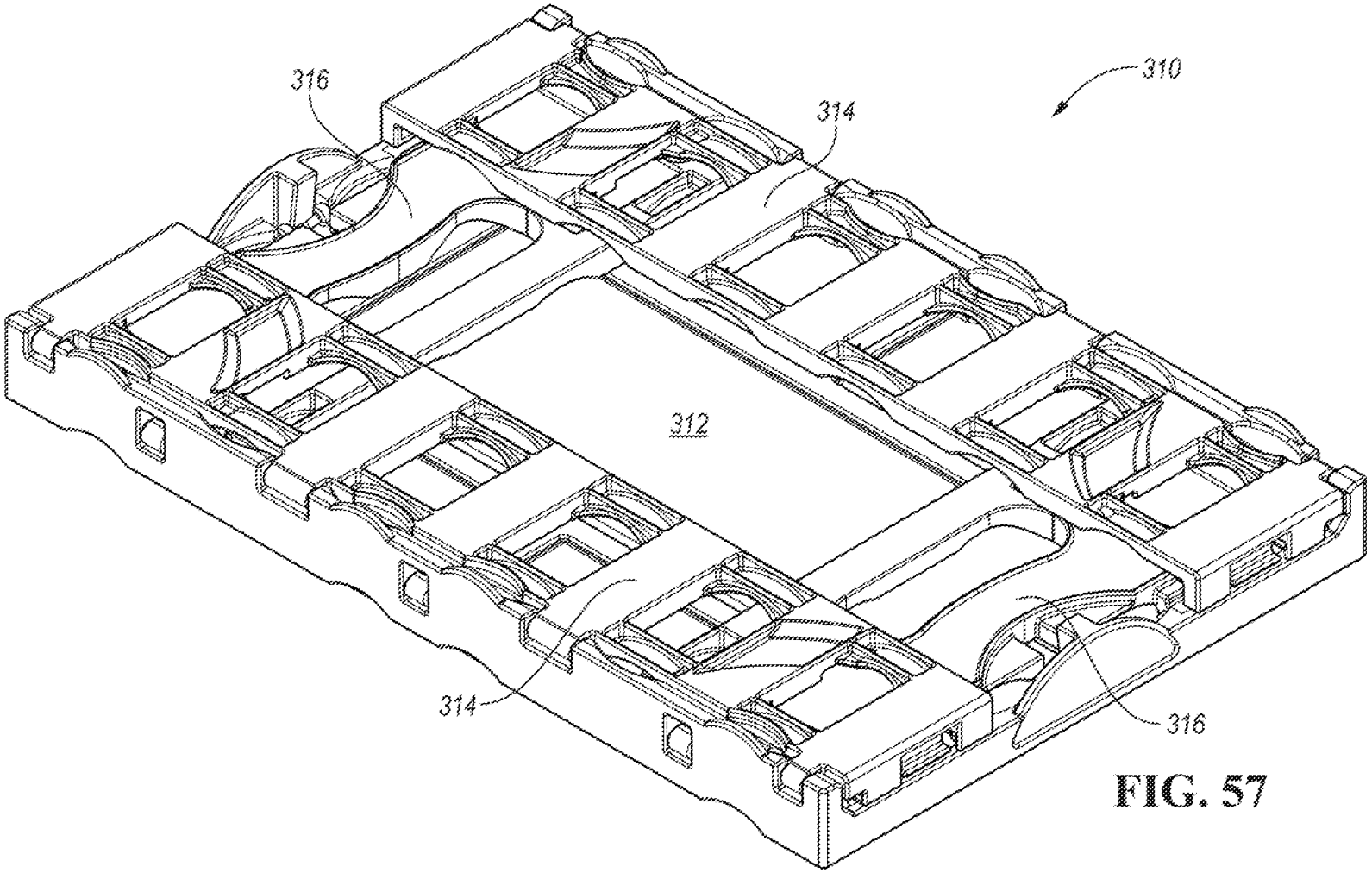
FIG. 57 shows the crate of FIG. 55 in a collapsed position.
Figure 58:
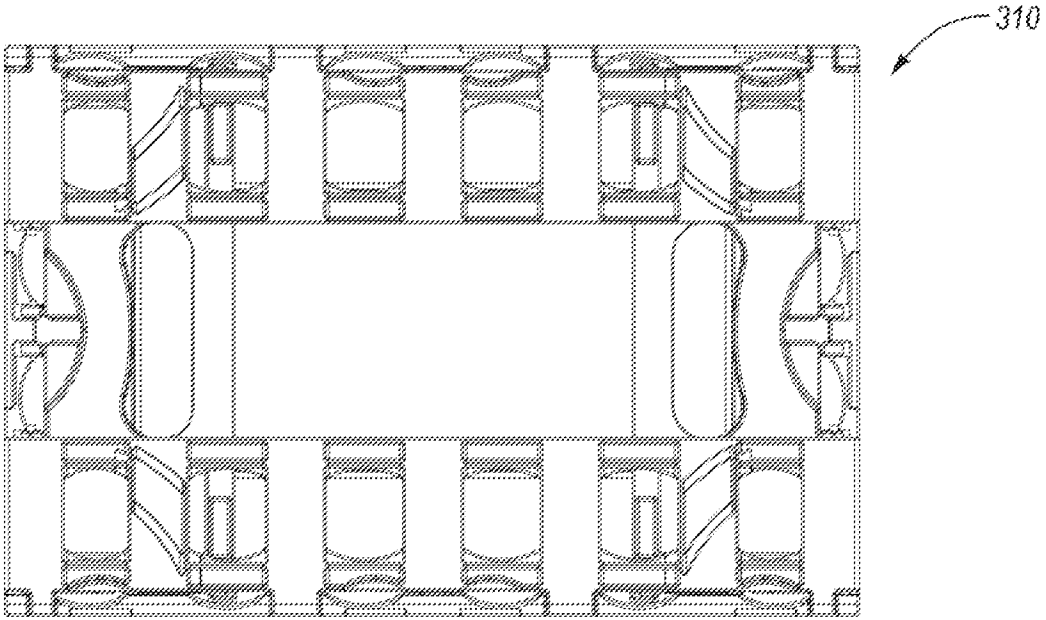
FIG. 58 is a top view of the crate of FIG. 57.
Figure 59:
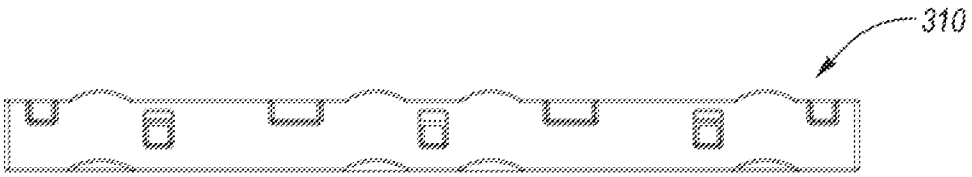
FIG. 59 is a side view of the collapsed crate of FIG. 58.
Figure 60:
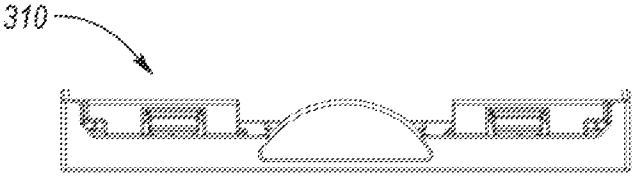
FIG. 60 is an end view of the collapsed crate of FIG. 58.

As shown in FIG. 57, the end walls 316 can be collapsed onto the base 312 and the side walls 314 can be collapsed onto the end walls 316 and base 312. FIG. 58 is a top view of the crate 310 in the collapsed position. FIGS. 59 and 60 are side and end view of the collapsed crate 310.

Figure 61:
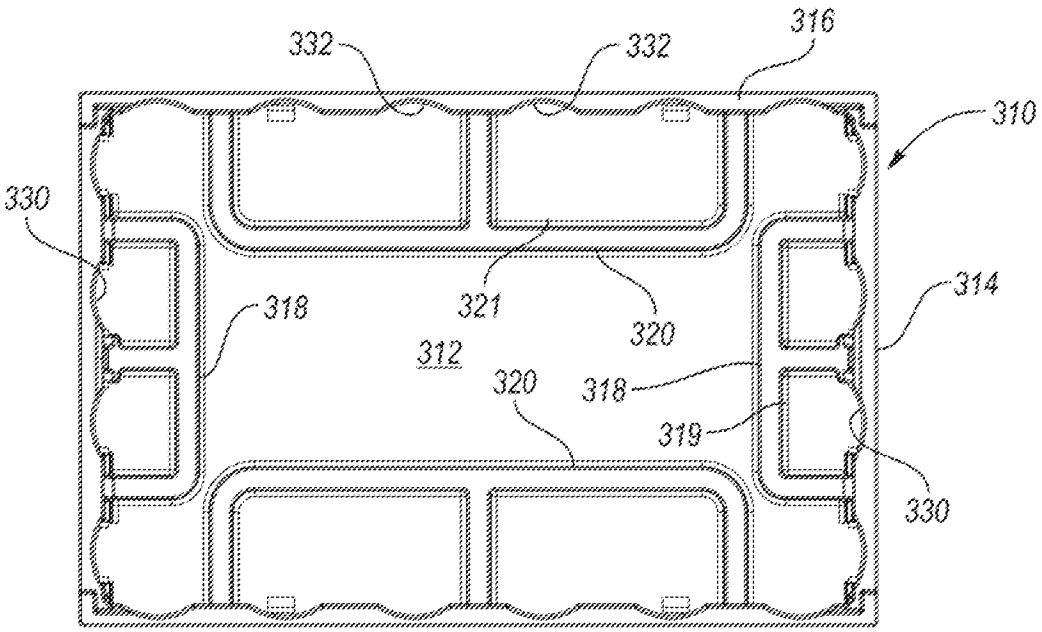
FIG. 61 is a top view of the crate of FIG. 55 showing the spacers in the stowed position in the recesses in the base.
Figure 62:
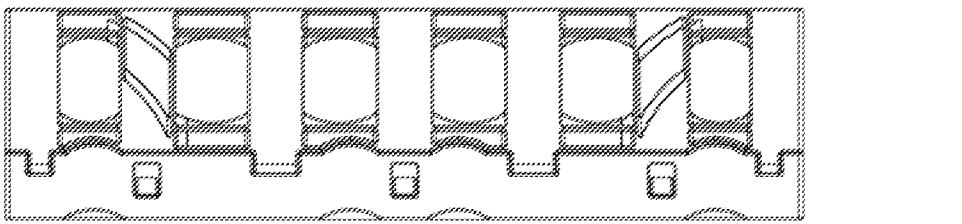
FIG. 62 is a side view of the crate of FIG. 61.
Figure 63:
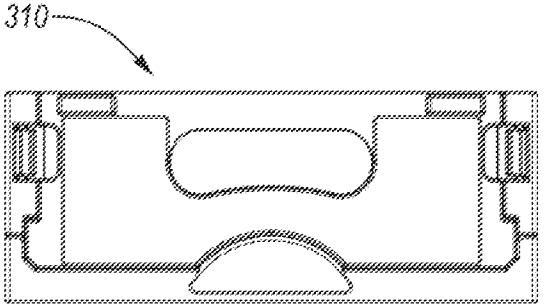
FIG. 63 is an end view of the crate of FIG. 61.

FIG. 61 is a top view of the crate 310 showing the spacers 318, 320 in the stowed position in the recesses 319, 321, respectively in the base 312. As shown, the recesses 330, 332 are exposed to the interior of the crate 310. FIGS. 62 and 63 are side and end views of the crate 310 of FIG. 61.

Figure 64:
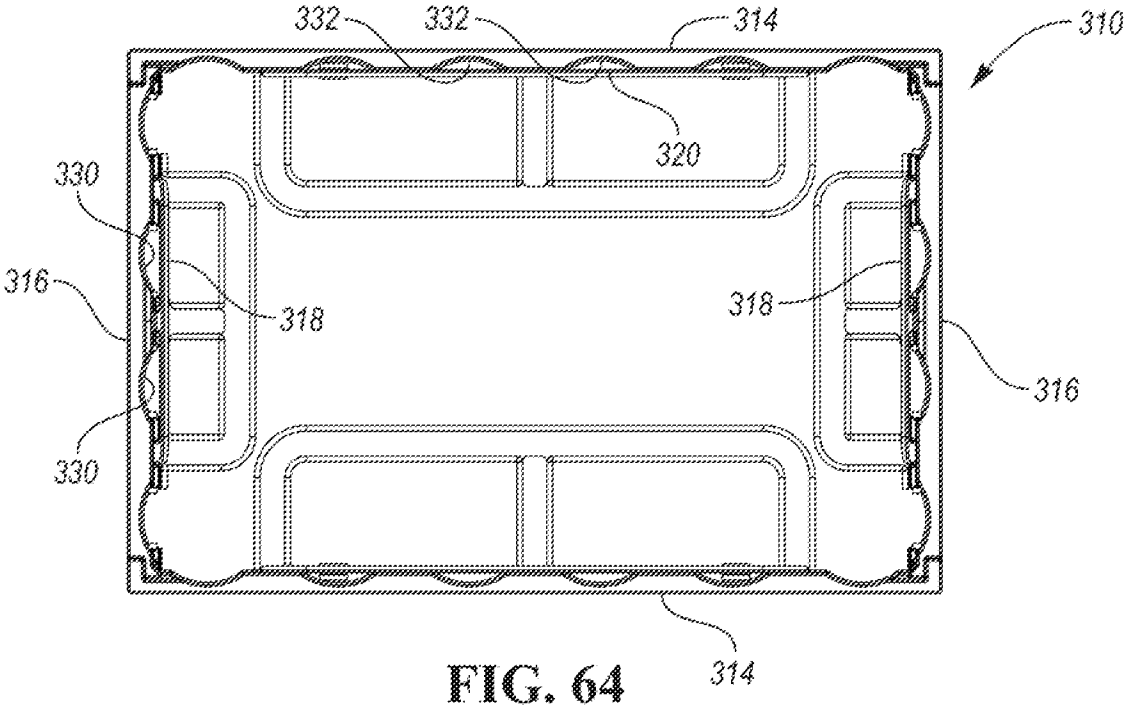
FIG. 64 is a top view of the crate of FIG. 56 with the spacers in the deployed position against the end walls and side walls.
Figure 65:
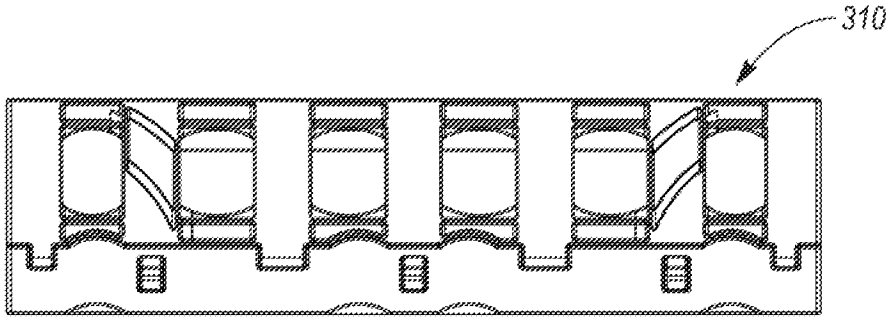
FIG. 65 is a side view of the crate of FIG. 64.
Figure 66:
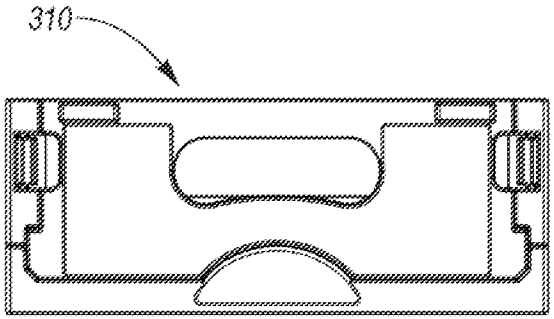
FIG. 66 is an end view of the crate of FIG. 64.

FIG. 64 shows the crate 310 with the spacers 318, 320 in the deployed position against the end walls 316 and side walls 314, respectively. In this position, the spacers 318, 320, block the recesses 330, 332, respectively, thereby reducing the effective interior dimensions of the crate 310. FIGS. 65 and 66 are side and end views of 310 of FIG. 64.

FIGS. 67-78 show a collapsible beverage crate 410 according to a fifth embodiment. The crate 410 includes abase 412 having side walls 414 and end walls 416. Again the end walls 416 include recesses 430 and the side walls 414 include recesses 432 as before. In this embodiment, the end walls 416 include one or more end spacers 418 which are pivotably connected at upper ends of the end walls 416 adjacent the recesses 430. In the stowed/retracted position, the end spacers 418 extend upward from hinges connecting them to the end walls 416. Similarly, side spacers 420 are pivotably connected adjacent upper edges of the side walls 414 adjacent the recesses 432. In the stowed/retracted position, the side spacers 420 extend upward from hinges connecting them to the side walls 414.

Figure 67:
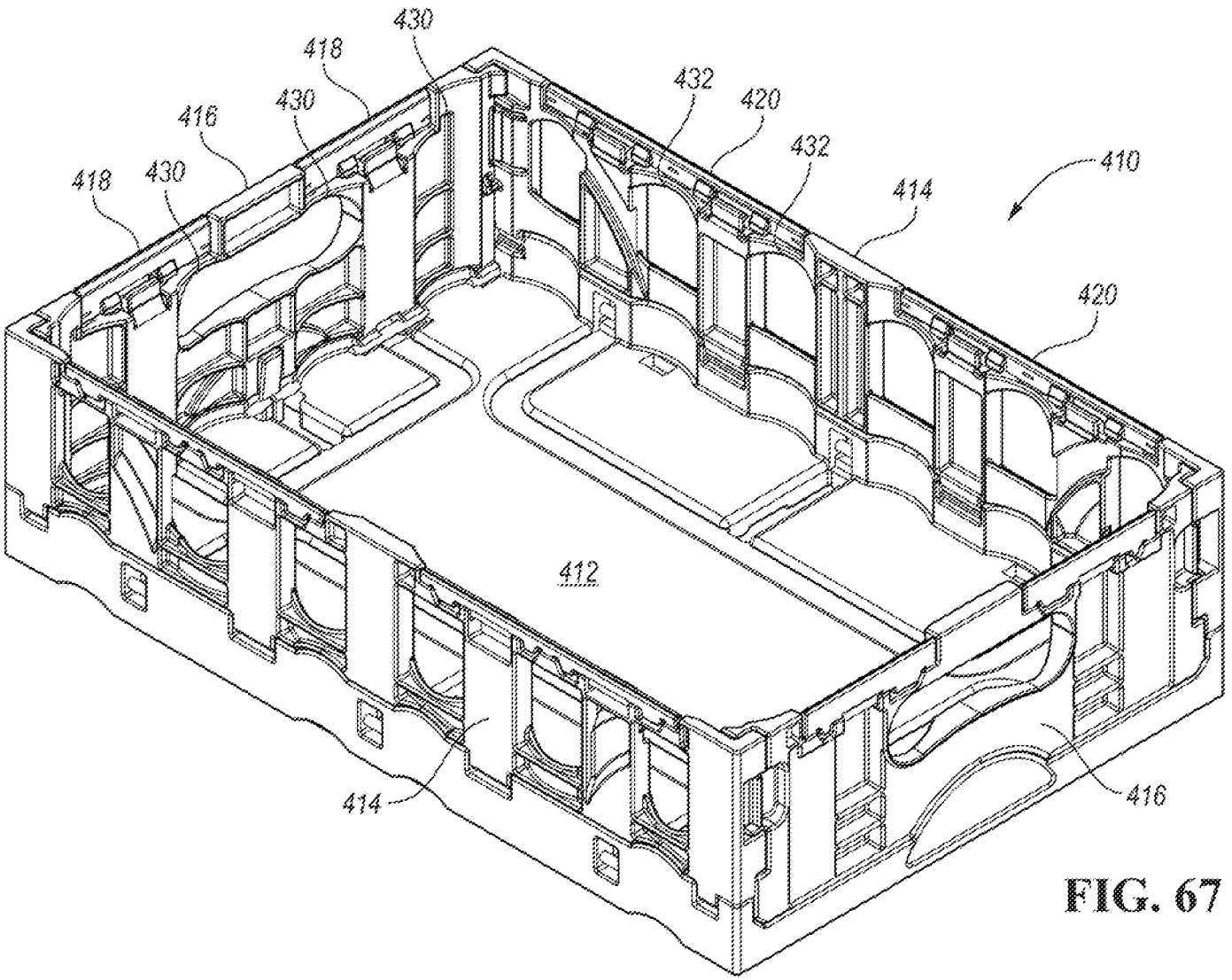
FIG. 67 is a perspective view of a crate according to a fifth embodiment with the spacers in the stowed or retracted position.
Figure 68:
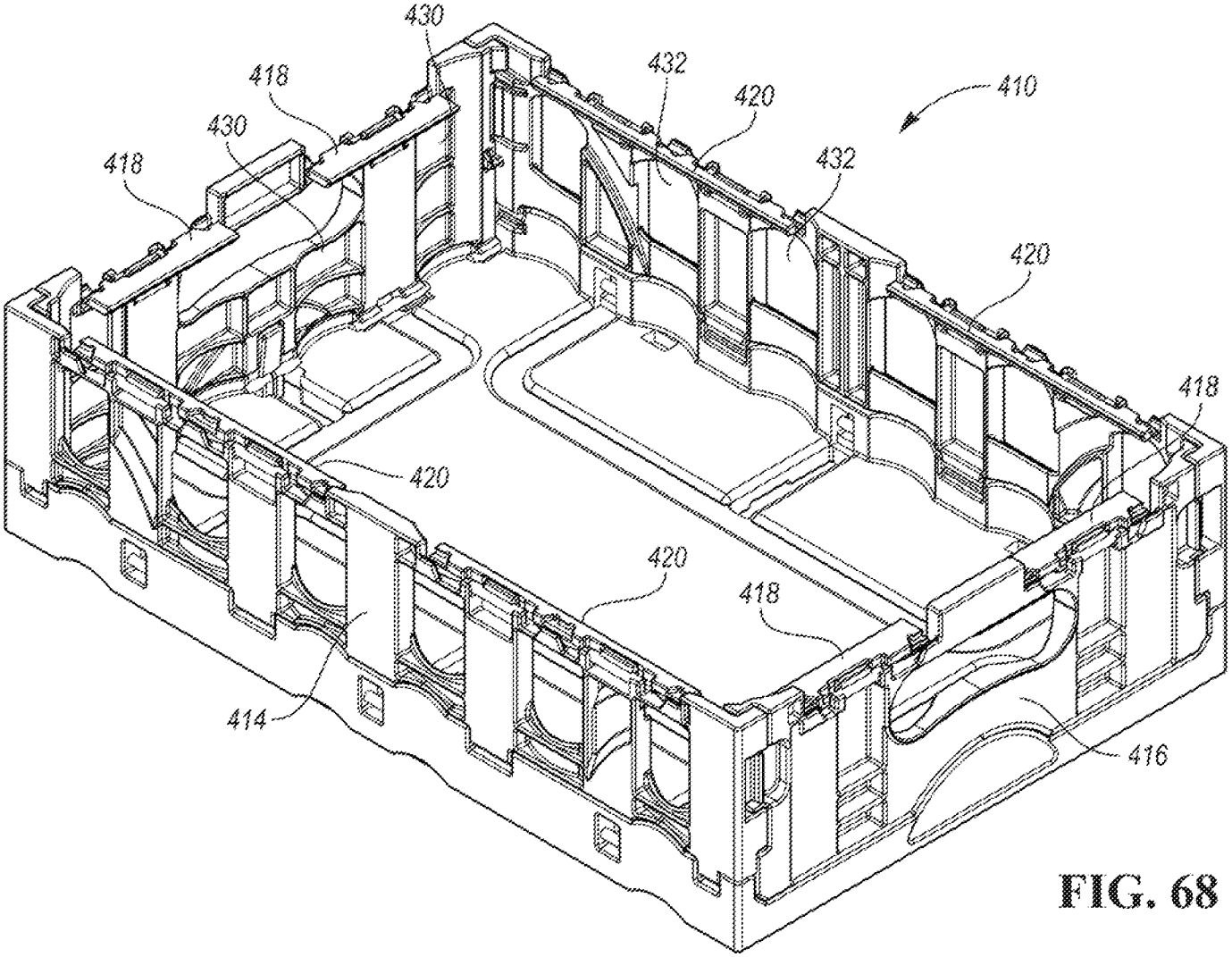
FIG. 68 shows the crate of FIG. 67 with the spacers pivoted downward to a deployed position.

In FIG. 67, the spacers 418, 420 are shown in the stowed or retracted position. In FIG. 68, the spacers 418, 420 are pivoted downward ninety degrees such that they project into the interior space of the crate 410. The spacers 418, 420 block or effectively block the recesses 430, 432, respectively, effectively reducing the interior dimensions of the crate 410 to the extent they block the recesses 430, 432 and to the extent they further project into the interior of the crate 410.

Figure 69:
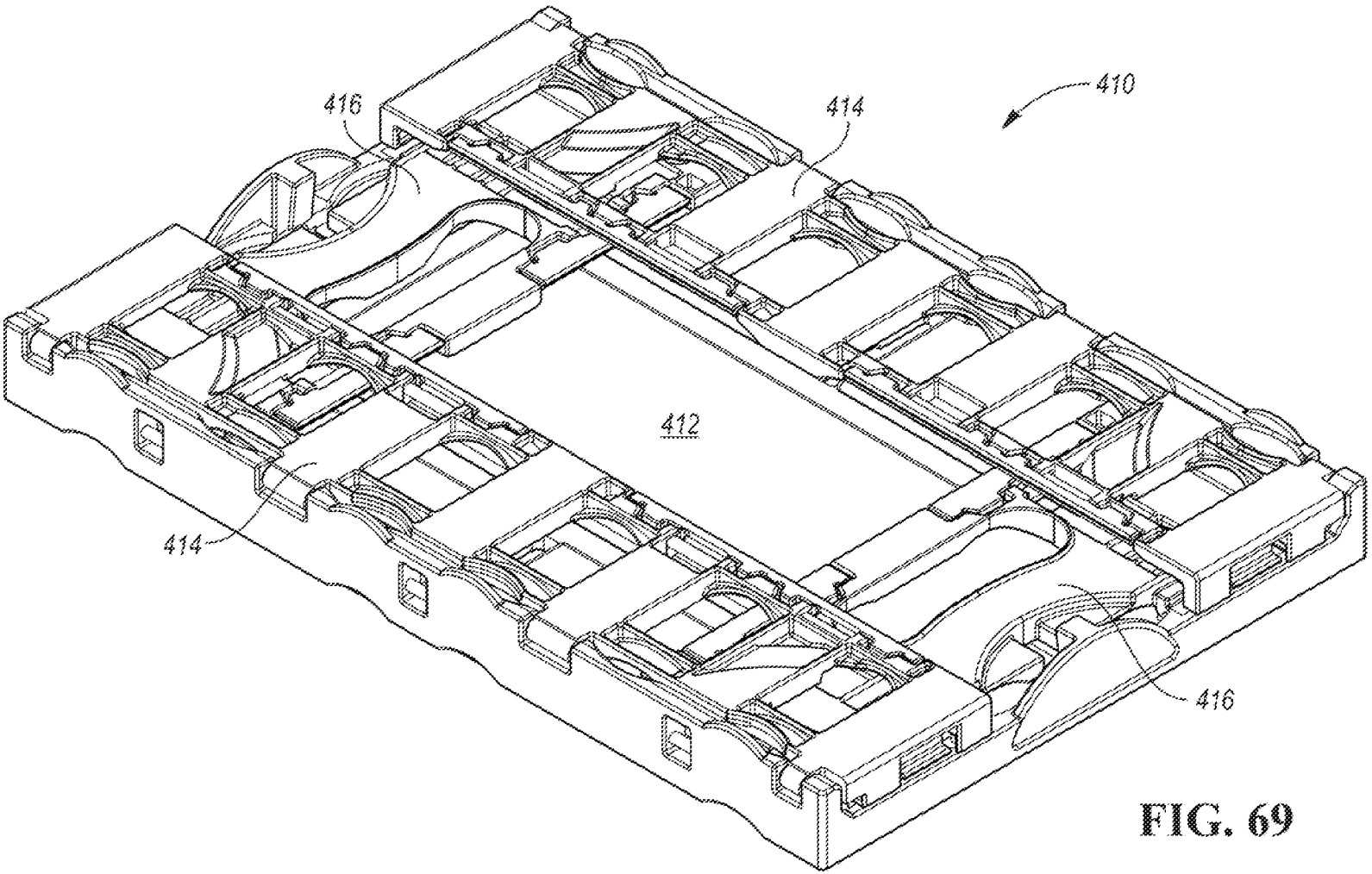
FIG. 69 shows the crate of FIG. 67 with the side walls and end walls collapsed onto the base.
Figure 70:
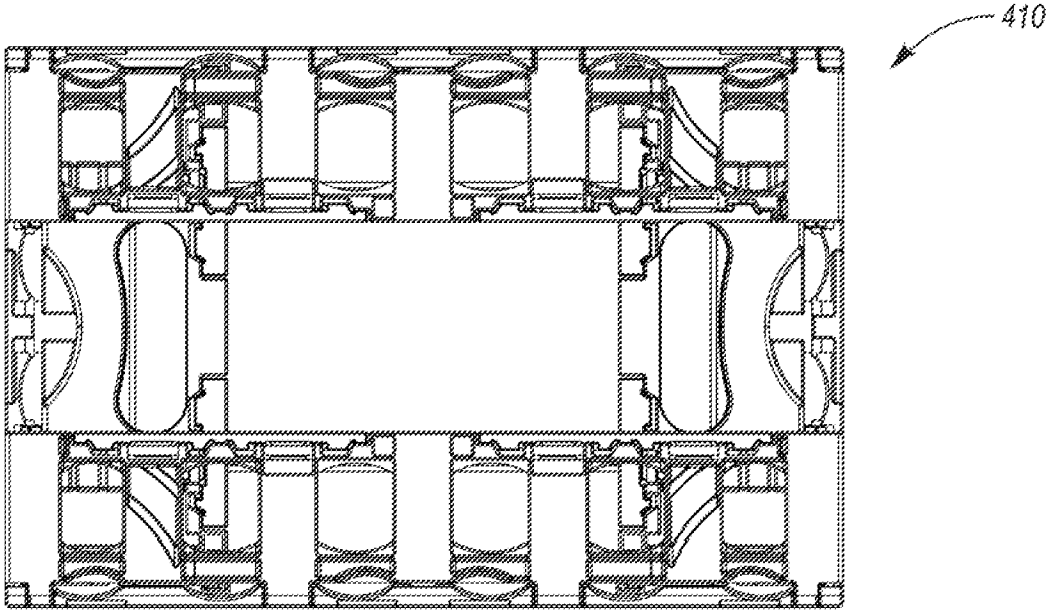
FIG. 70 is a top view of the crate of FIG. 69 in the collapsed position.
Figure 71:
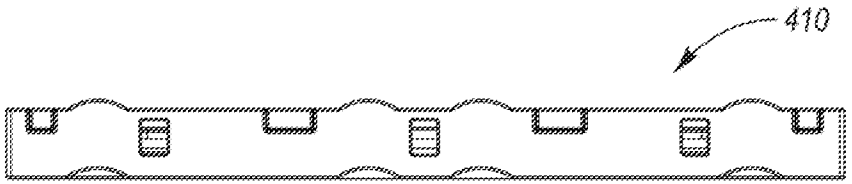
FIG. 71 is a side view of the collapsed crate of FIG. 69.
Figure 72:
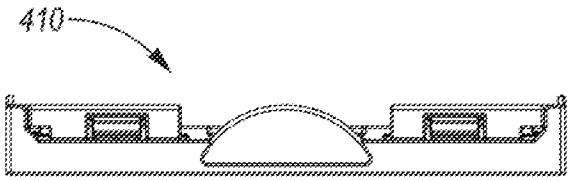
FIG. 72 is an end view of the collapsed crate of FIG. 69.

FIG. 69 shows the crate 410 in the collapsed position, with the side walls 414 and end walls 416 collapsed onto the base 412. FIGS. 70, 71 and 72 are top side and end views of the collapsed crate of FIG. 69.

Figure 73:
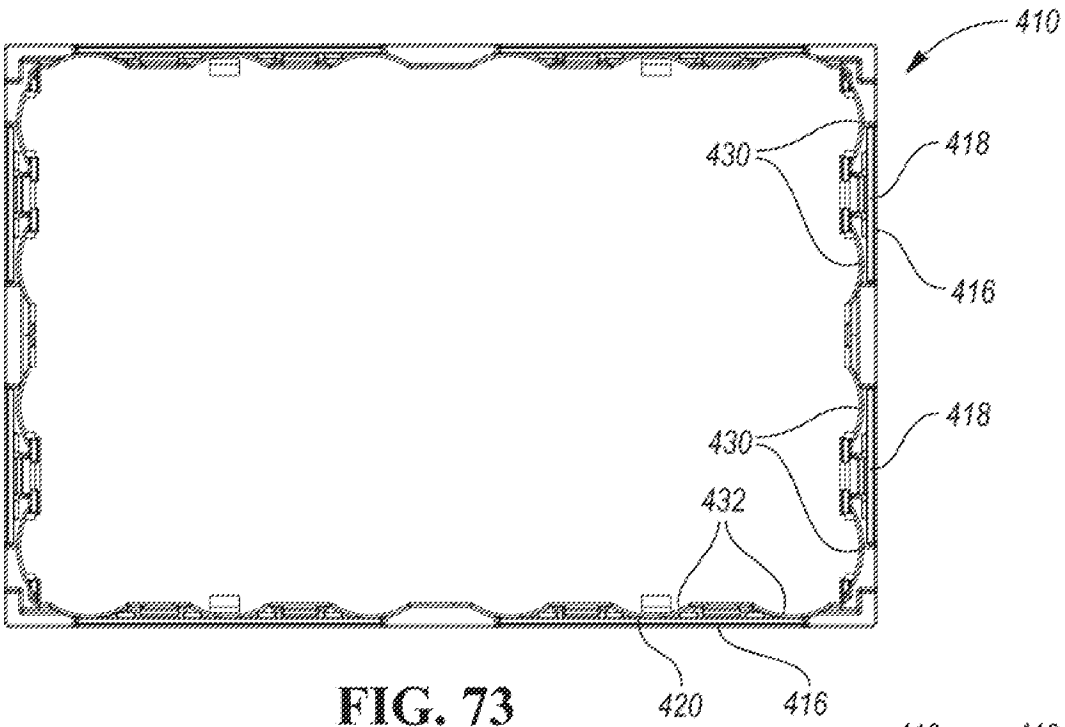
FIG. 73 is a top view of the crate of FIG. 67 with the spacers in the retracted position.
Figure 74:
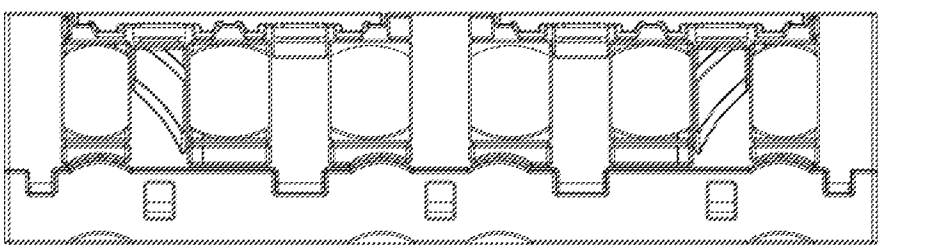
FIG. 74 is a side view of the crate of FIG. 73.
Figure 75:
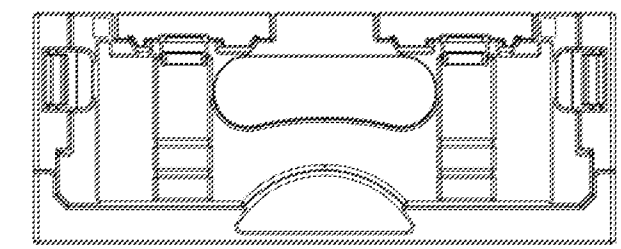
FIG. 75 is an end view of the crate of FIG. 73.

FIG. 73 is a top view of the crate 410 with the spacers 418, 420 in the retracted position, exposing the recesses 430, 432 to the interior of the crate. FIG. 74 are side and end views of the crate 410 of FIG. 73.

Figure 76:
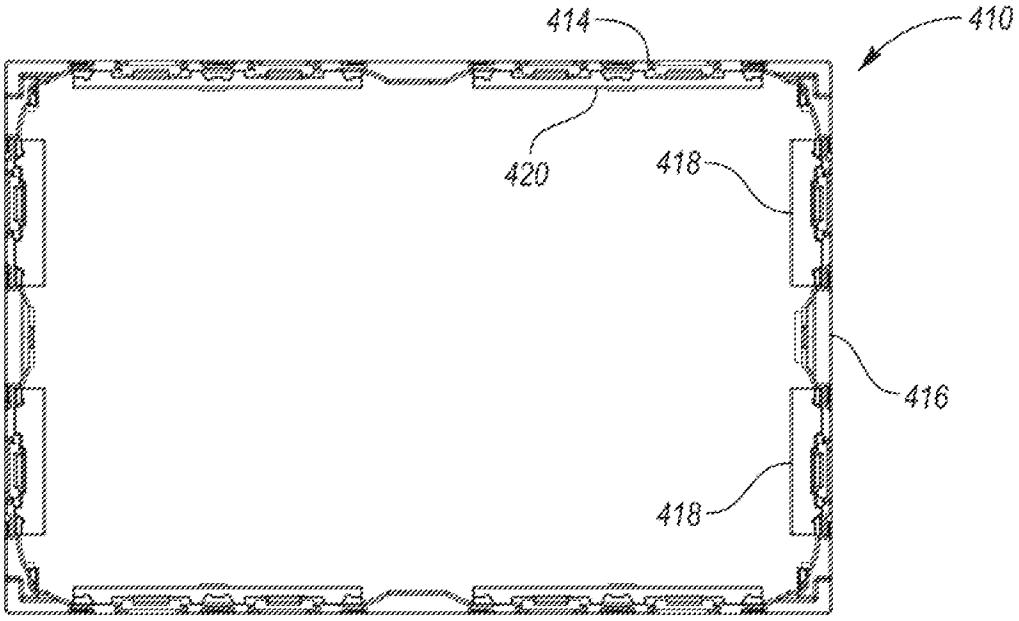
FIG. 76 is a top view of the crate of FIG. 68 with the spacers in the deployed position.
Figure 77:
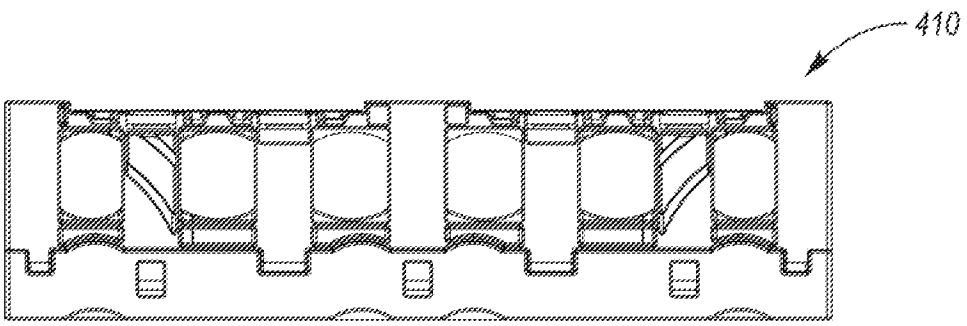
FIG. 77 is a side view of the crate of FIG. 76.
Figure 78:
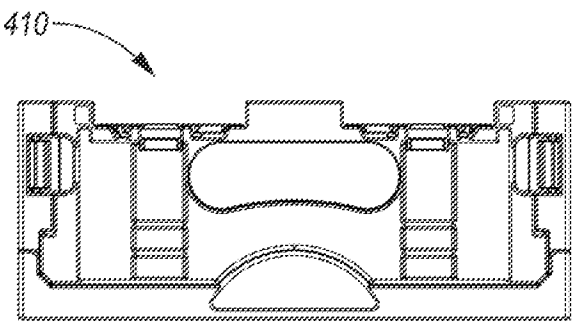
FIG. 78 is an end view of the crate of FIG. 76.
Figure 79:
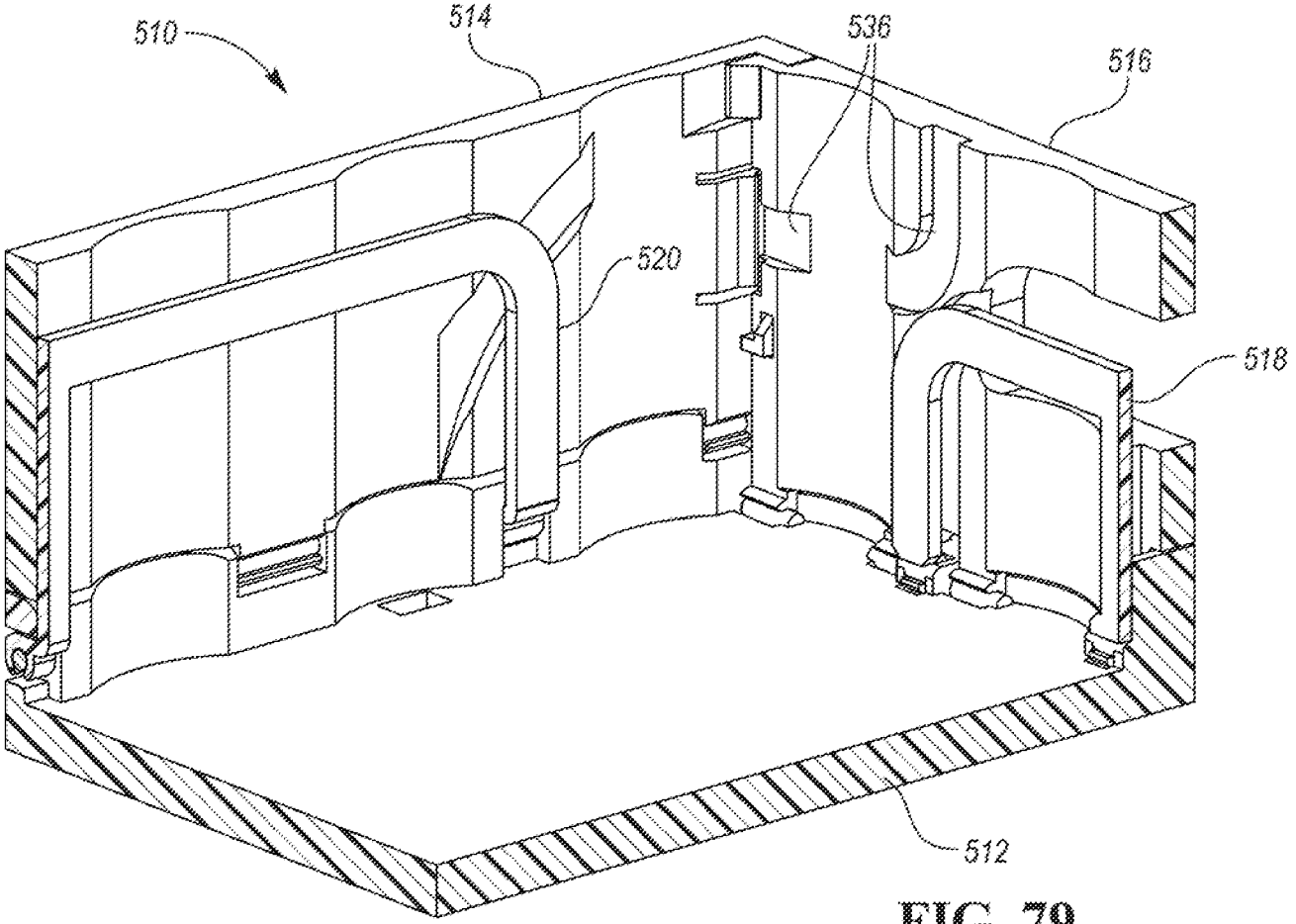
FIG. 79 shows an interior corner of a collapsible crate according to a sixth embodiment with the spacers in the deployed position.

FIG. 76 is a top view of the crate 410 with the spacers 418, 420 in the deployed position, such that they project into the interior of the crate 410 and block the recesses 430, 432 (FIG. 70). FIGS. 77 and 78 are side and end views of the crate 410 of FIG. 76.

FIGS. 79-84 show a collapsible crate 510 according to a sixth embodiment (a quarter of the crate 510 is shown, the rest would be symmetric). In this embodiment, the end spacers 518 and side spacers 520 are pivotably connected adjacent lower ends of the end walls 516 and side walls 514, respectively. Recesses 536 are formed in the end wall 516 for receiving the side spacers 520.

Figure 80:
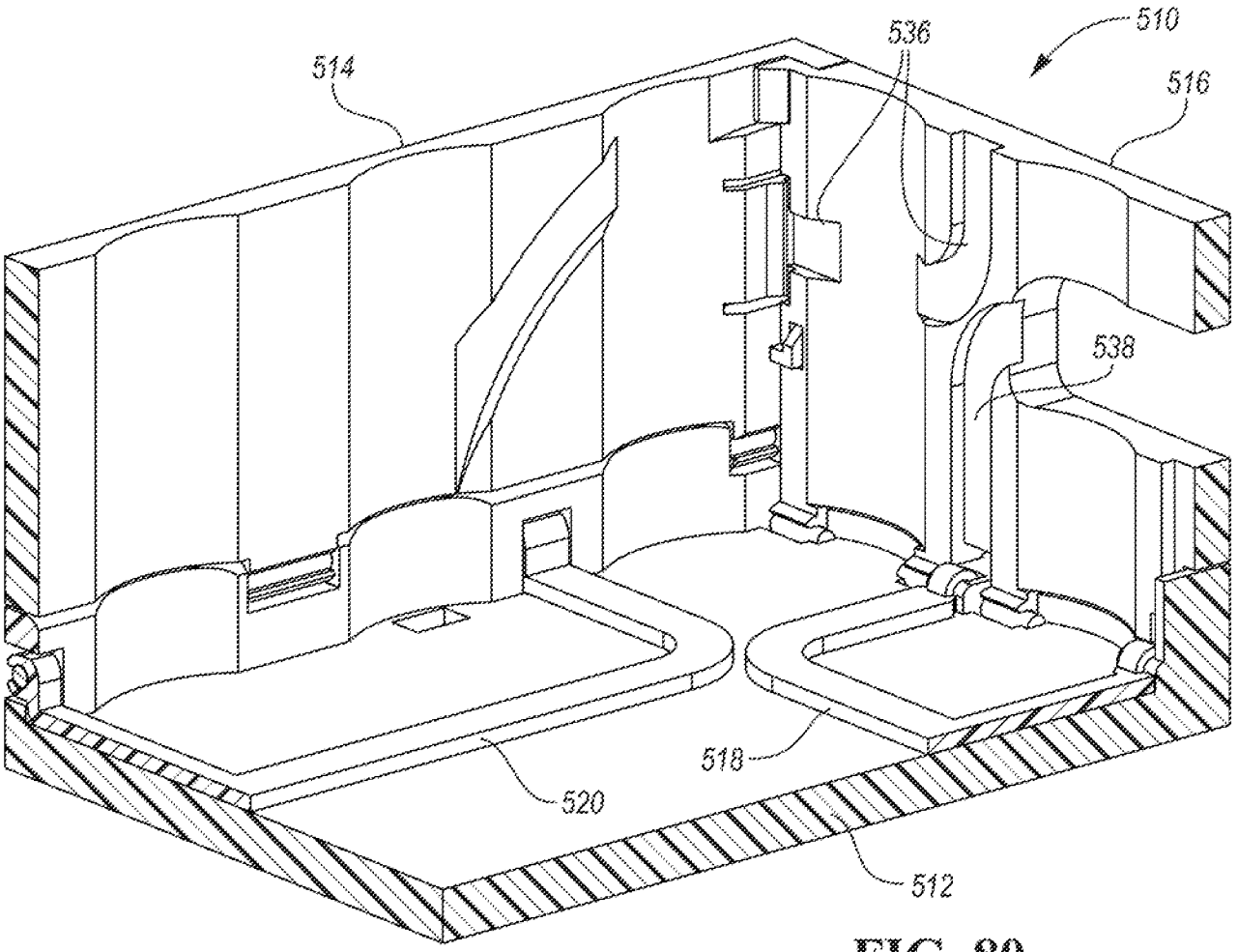
FIG. 80 shows the interior corner of the crate of FIG. 79 with the spacers pivoted downward to a stowed or retracted position.

As shown in FIG. 80, the spacers 518, 520 can be pivoted downward onto the base 512. A recess 538 is formed in the end wall for receiving the end spacer 518.

Figure 81:
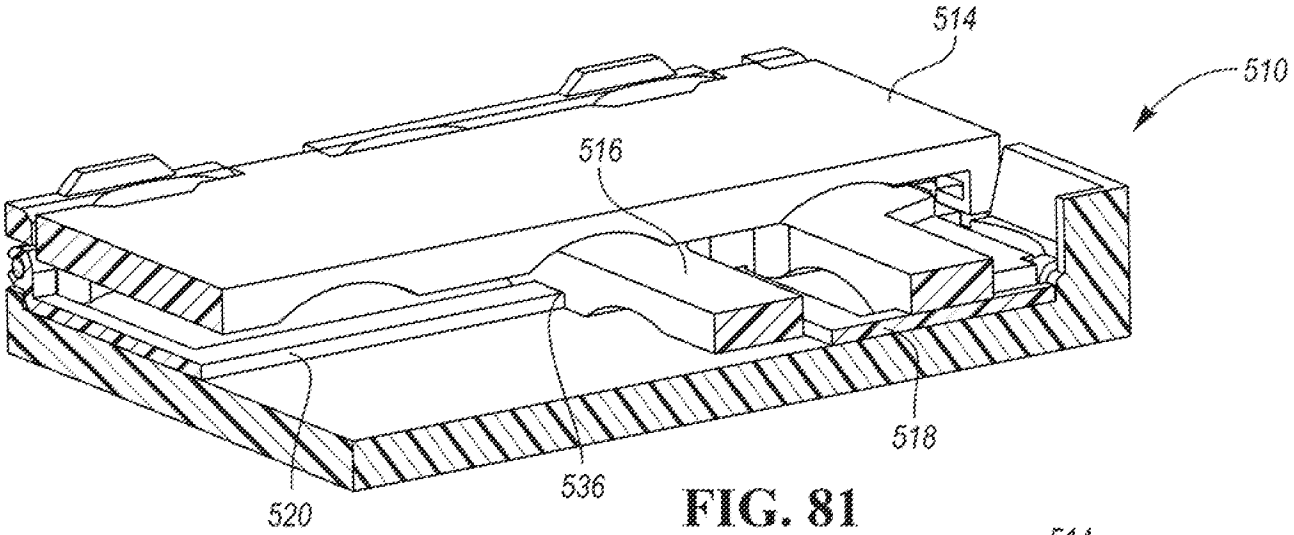
FIG. 81 shows the interior corner of the crate of FIG. 79 in the collapsed position.

FIG. 81 shows the crate 510 in the collapsed position. The side spacer 520 is received in the recesses 536 of the end wall 516 and the end spacer 518 is received in the recess 538 of the end wall 516.

Figure 82:
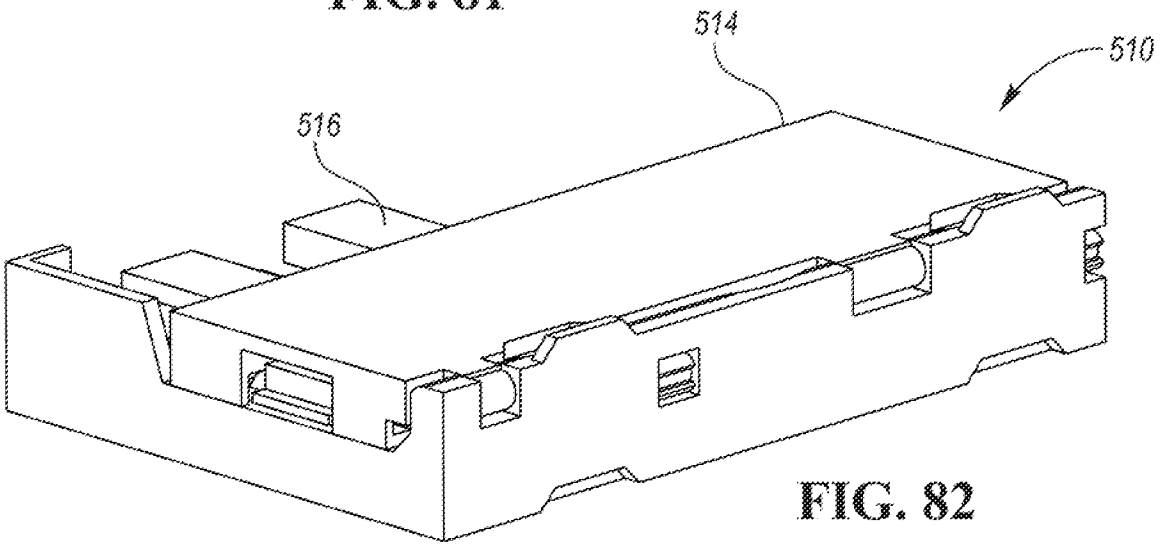
FIG. 82 shows an exterior view of the corner of the crate of FIG. 81.
Figure 83:
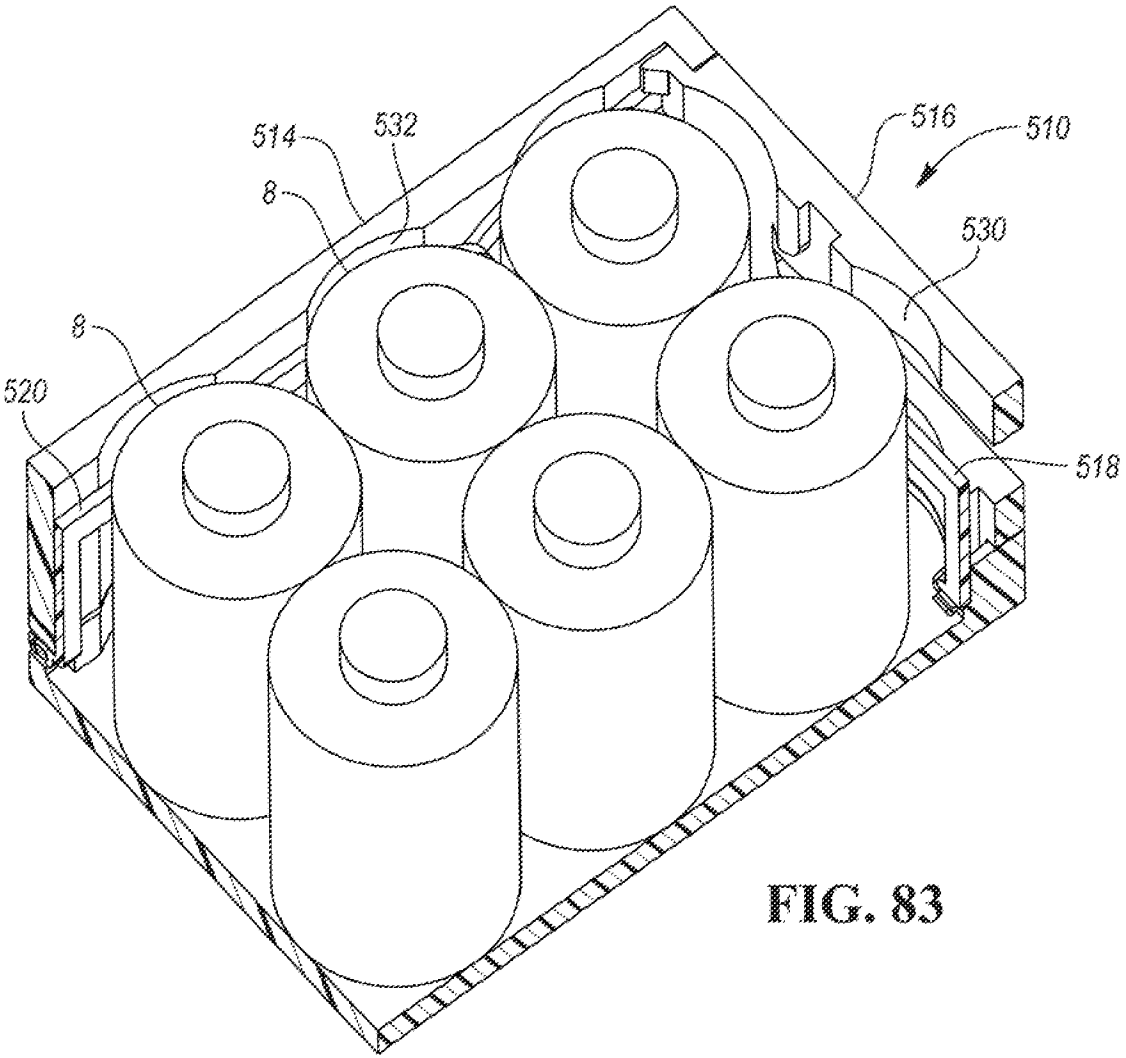
FIG. 83 shows the interior corner of the crate of FIG. 79 with the spacers deployed and with a plurality of beverage containers therein.
Figure 84:
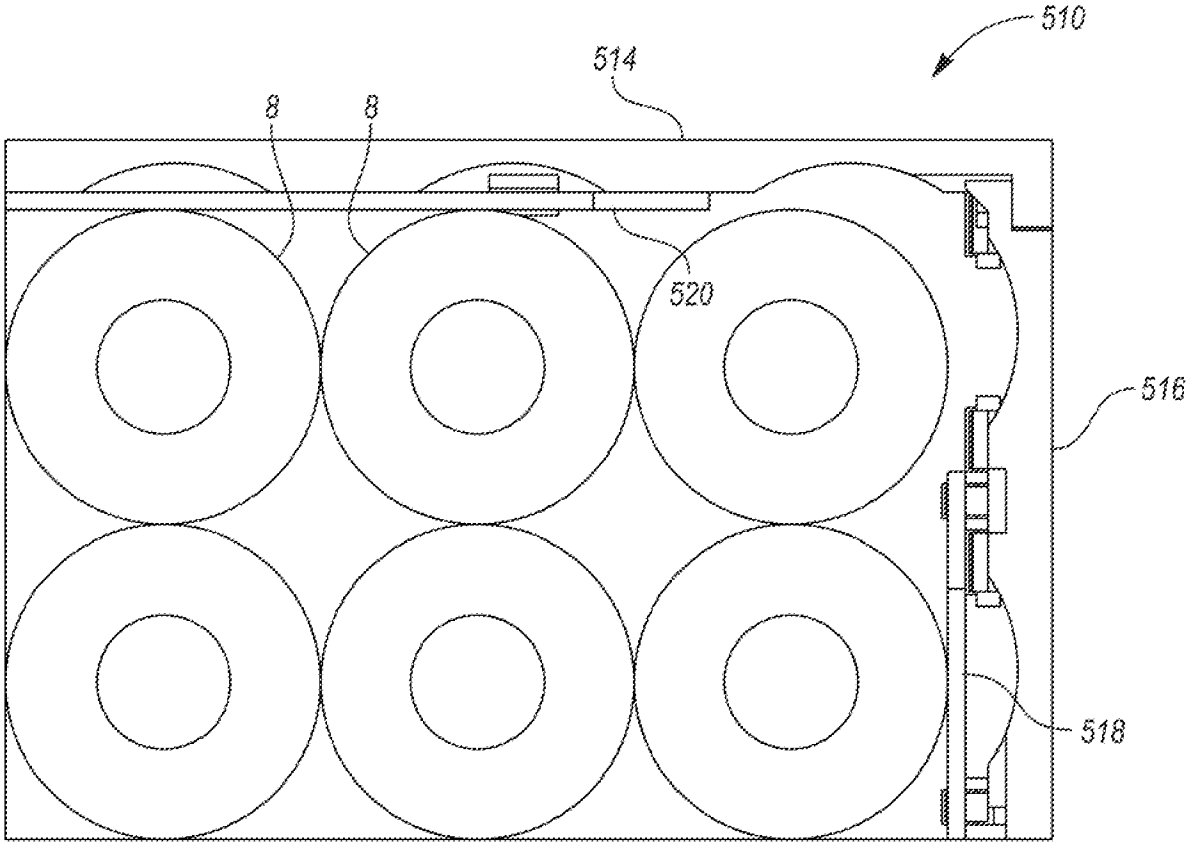
FIG. 84 is a top view of the crate of FIG. 83.

FIG. 82 is an exterior view of the crate 510 of FIG. 81. As shown in FIG. 83, when deployed, the spacers 518, 520 block the recesses 530, 532 in the end walls 516 and side walls 514, respectively, thereby effectively reducing the interior dimensions of the crate 510. FIG. 84 is a top view of the crate 510 of FIG. 83.

Figure 85:
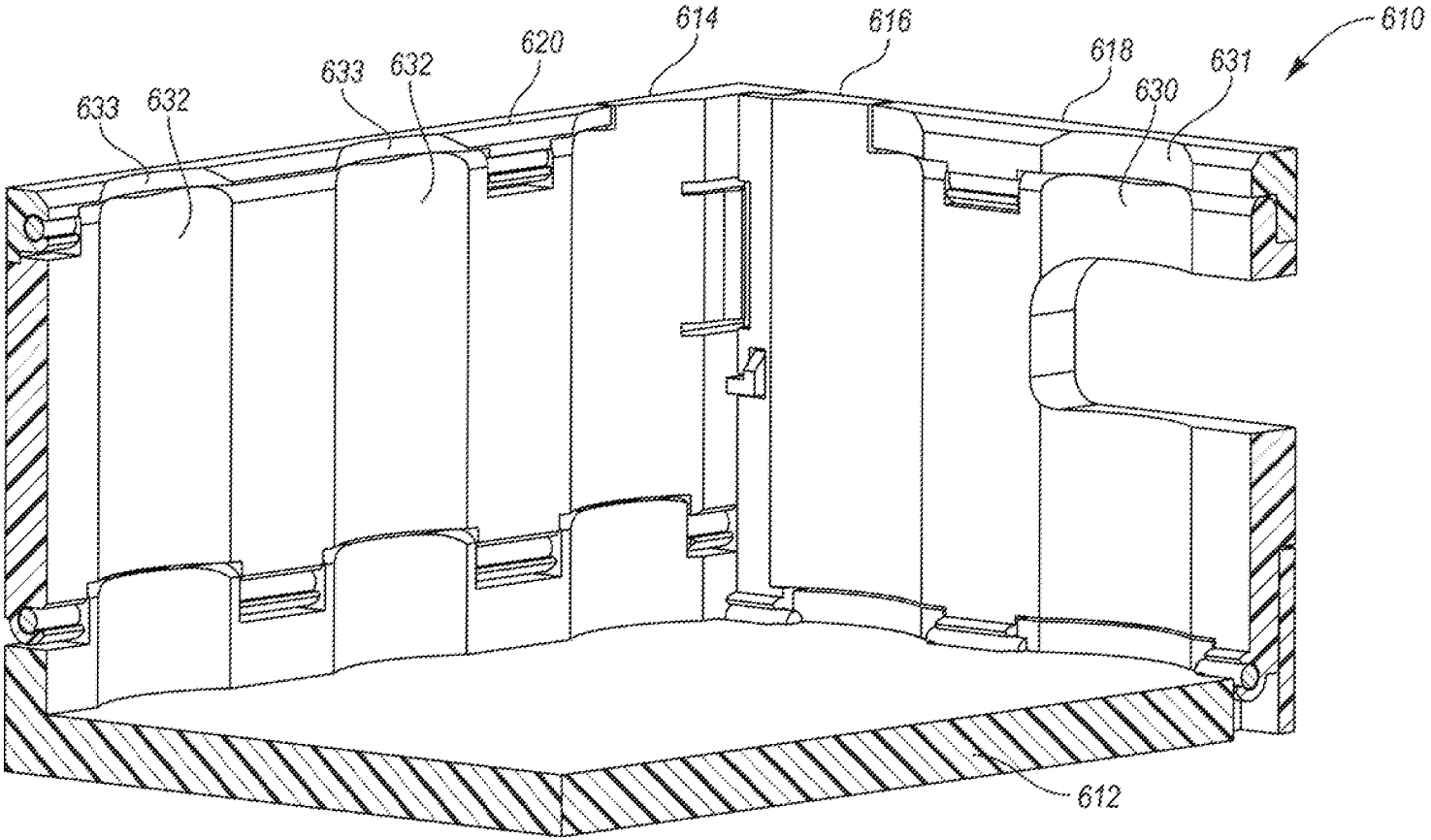
FIG. 85 shows a collapsible crate according to a seventh embodiment.

FIGS. 85-91 show a collapsible crate 610 according to a seventh embodiment. Again, the end walls 616 and side walls 614 include recesses 630, 632, respectively. End spacers 618 are pivotably connected adjacent upper edges of the end walls 616 and include recesses 631 that align with the recesses 630 in the end walls 616 when the spacers 618 is in the retracted position, as shown. Likewise, the side spacers 620 include recesses 633 that align with the recesses 632 and side walls 614 when the spacer 620 is in the retracted position, as shown in FIG. 85. In the stowed/retracted position shown in FIG. 85, the spacers 618, 620 extend upward from pivotable connections to upper ends of the end walls 616 and side walls 614, respectively.

Figure 86:
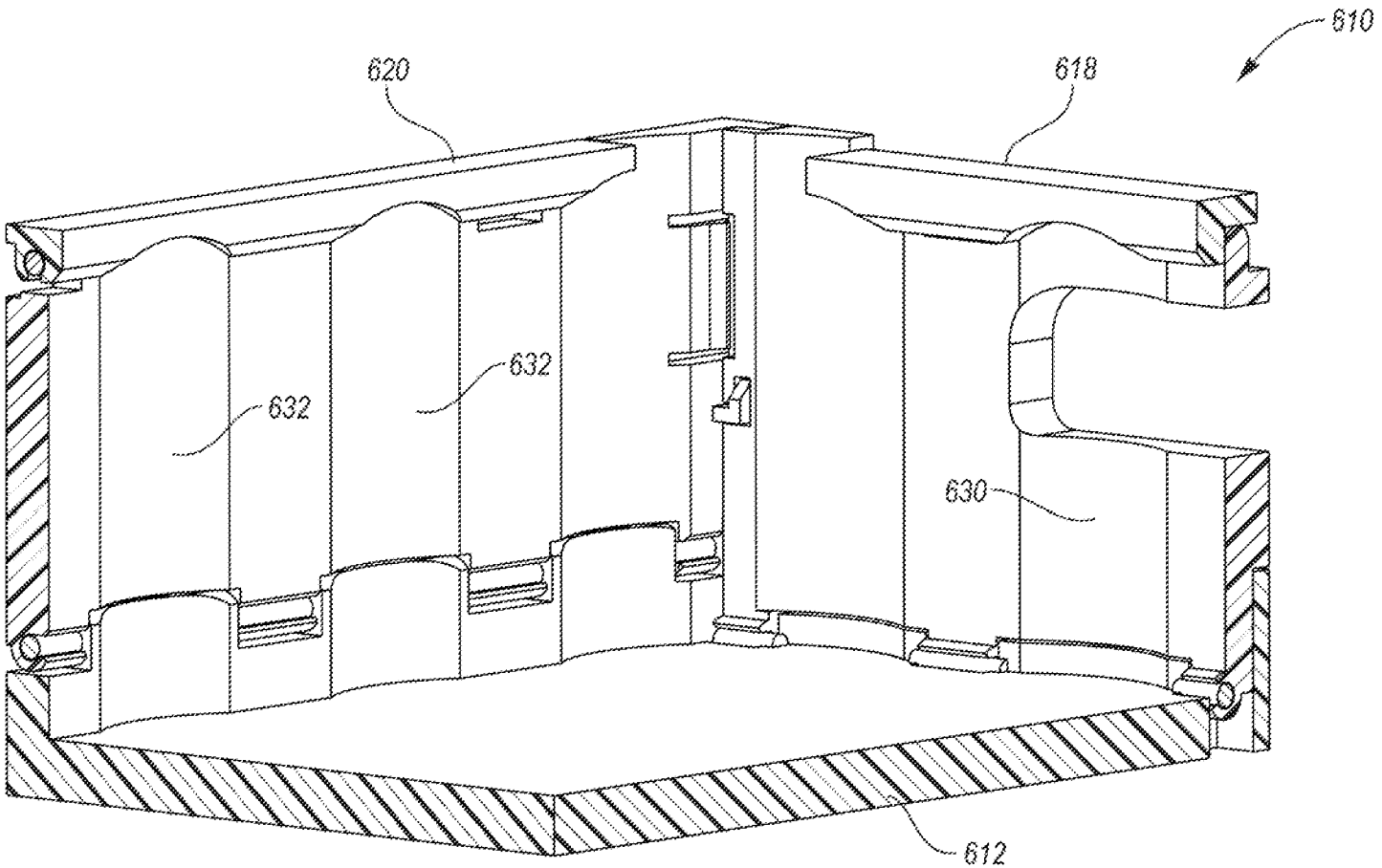
FIG. 86 shows the crate of FIG. 85 with the spacers pivoted downward.

FIG. 86 shows the spacers 618, 620 pivoted downward approximately ninety degrees such that they project into the interior of the crate 610 and block the recesses 630, 632, thereby reducing the effective dimensions of the crate 610.

Figure 87:
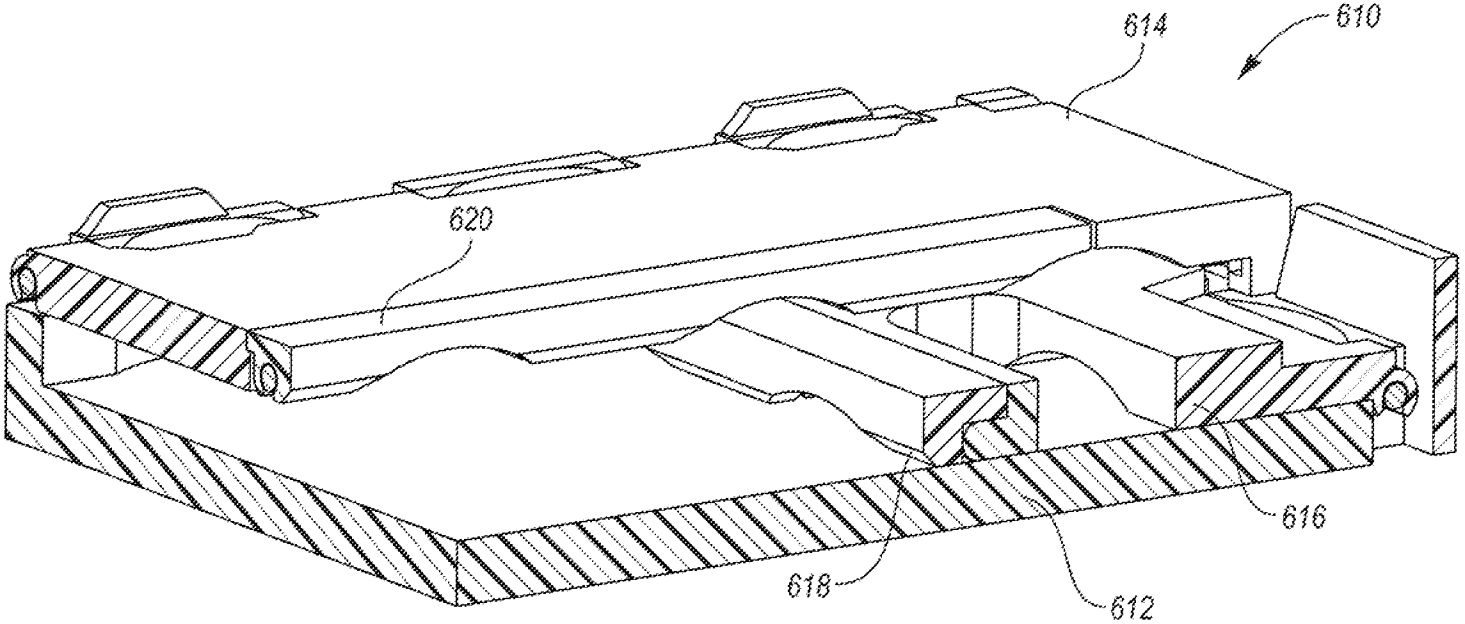
FIG. 87 shows the crate of FIG. 85 in a collapsed position.

FIG. 87 shows the crate 610 in the collapsed position.

Figure 88:
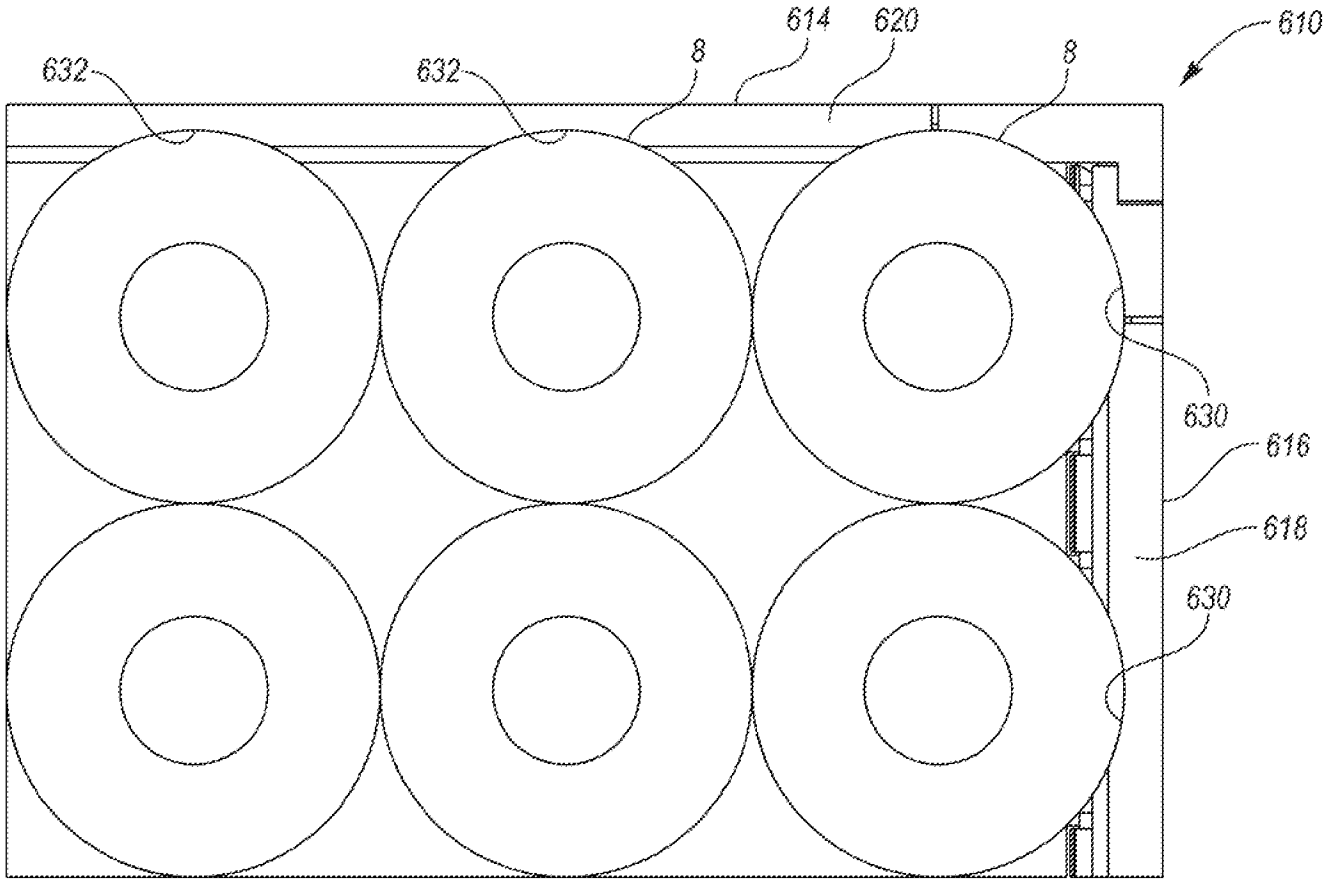
FIG. 88 shows the crate of FIG. 85 with the spacers in the retracted position and larger beverage containers stored therein.

FIG. 88 shows the crate 610 with the spacers 618, 620 in the retracted position and bottles 8 partially received in the recesses 632, 630 (and recesses 631, 633).

Figure 89:
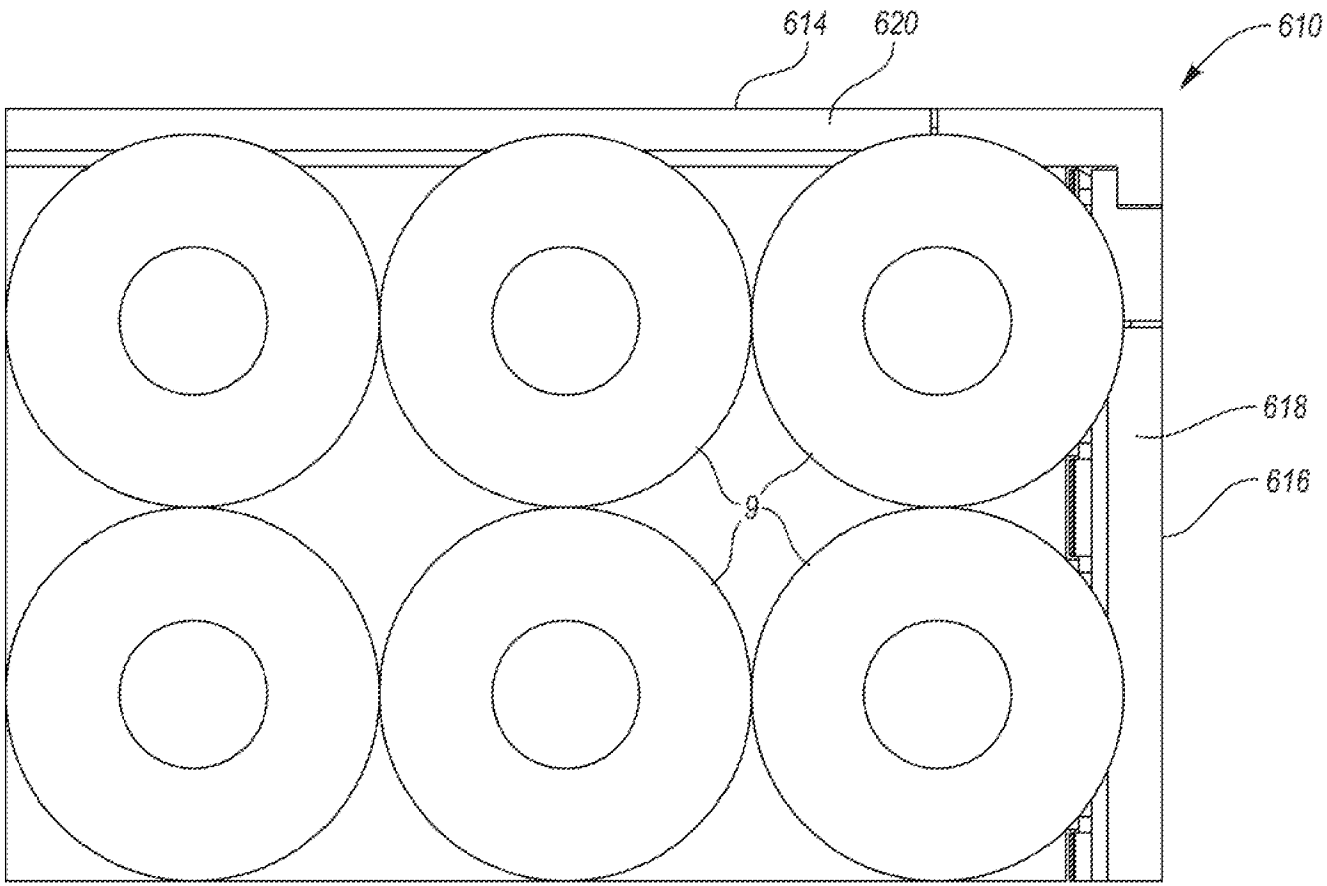
FIG. 89 shows the crate of FIG. 85 with the spacers in the deployed position and smaller beverage containers stored therein.

FIG. 89 shows the crate 610 with the spacers 618, 620 in the deployed position where they project into the interior of the crate and block the recesses 630, 632, thereby reducing the interior dimensions of the crate, such that they can reasonably snugly fit the smaller bottles 9.

Figure 90:
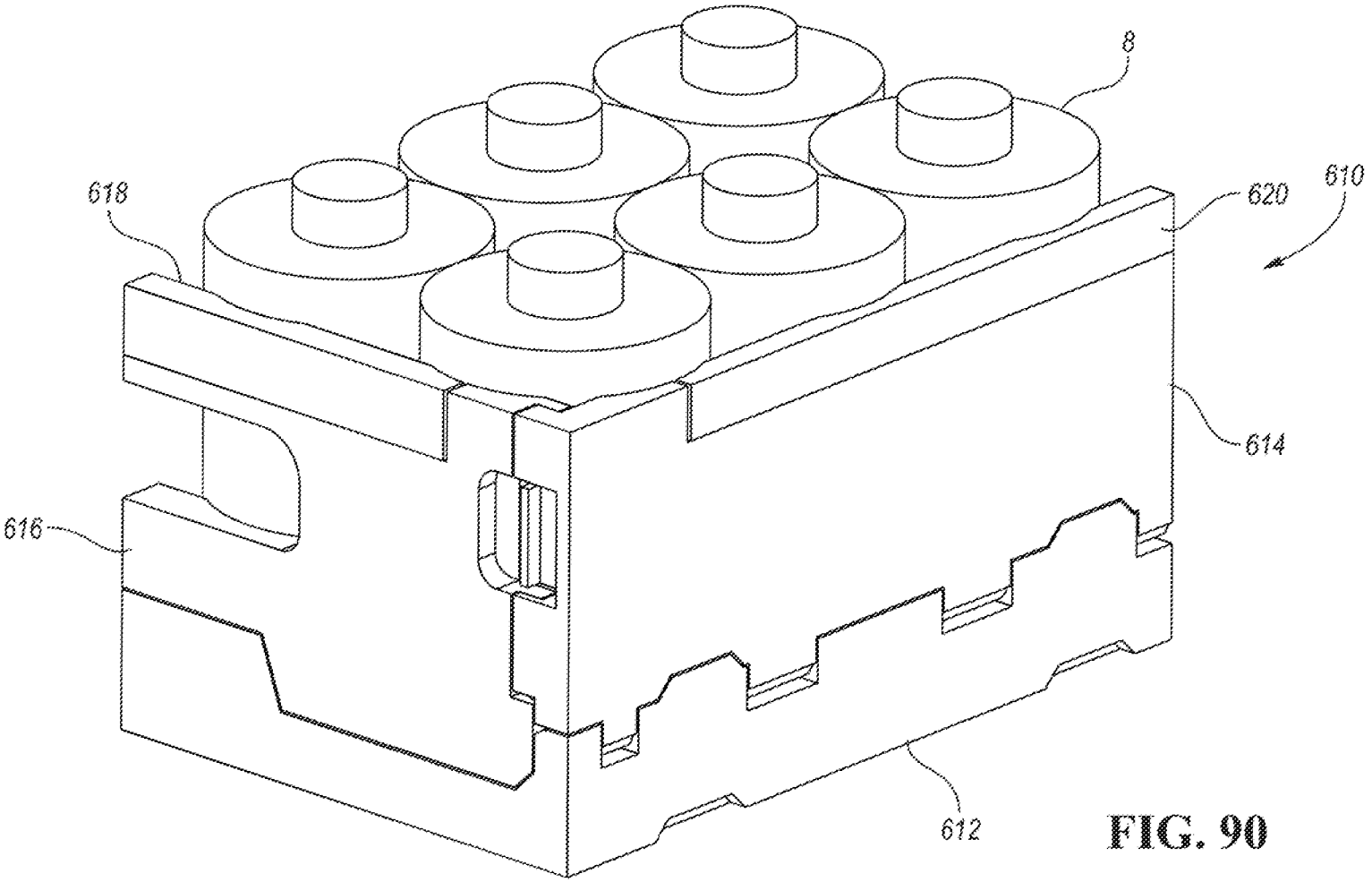
FIG. 90 is an exterior view of the crate and beverage containers of FIG. 88 with the spacers in the retracted position.

FIG. 90 is an exterior view of the crate 610 with the spacers 618, 620 in the retracted position.

Figure 91:
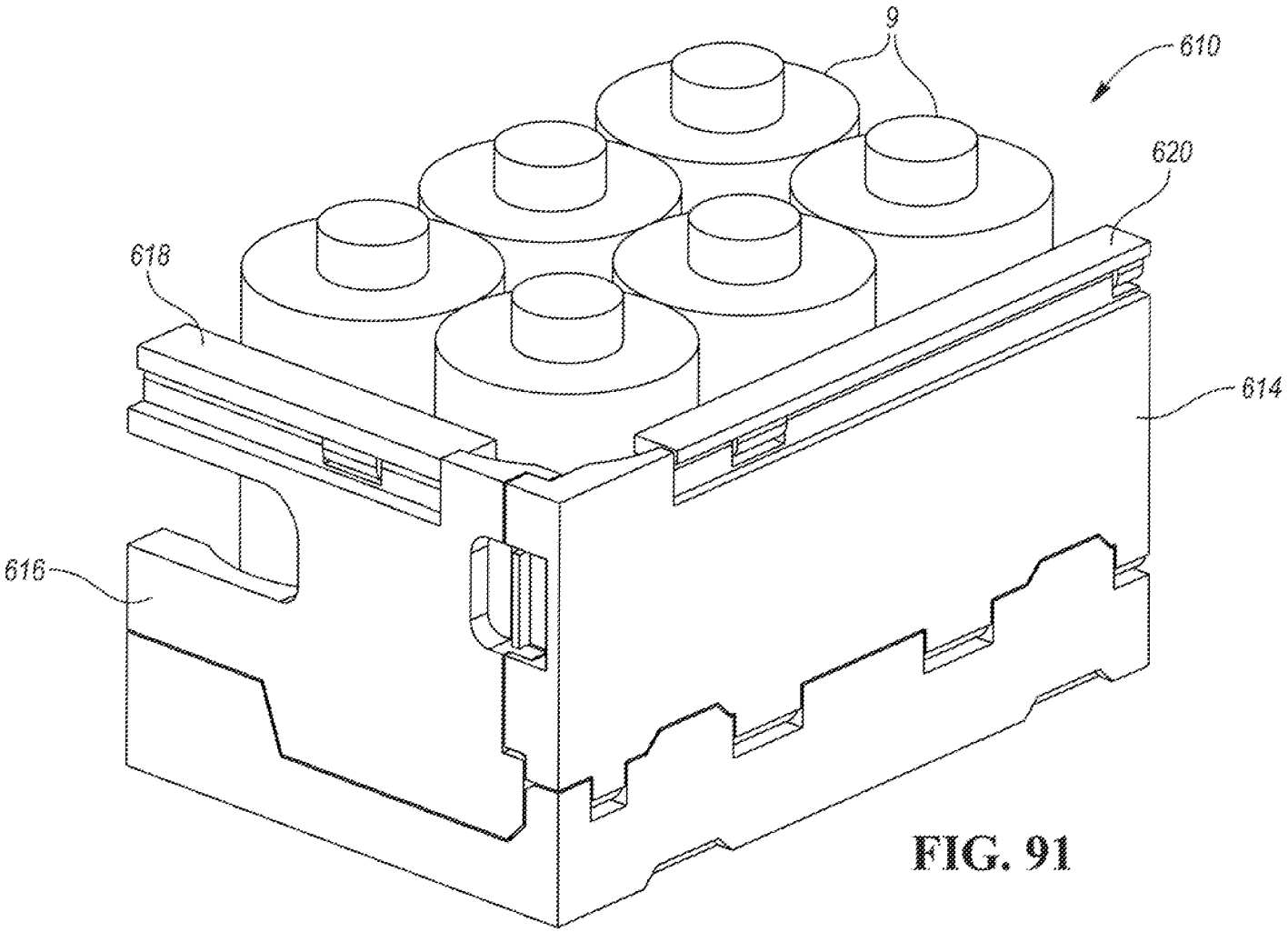
FIG. 91 is an exterior view of the crate and beverage containers of FIG. 89 with the spacers in the deployed position.

FIG. 91 is an exterior view of the crate 610 with the spacers 618, 620 in the deployed position.

Figure 92:
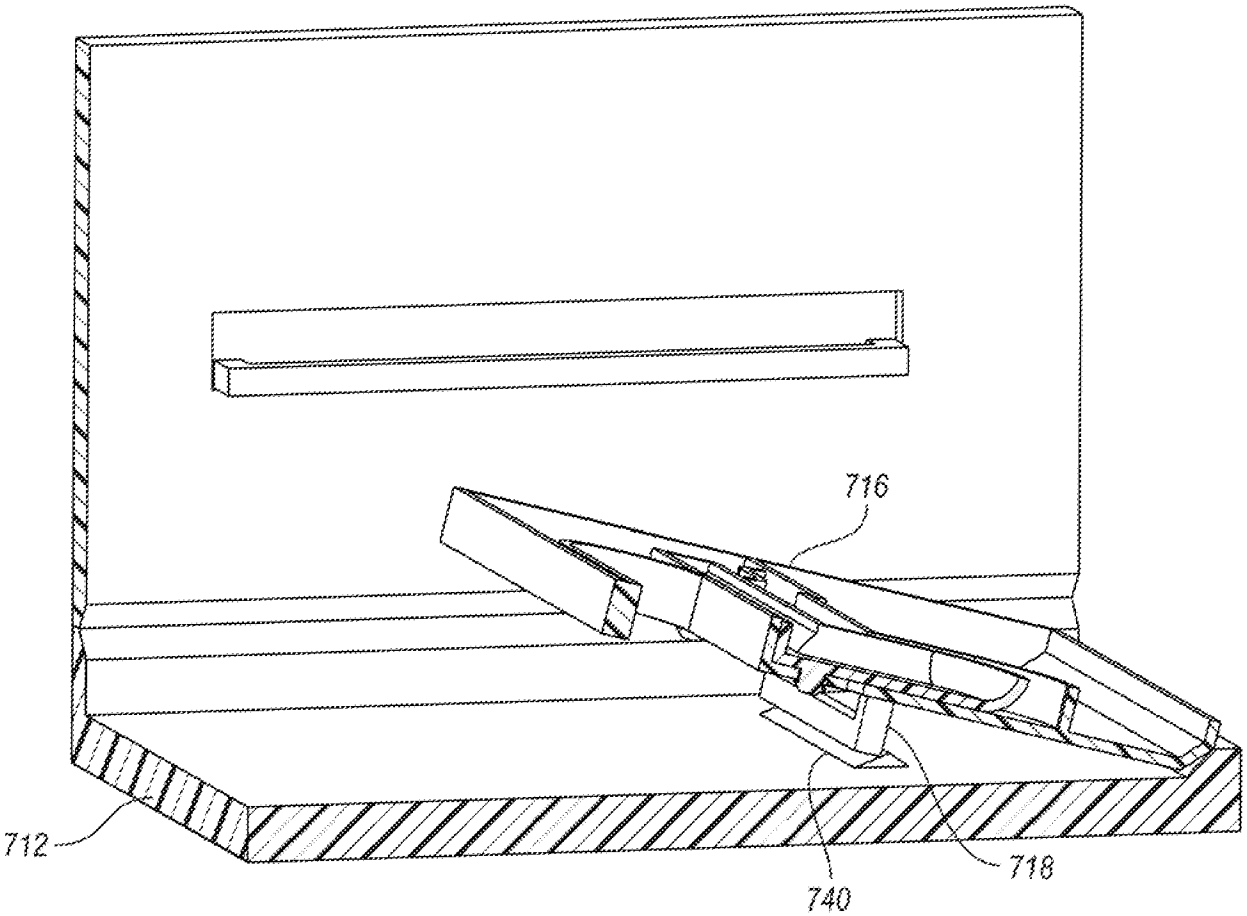
FIG. 92 shows an optional ramp that could be added to the base of some embodiments to automatically retract the spacer when the wall is collapsed onto the base.

As shown in FIG. 92, a ramp feature 740 can be formed on the base 712 to automatically move a spacer 718 from the deployed position to the retracted position as the wall 716 is pivoted downward onto the base 712 to the collapsed position. The ramp feature could be added to some of the collapsible crate embodiments disclosed above.

All of the embodiments described above provide crates that can be reconfigured to accommodate different sizes and/or different numbers of bottles. In all of the embodiments, except the third embodiment, the external footprint of the crate would not change between the two configurations. All of the features described above for altering the interior dimensions of the crate could be provided in a collapsible crate or in a low-depth nestable crate, or even a full-depth crate, again with the exception of the third embodiment. Other products besides beverage containers could be accommodated by any of the disclosed embodiments. Generally, it is contemplated that all of the disclosed components are formed of injection molded plastic; however, other materials and/or forming methods could be used for some of the components.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. Alphanumeric labels on method steps in the claims are for ease of reference in other steps or other claims and unless otherwise explicitly indicated in the claim do not signify a required sequence.

What is claimed is:

1. In combination, a beverage crate and a plurality of first beverage containers, the combination comprising:

the beverage crate including a base and a plurality of walls extending from the base, the base together with the plurality of walls defining a container interior receiving the plurality of first beverage containers, wherein a storage volume of the container interior is selectively adjustable to accommodate the plurality of first beverage containers and to be able to accommodate a plurality of second beverage containers, the beverage crate further including at least one spacer movable between a stowed position in which the storage volume of the container interior is larger and a deployed position in which the storage volume of the container interior is smaller; and the plurality of first beverage containers received in the storage volume and contacting the at least one spacer in the deployed position.

2. The combination of claim 1 wherein the at least one spacer is pivotably secured to one of the plurality of walls.

3. The combination of claim 2 wherein the at least one spacer is pivotable into a recess in the one of the plurality of walls to the stowed position.

4. The combination of claim 1 wherein the plurality of walls are pivotably connected to the base and movable between an upright position and a collapsed position on the base.

5. The combination of claim 1 wherein one of the plurality of walls includes a recess formed on an interior surface thereof for partially receiving one of the plurality of first beverage containers, wherein the at least one spacer is movable between the stowed position in which the recess is accessible from the container interior to increase the storage volume and the deployed position in which the recess is blocked from the container interior to reduce the storage volume.

6. The combination of claim 5 wherein the plurality of walls are pivotably connected to the base and movable between an upright position and a collapsed position on the base.

7. The combination of claim 5 wherein the at least one spacer is pivotable between the stowed position and the deployed position.

8. The combination of claim 7 wherein the at least one spacer is receivable in a base recess in the base in the stowed position.

9. The combination of claim 8 wherein the plurality of walls are pivotably connected to the base and movable between an upright position and a collapsed position on the base.

10. The combination of claim 5 wherein the at least one spacer is pivotably connected to the one of the plurality of walls or to the base.

11. The combination of claim 2 wherein the at least one spacer includes a plurality of recesses that align with recesses on an interior surface of the one of the plurality of walls when the at least one spacer is in the stowed position.

12. The combination of claim 11 wherein the plurality of walls are pivotably connected to the base and movable between an upright position and a collapsed position on the base.

13. In combination, a beverage crate and a plurality of beverage containers, the combination comprising:

the beverage crate including:

a base having opposed end edges and opposed side edges;

a pair of opposed end walls extending upward from the end edges of the base;

a pair of opposed side walls extending upward from the side edges of the base, the base together with the pair of opposed side walls and the pair of opposed end walls defining a container interior for receiving beverage containers;

an end spacer secured to one of the pair of opposed end walls, the end spacer movable between a stowed position in which the container interior is larger and a deployed position in which the container interior is smaller; and a side spacer secured to one of the pair of opposed side walls, the side spacer movable between a stowed position in which the container interior is larger and a deployed position in which the container interior is smaller; and the plurality of beverage containers received in the container interior and contacting the end spacer and the side spacer.

14. The combination of claim 13 wherein the end spacer includes a pair of arms extending from an elongated cross bar, and wherein the pair of arms are pivotably secured to the one of the pair of end walls.

15. The combination of claim 14 wherein the end spacer is received within a recess in the one of the pair of end walls in the stowed position.

16. The combination of claim 15 wherein the one of the pair of end walls includes a notch through an uppermost surface thereof and through which the end spacer is accessible.

17. The combination of claim 14 wherein the end spacer is completely below an uppermost surface of the one of the pair of end walls in the stowed position.

18. The combination of claim 17 wherein the side spacer includes a pair of arms extending from an elongated cross bar, the pair of arms pivotably secured to the one of the pair of side walls, the side spacer received within a recess in the one of the pair of side walls in the stowed position, the one of the pair of end walls including a notch through an uppermost surface thereof and through which the side spacer is accessible, the side spacer completely below an uppermost surface of the one of the pair of side walls in the stowed position.

* * * * *